US008499732B2

(12) United States Patent
Watanabe

(10) Patent No.: US 8,499,732 B2
(45) Date of Patent: Aug. 6, 2013

(54) VALVE TIMING CONTROL APPARATUS FOR INTERNAL COMBUSTION ENGINE

(75) Inventor: Atsushi Watanabe, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 13/443,395

(22) Filed: Apr. 10, 2012

(65) Prior Publication Data

US 2012/0192819 A1 Aug. 2, 2012

Related U.S. Application Data

(62) Division of application No. 12/619,986, filed on Nov. 17, 2009, now Pat. No. 8,171,904.

(30) Foreign Application Priority Data

Feb. 27, 2009 (JP) ..... 2009-045333
Feb. 27, 2009 (JP) ..... 2009-046208
Feb. 27, 2009 (JP) ..... 2009-046226

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS

| | | | |
|---|---|---|---|
| 5,520,145 | A | 5/1996 | Nagai et al. |
| 6,338,322 | B1 | 1/2002 | Ogawa et al. |
| 6,453,860 | B1 | 9/2002 | Hase |
| 7,637,236 | B2 | 12/2009 | Ochiai et al. |
| 8,171,904 | B2 * | 5/2012 | Watanabe ..... 123/90.17 |
| 2002/0038501 | A1 | 4/2002 | Iwasaki et al. |
| 2006/0090719 | A1 | 5/2006 | Imaizumi et al. |

FOREIGN PATENT DOCUMENTS

| | | | |
|---|---|---|---|
| EP | 1 128 026 | B1 | 8/2001 |
| JP | 05-113112 | A | 5/1993 |
| JP | 07-238806 | A | 9/1995 |
| JP | 09-324612 | A | 12/1997 |
| JP | 10-231712 | A | 9/1998 |
| JP | 2000-282820 | A | 10/2000 |
| JP | 2000-282821 | A | 10/2000 |
| JP | 2001-221018 | A | 8/2001 |
| JP | 2002-180809 | A | 6/2002 |
| JP | 2002-256825 | A | 9/2002 |
| JP | 2005-076482 | A | 3/2005 |
| JP | 2006-125318 | A | 5/2006 |
| WO | WO 2006/067896 | A1 | 6/2006 |

* cited by examiner

*Primary Examiner* — Ching Chang
(74) *Attorney, Agent, or Firm* — Foley & Lardner LLP

(57) ABSTRACT

In a housing body of an engine valve timing control apparatus, a vane rotor includes a vane, wherein the vane and shoes of the housing body define advance and retard chambers. The housing body is formed with a pulley adapted to winding of a belt, and formed with first bolt holes extending axially through the housing body, and formed with a sealing recess at an open axial end. A plate is fixedly inserted in the sealing recess, and formed with second bolt holes facing the first bolt holes. An annular first sealing ring is arranged between an inside periphery of the sealing recess and an outside periphery of the plate. An annular second sealing ring is arranged between the plate and an axial end surface of one of the shoes, wherein the second sealing ring extends circumferentially around one of the second bolt holes.

20 Claims, 18 Drawing Sheets

F6B
F6B
Ro
Ri
R
O
L
L1
L2
A
B
10
11
12
13
100
101
102
103
104
110
111
112
113
114
115
116
117
120
121
125
126
127
130
131
135
136
137
x

F18B
F18B
L
L1
L2
x
O
R
Ro
Ri
A
B
10
11
12
13
100
101
102
103
104
110
111
112
113
114
115
116
117
120
121
125
126
127
130
131
135
136
137

VALVE TIMING CONTROL APPARATUS FOR INTERNAL COMBUSTION ENGINE

CROSS-REFERENCE TO RELATED PATENT APPLICATIONS

The present application is a Divisional of U.S. application Ser. No. 12/619,986, filed Nov. 17, 2009 which is based on Japanese Patent Application Nos. 2009-045333, 2009-046208 and 2009-046226 filed Feb. 27, 2009, the entire contents of which are incorporated herein by reference.

BACKGROUND OF THE INVENTION

The present invention relates to valve timing control apparatuses for internal combustion engines.

Japanese Patent Application Publication No. 5-113112 discloses a valve timing control apparatus for an internal combustion engine, which includes a housing drivingly connected to a crankshaft, and a driven member rotatably mounted in the housing, and fixed to the camshaft, wherein valve timing, or rotational phase of the camshaft with respect to the crankshaft, is changed according to relative rotation of the driven member with respect to the housing which is caused by supply and drainage of working fluid. The housing has a cylindrical shape, and is formed with a pulley at its outside periphery. The pulley, around which a timing belt is wound, receives a torque from the crankshaft through the timing belt so that the housing rotates in synchronization with the crankshaft. The housing is constituted by a cylindrical housing body, and front and rear plates which are simply fixed to axial end surfaces of the housing body for sealing axial end openings of the housing body. For sealing, an O-ring as a sealing member is provided between the rear plate and one axial end surface of the housing body.

Japanese Patent Application Publication No. 2002-256825 discloses a valve timing control apparatus for an internal combustion engine which includes an intake valve timing control apparatus fixed to an intake camshaft, and an exhaust valve timing control apparatus fixed to an exhaust camshaft.

SUMMARY OF THE INVENTION

In recent years, there is an increasing demand for a compact valve timing control apparatus.

On the other hand, in the valve timing control apparatus disclosed by Japanese Patent Application Publication No. 2002-256825, it is generally advantageous to provide commonality and compatibility of components and workpieces of a housing, a driven member, etc. between the intake valve timing control apparatus and the exhaust valve timing control apparatus. In general, however, different requirements are set for an intake valve timing control apparatus and an exhaust valve timing control apparatus. Accordingly, the intake valve timing control apparatus employs a different set of components, or employs differently-shaped components, than the exhaust valve timing control apparatus. For example, in case the intake valve timing control apparatus is provided with an initial operating position where a driven member is in a most retarded position with respect to a housing, and the exhaust valve timing control apparatus is provided with an initial operating position where a driven member is in a most advanced position with respect to a housing, it may be necessary to provide the exhaust valve timing control apparatus with a biasing member such as a spring for biasing the driven member in a direction toward the most advanced position, although no such biasing member is needed for the intake valve timing control apparatus. This is because the driven member is generally subject to a torque from a camshaft in a direction toward the most retarded position in each of the intake valve timing control apparatus and the exhaust valve timing control apparatus.

In view of the foregoing, it is desirable to provide a valve timing control apparatus for an internal combustion engine which has such a structure that the valve timing control apparatus can be made compact, especially in its axial size. Specifically, it is desirable to provide a valve timing control apparatus for an internal combustion engine which has such a structure that the valve timing control apparatus can be made compact, especially in its axial size, while suitably preventing working fluid from leaking from the inside of a housing.

Moreover, it is desirable to provide a valve timing control apparatus for an internal combustion engine which includes an intake valve timing control apparatus, and an exhaust valve timing control apparatus, wherein the intake valve timing control apparatus and the exhaust valve timing control apparatus can be constituted by common components or workpieces.

According to one aspect of the present invention, a valve timing control apparatus for an internal combustion engine, comprises: a housing body having a hollow cylindrical shape having at least an open axial end, wherein the housing body is formed with a plurality of shoes at an inside periphery of the housing body, wherein each of the shoes projects inwardly in a radial direction of the housing body, and is formed with a first bolt hole, wherein the first bolt holes extend through the housing body in an axial direction of the housing body, and wherein the housing body is formed with a sealing recess at the open axial end of the housing body; a vane rotor rotatably mounted in the housing body, wherein the vane rotor includes a vane, wherein the vane and the shoes define an advance chamber and a retard chamber between the vane rotor and housing body, and wherein the advance chamber and the retard chamber are adapted to supply and drainage of fluid; a first plate fixedly inserted in the sealing recess of the housing body, the first plate sealing an axial end opening of the advance chamber and an axial end opening of the retard chamber, wherein the first plate is formed with second bolt holes whose positions are conformed to positions of the first bolt holes of the housing body respectively, and wherein the second bolt holes extend through the first plate; a plurality of bolts that are inserted through respective ones of the first bolt holes of the housing body and respective ones of the second bolt holes of the first plate, for fixing the first plate to the housing body; a pulley adapted to winding of a belt, and arranged to rotate with the housing body; an annular first sealing ring arranged between an inside periphery of the sealing recess and an outside periphery of the first plate; and an annular second sealing ring arranged between the first plate and an axial end surface of one of the shoes, wherein the second sealing ring extends circumferentially around one of the second bolt holes.

According to another aspect of the present invention, a valve timing control apparatus for an internal combustion engine, comprises: a housing body having a hollow cylindrical shape having first and second open axial ends, wherein the housing body is formed with a plurality of shoes at an inside periphery of the housing body, wherein each of the shoes projects inwardly in a radial direction of the housing body, and is formed with a first bolt hole, wherein the first bolt holes extend through the housing body in an axial direction of the housing body, and wherein the housing body is formed with a sealing recess at the first open axial end of the housing body; a vane rotor rotatably mounted in the housing body, wherein the vane rotor includes a vane, wherein the vane and the shoes define an advance chamber and a retard chamber between the vane rotor and housing body, and wherein the advance chamber and the retard chamber are adapted to supply and drainage of fluid; a first plate fixedly inserted in the sealing recess of the housing body, the first plate sealing an axial end opening of the advance chamber and an axial end opening of the retard chamber, wherein the first plate is formed with second bolt holes whose positions are conformed to positions of the first bolt holes of the housing body respectively, wherein the second bolt holes extend through the first plate, and wherein an inside periphery of each of the second bolt holes is formed with a female thread; a second plate sealing anther axial end of the advance chamber and another axial end of the retard chamber, wherein the second plate is formed with third bolt holes whose positions are conformed to the positions of the first bolt holes of the housing body respectively; a plurality of bolts that are inserted through respective ones of the third bolt holes of the second plate and respective ones of the first bolt holes of the housing body, and screwed in respective ones of the second bolt holes of the first plate, for fixing the first plate to the housing body; a pulley adapted to winding of a belt, and arranged to rotate with the housing body; an annular first sealing ring arranged between an inside periphery of the sealing recess and an outside periphery of the first plate; an annular second sealing ring arranged between the first plate and an axial end surface of one of the shoes, wherein the second sealing ring extends circumferentially around one of the second bolt holes; and an annular third sealing ring arranged between a portion of the second plate and a portion of the housing body which face each other, wherein the third sealing ring extends circumferentially inside of the first bolt holes of the housing body.

According to a further aspect of the present invention, a valve timing control apparatus for an internal combustion engine, comprises: a housing body having a hollow cylindrical shape having at least an open axial end, wherein the housing body is formed with a plurality of shoes at an inside periphery of the housing body, wherein each of the shoes projects inwardly in a radial direction of the housing body, and is formed with a first bolt hole, wherein the first bolt holes extend through the housing body in an axial direction of the housing body, and wherein the housing body is formed with a sealing recess at the open axial end of the housing body; a vane rotor rotatably mounted in the housing body, wherein the vane rotor includes a vane, wherein the vane and the shoes define an advance chamber and a retard chamber between the vane rotor and housing body, and wherein the advance chamber and the retard chamber are adapted to supply and drainage of fluid; a first plate fixedly inserted in the sealing recess of the housing body, the first plate sealing an axial end opening of the advance chamber and an axial end opening of the retard chamber, wherein the first plate is formed with second bolt holes whose positions are conformed to positions of the first bolt holes of the housing body respectively, and wherein the second bolt holes extend through the first plate; a plurality of bolts that are inserted through respective ones of the first bolt holes of the housing body and respective ones of the second bolt holes of the first plate, for fixing the first plate to the housing body; and a pulley adapted to winding of a belt, and arranged to rotate with the housing body; wherein a boundary between an inside periphery of the sealing recess and an outside periphery of the first plate is sealed; and wherein a boundary between an axial end surface of one of the shoes and an annular portion of the first plate is sealed, wherein the annular portion extends circumferentially around one of the second bolt holes.

BRIEF DESCRIPTION OF THE DRAWINGS

FIG. 6A is a front view along the axis of rotation, FIG. 6B is a side sectional view taken along a plane indicated by F6B-F6B in FIG. 6A, and FIG. 6C is a rear view along the axis of rotation.

FIG. 9A is a front view along the axis of rotation, and FIG. 9B is a side sectional view taken along a plane indicated by F9B-F9B in FIG. 9A.

FIG. 18A is a front view along the axis of rotation, FIG. 18B is a side sectional view taken along a plane indicated by F18B-F18B in FIG. 18A, and FIG. 18C is a rear view along the axis of rotation.

FIG. 19A is a front view along the axis of rotation, and FIG. 19B is a side sectional view taken along a plane indicated by F19B-F19B in FIG. 19A.

DETAILED DESCRIPTION OF THE INVENTION

Figure 1:
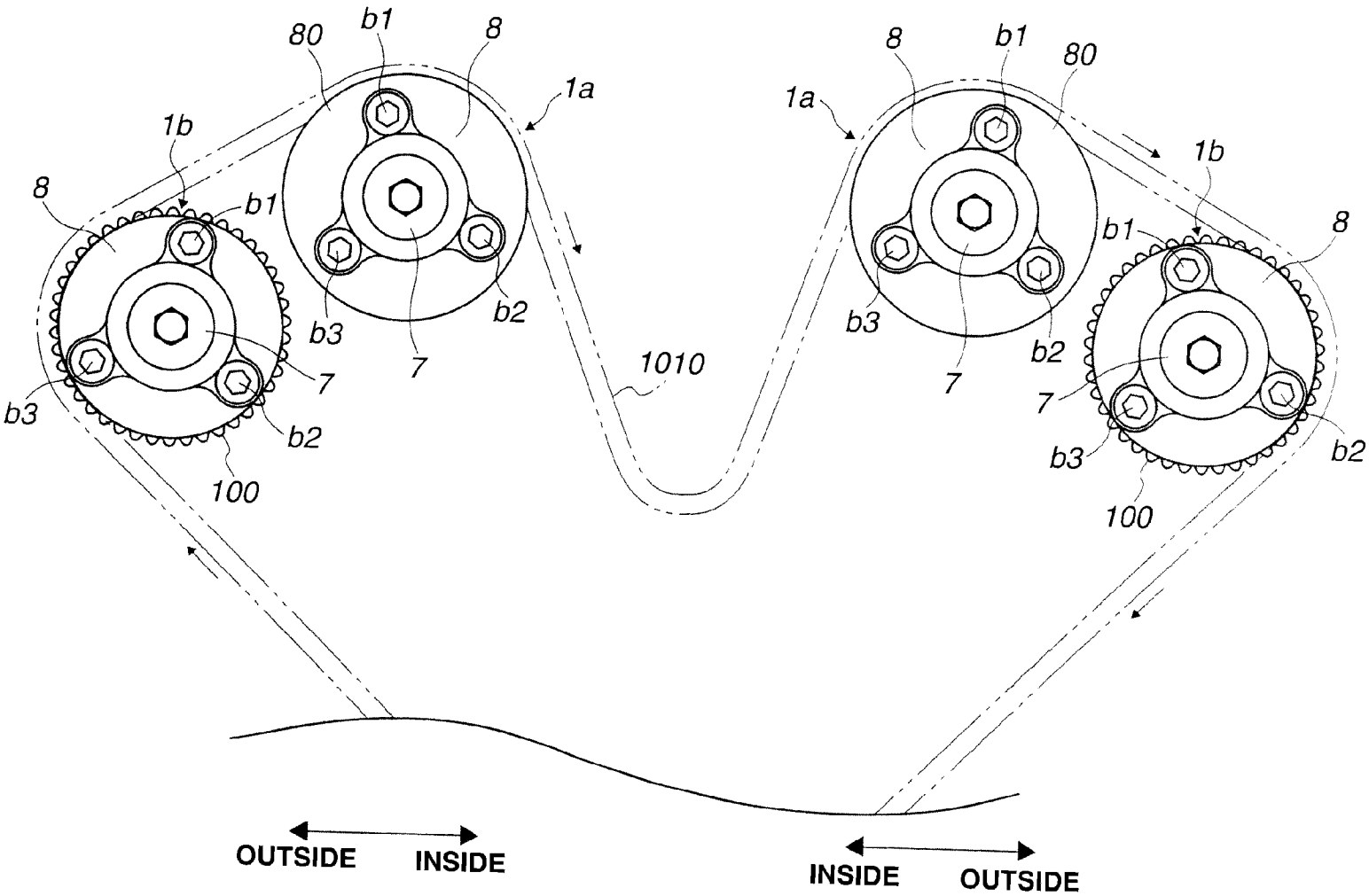
FIG. 1 is a front view of a valve timing control apparatus according to an embodiment of the present invention in which a pair of intake valve timing control apparatuses and a pair of exhaust valve timing control apparatuses are mounted to an internal combustion engine, as viewed in an axial direction of the internal combustion engine.

<<Construction of Valve Timing Control Apparatus>> FIG. 1 is a front view of a valve timing control apparatus according to an embodiment of the present invention in which a pair of intake valve timing control apparatuses 1*a* and a pair of exhaust valve timing control apparatuses 1*b* are mounted to an internal combustion engine, as viewed in an axial direction of the internal combustion engine. The axial direction is an axial direction of a crankshaft of the internal combustion engine, which is identical to an axial direction of intake camshafts or exhaust camshafts. The intake valve timing control apparatus 1*a* and exhaust valve timing control apparatus 1*b* are collectively referred to as valve timing control apparatus 1. The internal combustion engine is a V-type DOHC engine in which a pair of cylinder banks are arranged in a V-shape spreading from the crankshaft as viewed in the axial direction, and each cylinder bank is provided with a camshaft for actuating intake valves, or intake camshaft 3*a*, and a camshaft for actuating exhaust valves, or exhaust camshaft 3*b*. Intake camshafts 3*a* and 3*a* are arranged inside of exhaust camshafts 3*b* and 3*b* in a lateral direction of a cylinder block of the internal combustion engine, as shown in FIG. 1.

Valve timing control apparatus 1 is mounted to one axial end of the internal combustion engine. Specifically, each intake valve timing control apparatus 1*a* is fixedly mounted to an axial end of respective intake camshaft 3*a*, whereas exhaust valve timing control apparatus 1*b* is fixedly mounted to an axial end of respective exhaust camshaft 3*b*. Each intake valve timing control apparatus 1*a* is provided with a pulley 100. Similarly, each exhaust valve timing control apparatus 1*b* is provided with a pulley 100. A timing belt 1010 is put over pulleys 100, as indicated by long dashed double-short dashed lines in FIG. 1. Timing belt 1010 is a toothed belt made of rubber, and transmits a torque from the crankshaft to pulleys 100. Each of intake valve timing control apparatuses 1*a* and exhaust valve timing control apparatuses 1*b* is rotated by the torque transmitted through the pulley 100. While rotating, each of intake valve timing control apparatuses 1*a* and exhaust valve timing control apparatuses 1*b* optimally controls variable opening and closing timings of respective intake valves or exhaust valves according to a state of operation of the internal combustion engine.

In the following, an X-axis is assumed to extend along the axial direction of intake camshaft 3*a* or exhaust camshaft 3*b*. Along the X-axis, a positive direction is defined as a direction from an axial end of intake camshaft 3*a* or exhaust camshaft 3*b* where no intake valve timing control apparatus 1*a* or no exhaust valve timing control apparatus 1*b* is provided to an axial end of intake camshaft 3*a* or exhaust camshaft 3*b* where intake valve timing control apparatuses 1*a* and exhaust valve timing control apparatuses 1*b* are mounted.

Figure 2:
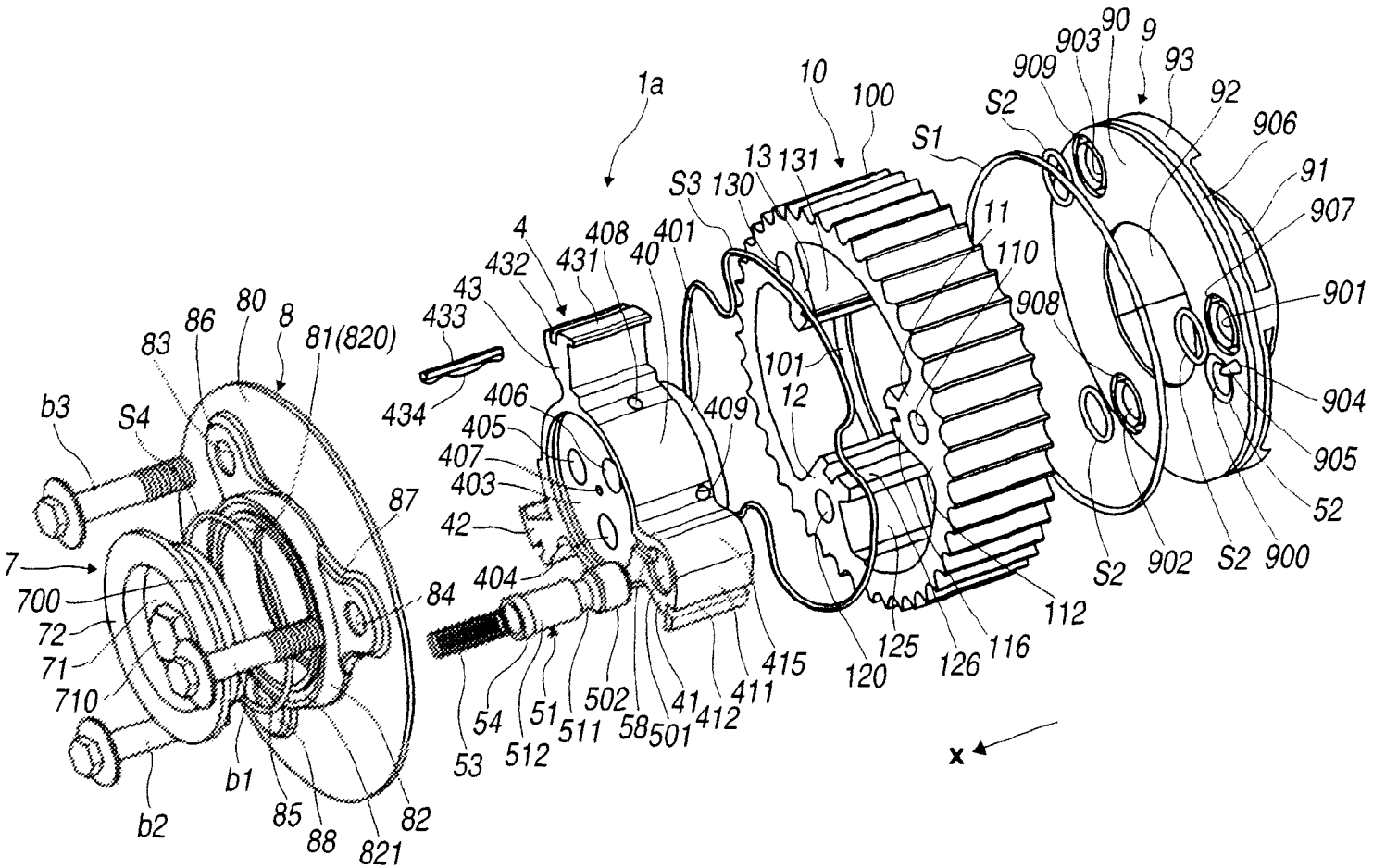
FIG. 2 is an exploded perspective view of the intake valve timing control apparatus.
Figure 3:
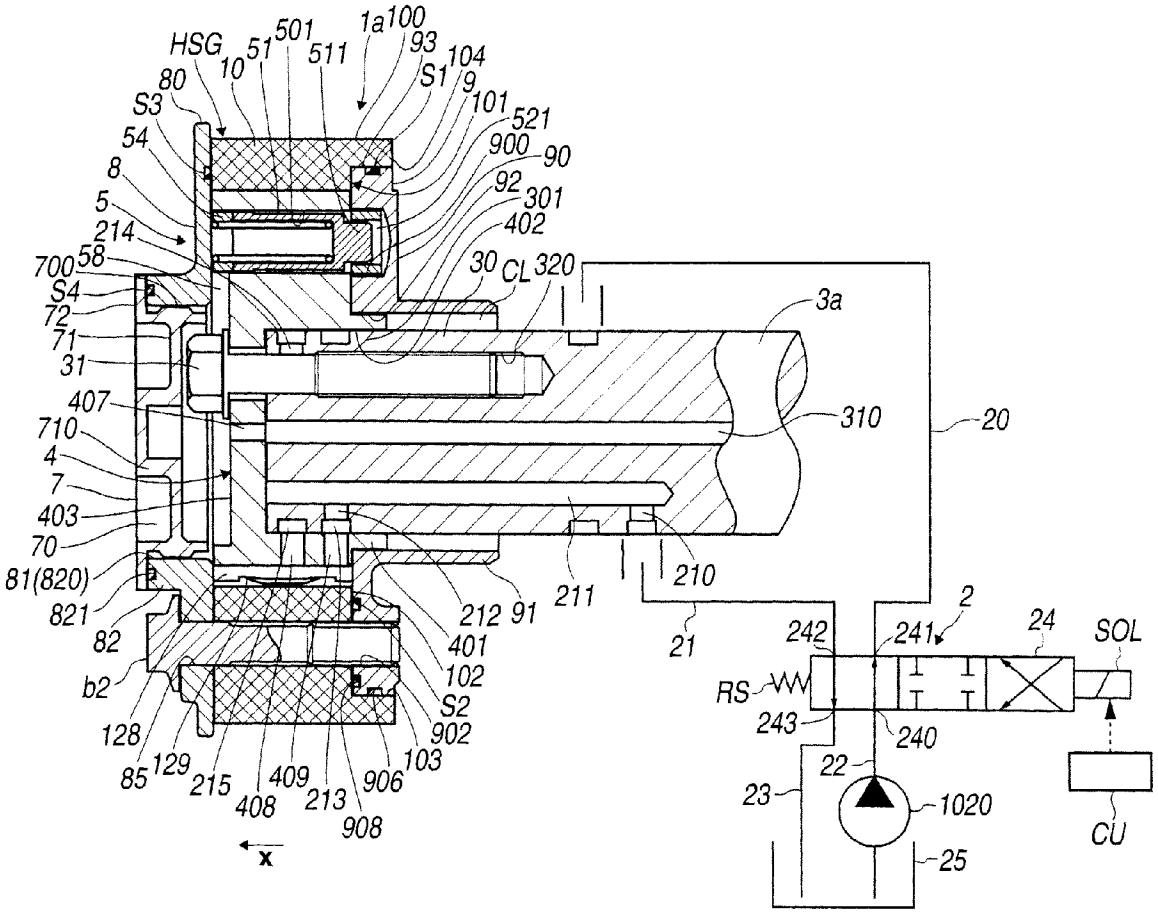
FIG. 3 is a partial side sectional view of the intake valve timing control apparatus, taken along a plane passing through an axis of rotation of the intake valve timing control apparatus.
Figure 4:
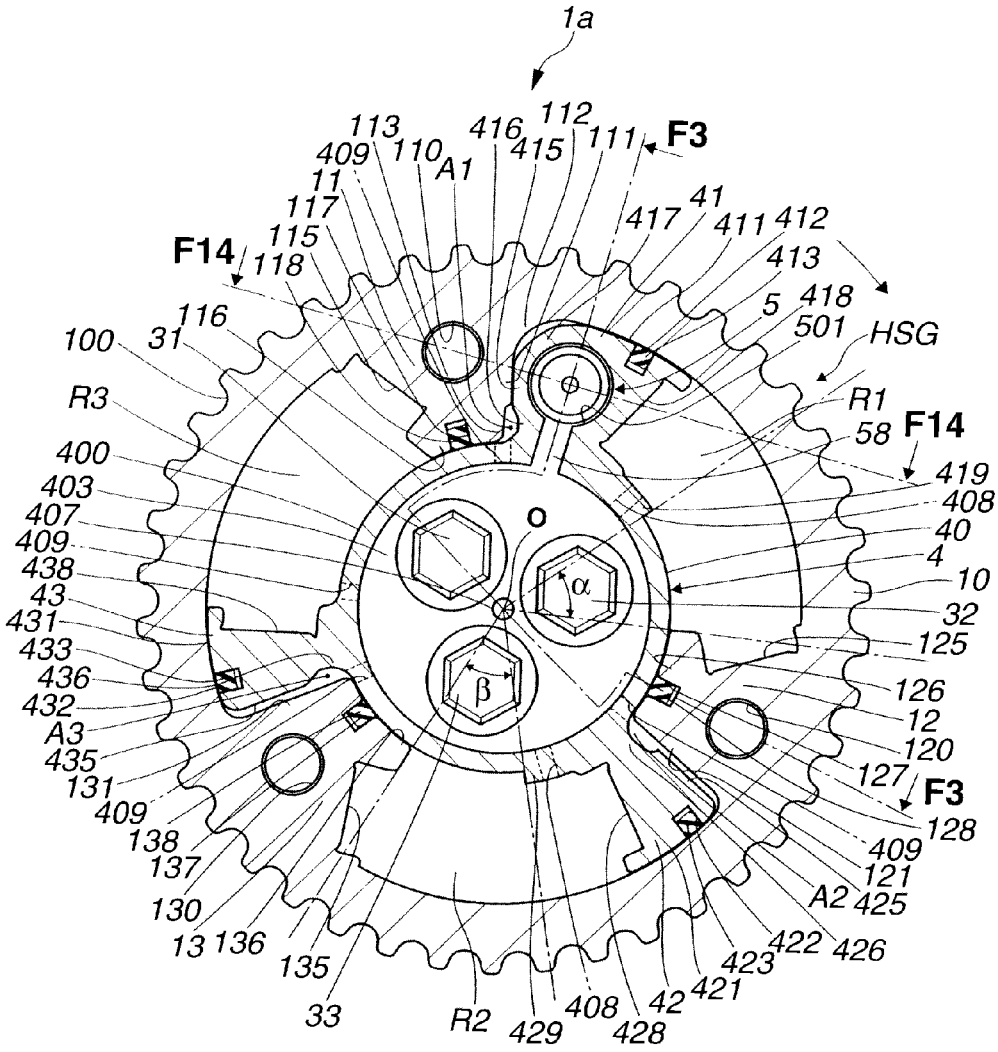
FIG. 4 is a front view of the intake valve timing control apparatus in a most retarded state, as viewed along the axis of rotation.
Figure 5:
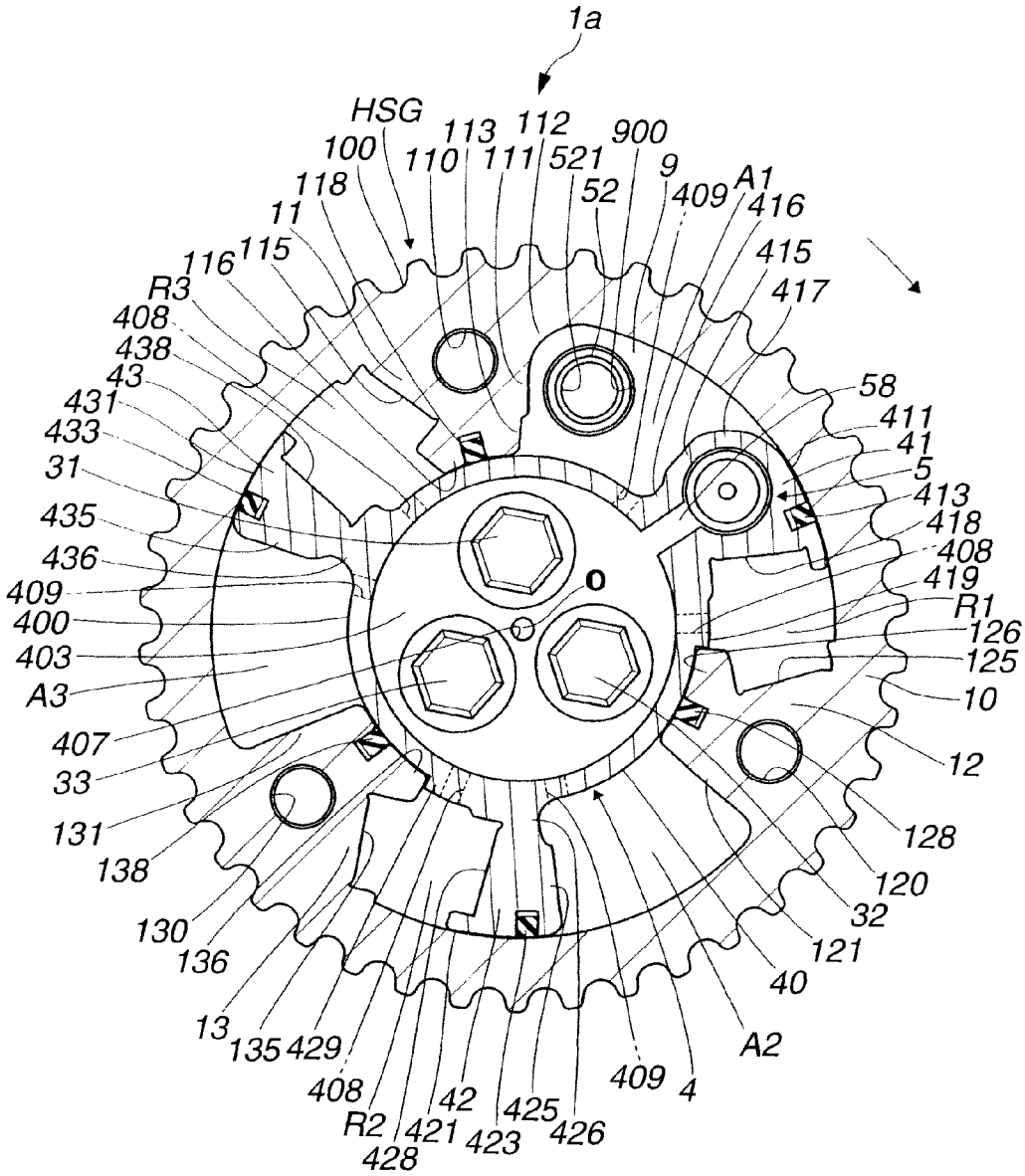
FIG. 5 is a front view of the intake valve timing control apparatus in a most advanced state, as viewed along the axis of rotation.

<Construction of Intake Valve Timing Control Apparatus> The following describes construction of intake valve timing control apparatus 1*a* with reference to FIGS. 2 to 14. FIG. 2 is an exploded perspective view of intake valve timing control apparatus 1*a*, where parts are arranged in the axial direction. FIG. 3 is a partial side sectional view of intake valve timing control apparatus 1*a*, taken along a plane passing through an axis of rotation "O" (shown in FIG. 4) of intake valve timing control apparatus 1*a*, i.e. taken along a plane indicated by a long dashed short dashed line F3-F3 in FIG. 4. FIGS. 4 and 5 are front views of intake valve timing control apparatus 1*a* under a condition that a front plate 8, etc. are removed, as viewed from the X-axis positive side, where retard fluid passages 408 and advance fluid passages 409 are indicated by broken lines.

Intake valve timing control apparatus 1*a* is a hydraulic actuator or hydraulically driven type phase actuation mechanism which is operated by receipt of supply of working fluid from a hydraulic fluid supply and drainage mechanism 2 or drainage of working fluid to hydraulic fluid supply and drainage mechanism 2. Supply and drainage of working fluid by hydraulic fluid supply and drainage mechanism 2 is controlled by a controller "CU" as a control means. Intake valve timing control apparatus 1*a* controls variable valve timing of the intake valves by continuously changing a rotational phase of intake camshaft 3*a* with respect to the crankshaft by supplied working fluid.

Intake valve timing control apparatus 1*a* includes pulley 100, a housing "HSG", and a vane rotor 4. Pulley 100 transmits a torque from the crankshaft to housing HSG. Vane rotor 4 is mounted inside of housing HSG for relative rotation with respect to housing HSG. The torque is transmitted from housing HSG to vane rotor 4 through working fluid. Vane rotor 4 transmits the torque to intake camshaft 3*a*.

Housing HSG includes a front plate 8, a rear plate 9, and a housing body 10. Housing body 10 has a hollow cylindrical shape with open longitudinal ends. This is because housing body 10 is formed by extrusion as described in detail below. Front plate 8 has a disc shape, which seals and closes a front longitudinal end (X-axis positive side end) of housing body 10. Rear plate 9 has a disc shape, which seals and closes a rear longitudinal end (X-axis negative side end) of housing body 10.

Figures 6A, 6B, 6C:
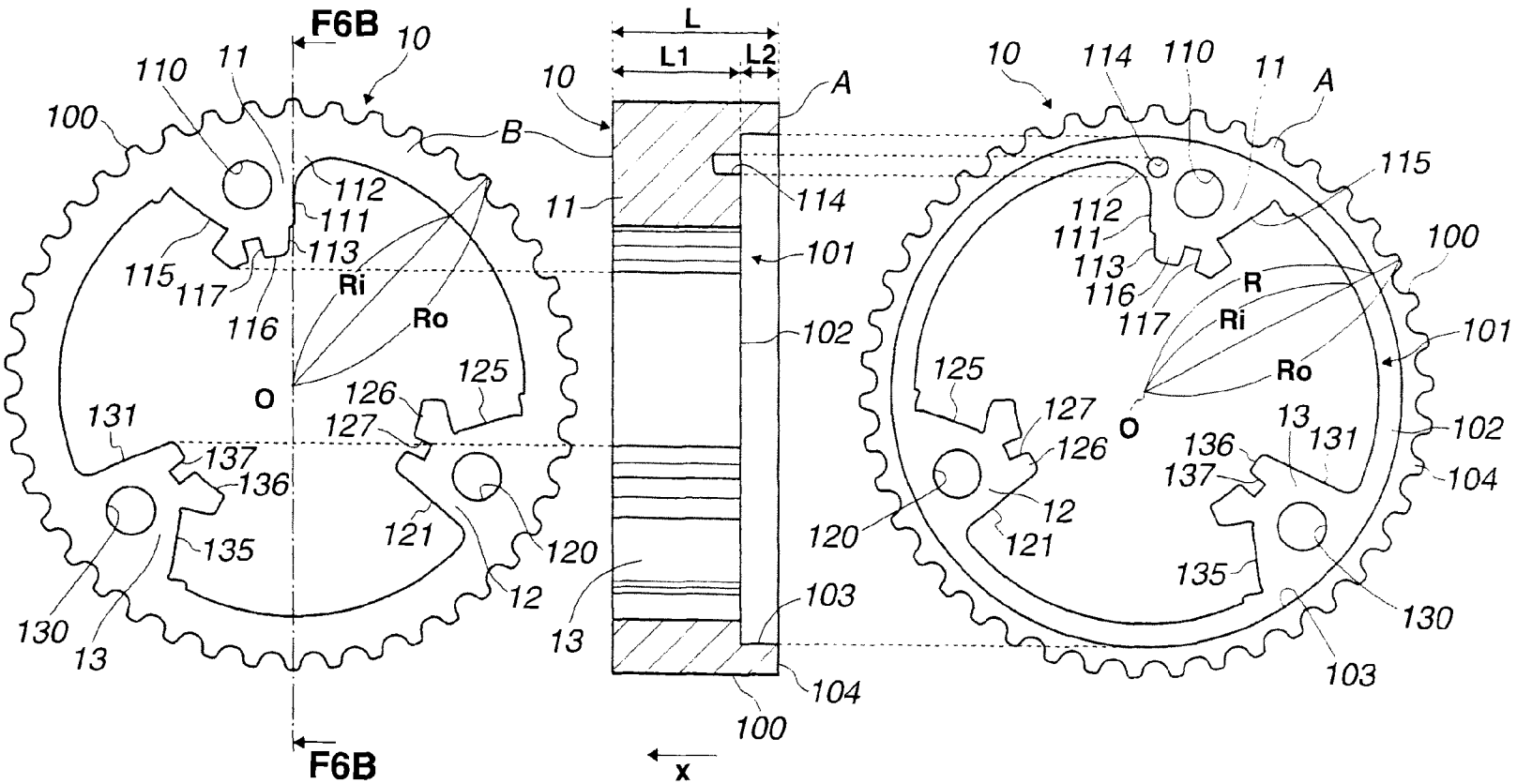
FIGS. 6A, 6B and 6C are views of a housing body of the intake valve timing control apparatus, where
Figure 7:
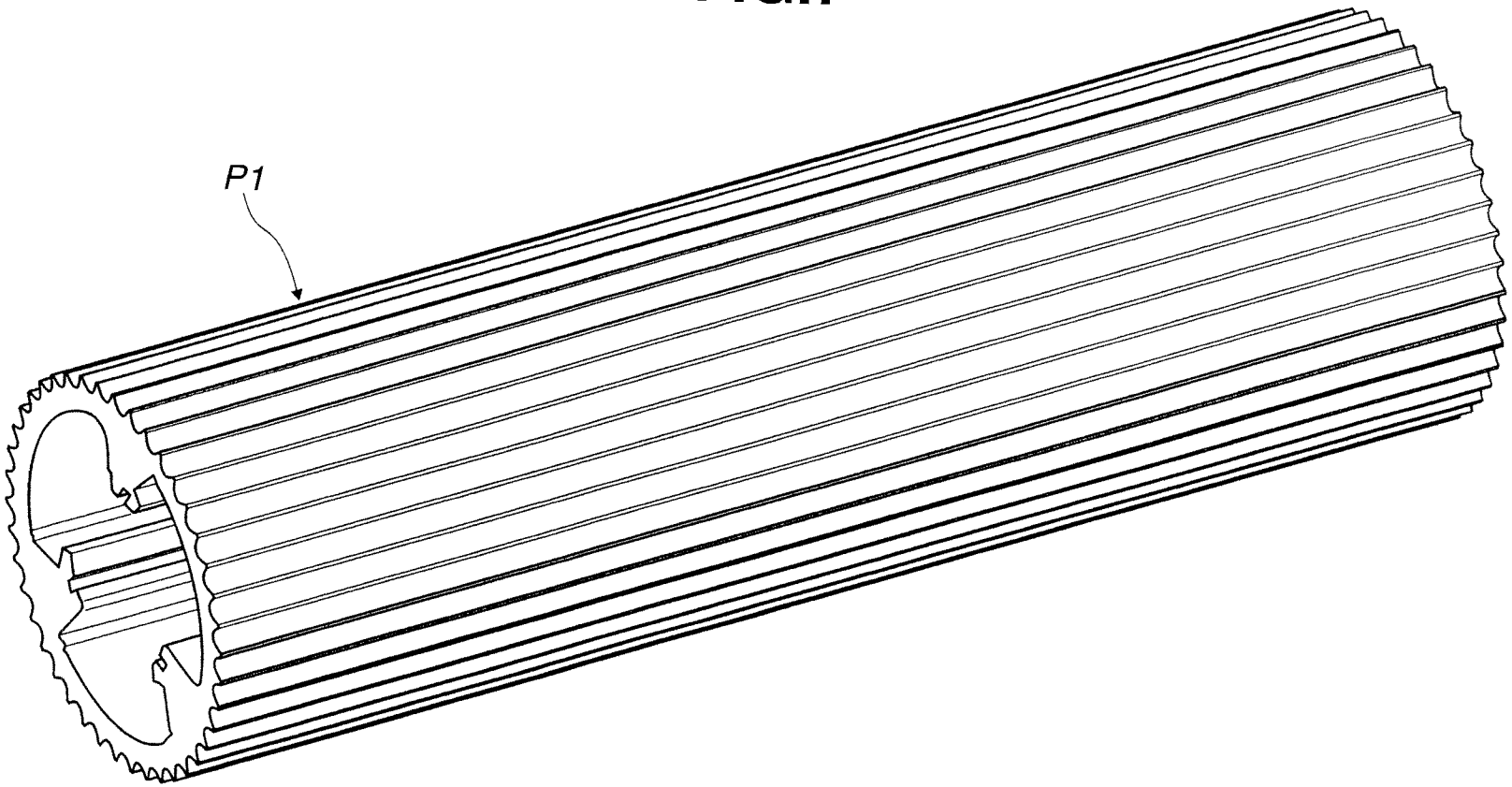
FIG. 7 is a perspective view of a first workpiece for the housing body of the intake valve timing control apparatus or a housing body of the exhaust valve timing control apparatus.
Figure 8:
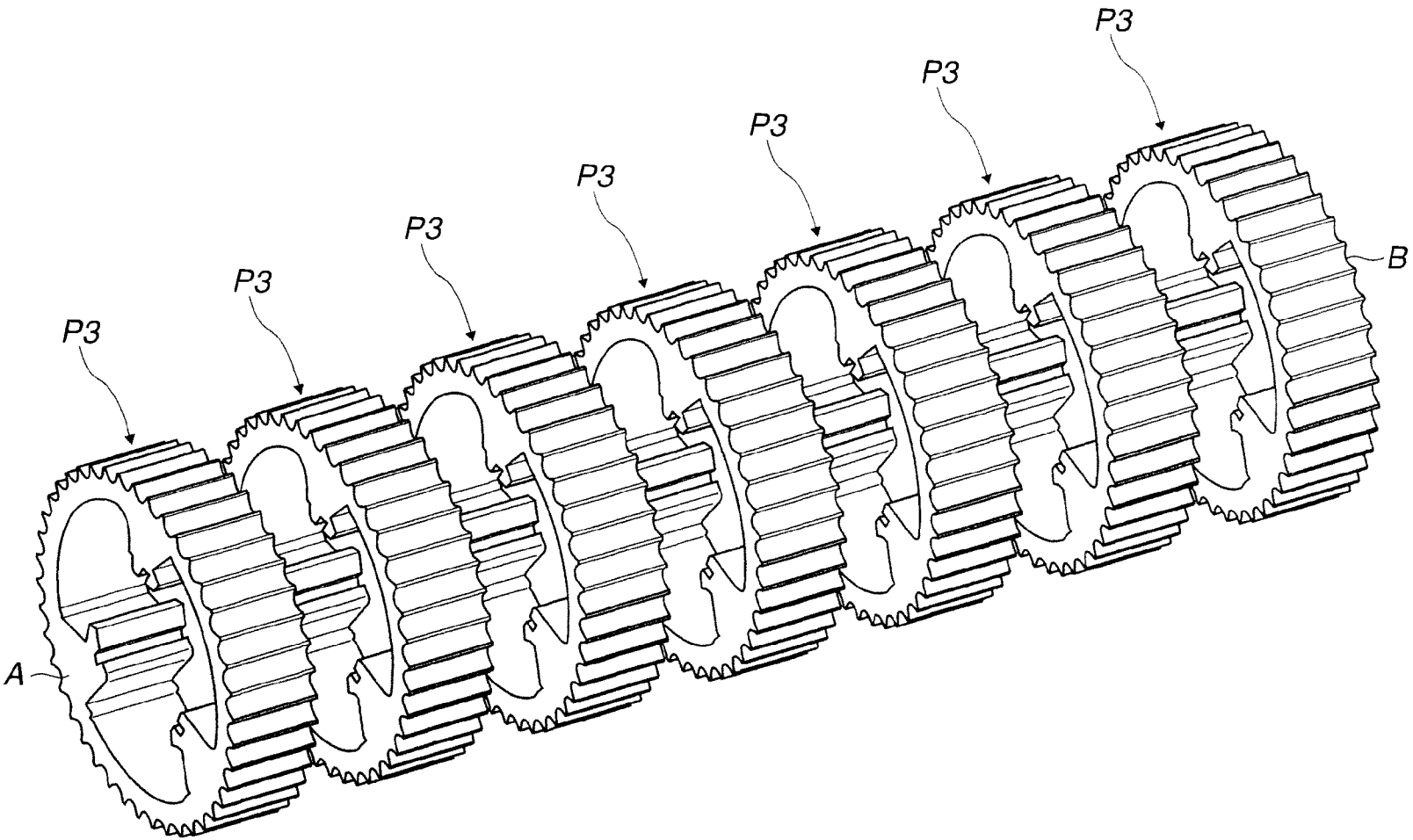
FIG. 8 is a perspective view of a third workpiece for the housing body of the intake valve timing control apparatus or exhaust valve timing control apparatus.

FIGS. 6A, 6B and 6C are views of housing body 10, where FIG. 6A is a front view along the axis of rotation from the X-axis positive side, FIG. 6B is a side sectional view taken along a plane indicated by F6B-F6B in FIG. 6A, and FIG. 6C is a rear view along the axis of rotation from the X-axis negative side. FIGS. 7 and 8 are perspective views of workpieces during a process of manufacturing the housing body 10.

Housing body 10 is formed from an aluminum extrusion shown in FIG. 7. First, an aluminum-based metal material, such as aluminum, or aluminum alloy such as A6000 or A7000, is extruded from a mold, to form a first workpiece P1 shown in FIG. 7, in which continuous shapes of first, second and third shoes 11, 12 and 13 are formed at an inside periphery, and a continuous shape of pulley 100 is formed at an outside periphery. Second, the entire inside and outside peripheral surfaces of first workpiece P1 are treated with an anodizing process or alumilite process, to form a second workpiece P2 which has hardened surfaces. Third, second workpiece P2 is cut laterally at intervals of a predetermined distance along the axial direction, to form a plurality of identically-shaped third workpieces P3, as shown in FIG. 8. Finally, each third workpiece P3 is treated with a cutting process, to form a sealing recess 101, a bolt hole 110, etc., as described in detail below, and thereby form a final shape of housing body 10 shown in FIGS. 6A, 6B and 6C.

As shown in FIGS. 6B and 6C, the open X-axis negative side end of housing body 10 is formed with sealing recess 101 which is a recess formed by cutting out a part of the periphery of the open X-axis negative side end portion. Specifically, sealing recess 101 is formed by cutting out a part of third workpiece P3, into a cylindrical shape having a predetermined radius R about the axis of rotation O, and having a predetermined depth in the X-axis positive direction. Sealing recess 101 includes a bottom surface 102 having a circular outside shape, and an inside peripheral surface 103 surrounding the bottom surface 102. Inside peripheral surface 103 has the radius R with respect to the axis of rotation O.

Where Ri represents a radius of the inside peripheral surface of housing body 10 about the axis of rotation O, and Ro represents a maximum radius of housing body 10 which is a distance between a tooth tip of pulley 100 and the axis of rotation O, it holds that Ro>R>Ri, and Ro:Ri=100:82. It also holds that (Ro+Ri)/2≈R. In other words, sealing recess 101 extends in the radial direction of housing body 10 substantially to a midpoint between the inside and outside peripheral surfaces of housing body 10. On the other hand, in the X-axis direction, a distance L2 between the bottom surface 102 of sealing recess 101 and the X-axis negative end surface of housing body 10 is equal to about 20% or more of an axial length L of housing body 10. In other words, sealing recess 101 is formed to extend in the X-axis direction over a range of about 20% or more of the axial length of housing body 10.

Housing body 10 is formed integrally with pulley 100 at the outside periphery, where pulley 100 extends over the entire axial length of the outside periphery of housing body 10 in the X-axis direction. The axial length of the inside periphery of housing body 10, L1, is shorter than that of the outside periphery, or that of pulley 100, (L1<L). In other words, the axial length of pulley 100 in the X-axis direction, L, is set longer than that of the inside periphery of housing body 10, L1. Pulley 100 is constituted by a plurality of projections and depressions or a plurality of teeth which extend in the X-axis direction, around which timing belt 1010 is wounded. Pulley 100 is rotated by the crankshaft, rotating integrally with housing body 10 in a clockwise direction as viewed in FIG. 4, according to movement of timing belt 1010 shown by an arrow in FIG. 1.

The inside periphery of housing body 10 is formed integrally with first, second and third shoes 11, 12 and 13 which extend inwardly in the radial direction. Specifically, first, second and third shoes 11, 12 and 13 are arranged in a direction of rotation about the axis of rotation O, at even intervals, extending from the inside periphery of housing body 10 inwardly toward the axis of rotation O. First, second and third shoes 11, 12 and 13 are arranged in this order in the clockwise direction in FIG. 4. Each of first, second and third shoes 11, 12 and 13 extends in the X-axis direction, and has a cross section having a substantially trapezoidal shape.

The width of each of first, second and third shoes 11, 12 and 13 in the circumferential direction is set substantially equal to each other. The space between second shoe 12 and third shoe 13, and the space between third shoe 13 and first shoe 11, are set substantially equal to each other. The space between first shoe 11 and second shoe 12 is set slightly larger than the other spaces, for accommodating a first vane 41 having a wider width, which is described in detail below.

First shoe 11 is formed with a bolt hole 110 substantially at the center of the trapezoidal cross section, where bolt hole 110 extends through the first shoe 11. Similarly, second shoe 12 and third shoe 13 are formed with a through bolt hole 120 and a through bolt hole 130 respectively.

The X-axis positive side end surface of each of first, second and third shoes 11, 12 and 13 is brought in intimate contact with and fixed to front plate 8. The X-axis negative side end surface of each of first, second and third shoes 11, 12 and 13, which is a part of the bottom surface 102 of sealing recess 101, is brought in intimate contact with and fixed to rear plate 9.

As viewed from the X-axis positive side, or as shown in FIG. 6A, second shoe 12 and third shoe 13 are formed with a flat portion 121 and a flat portion 131 in their clockwise sides, respectively. Each of flat portion 121 and flat portion 131 is in a straight line passing through the axis of rotation O of housing body 10, as viewed in the X-axis direction.

On the other hand, the clockwise side of first shoe 11 is formed with a rounded portion 112 at a root portion in an outward position in the radial direction of housing body 10, and formed with a recess 113 at a tip portion in an inward position in the radial direction of housing body 10, as viewed in FIG. 6B. First shoe 11 is formed with a flat portion 111 between rounded portion 112 and recess 113, similar to second shoe 12 and third shoe 13. Rounded portion 112 has an inwardly curved and substantially arced edge having a predetermined curvature, as viewed in the X-axis direction. The edge of rounded portion 112 gradually rises from the inside peripheral surface of housing body 10 to merge into the clockwise side edge of first shoe 11.

As shown in FIG. 6C, rounded portion 112 in bottom surface 102 of sealing recess 101 is formed with a positioning recess 114 adjacent to bolt hole 110. Positioning recess 114 has a smaller diameter than bolt hole 110. Rounded portion 112 serves to allow arrangement of positioning recess 114 in first shoe 11, and enhance rigidity of the root portion of first shoe 11 in the circumferential direction, so as to bear a stress resulting from contact between first vane 41 and first shoe 11.

As viewed from the X-axis positive side, or as viewed in FIG. 6A, the counterclockwise sides of first, second and third shoes 11, 12 and 13 are formed with recesses 115, 125 and 135, respectively. Recesses 115, 125 and 135 are relatively wide grooves extending over the entire axial length of housing body 10 in the X-axis direction.

As shown in FIG. 6B, as viewed in the X-axis direction, the tips 116, 126 and 136 of first, second and third shoes 11, 12 and 13 have radially inside surfaces facing the axis of rotation O, which are inwardly curved like an arc fitted with an outside peripheral surface 411 of a rotor 40 of vane rotor 4, which is described in detail below. The tip 116 of first shoe 11 is formed with a sealing groove 117 which extends in the X-axis direction. A sealing member 118 and a sealing spring such as a leaf spring 119 not shown are fitted and retained in sealing groove 117. Sealing member 118 is in liquid-tight sliding contact with the outside peripheral surface of rotor 40. Leaf spring 119 presses the sealing member 118 onto the outside peripheral surface of rotor 40. Sealing member 118 is formed of a grass fiber plastic, having a substantially U-shape as viewed in a direction perpendicular to the X-axis. Similarly, the tips 126 and 136 of second shoe 12 and third shoe 13 are formed with sealing grooves 127 and 137, sealing members 128 and 138, and leaf springs 129 and 139, respectively, as shown in FIGS. 3 and 4.

Figure 9B:
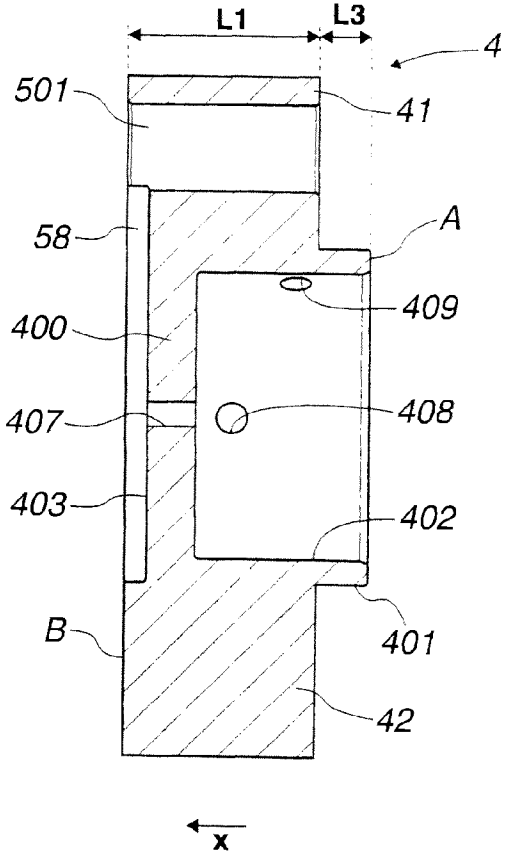
FIGS. 9A and 9B are views of a vane rotor of the intake valve timing control apparatus, where
Figure 9A:
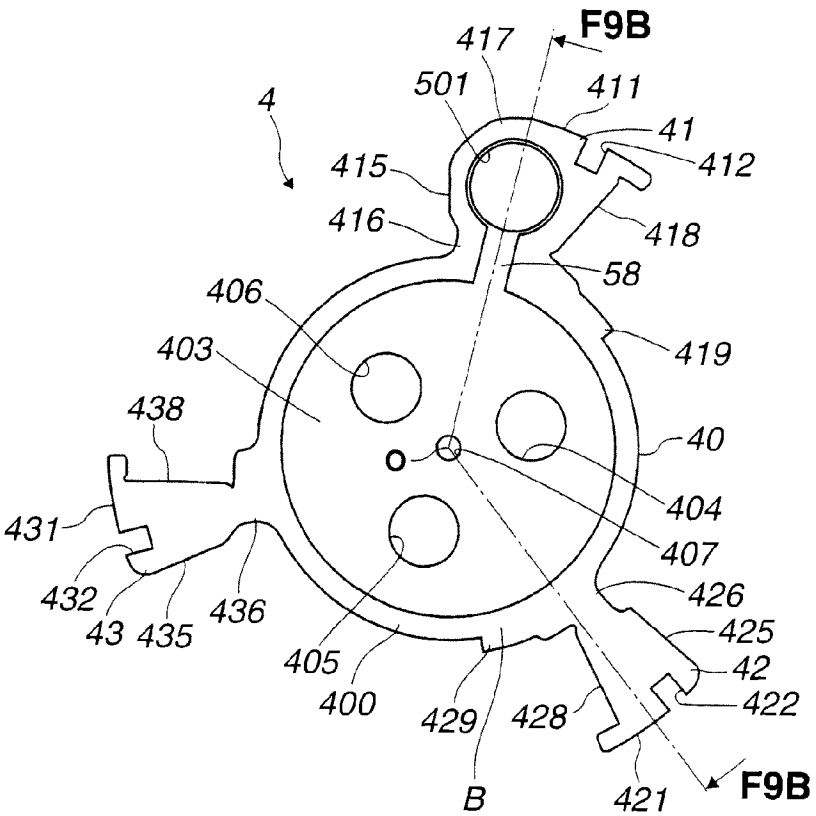
Figure 10:
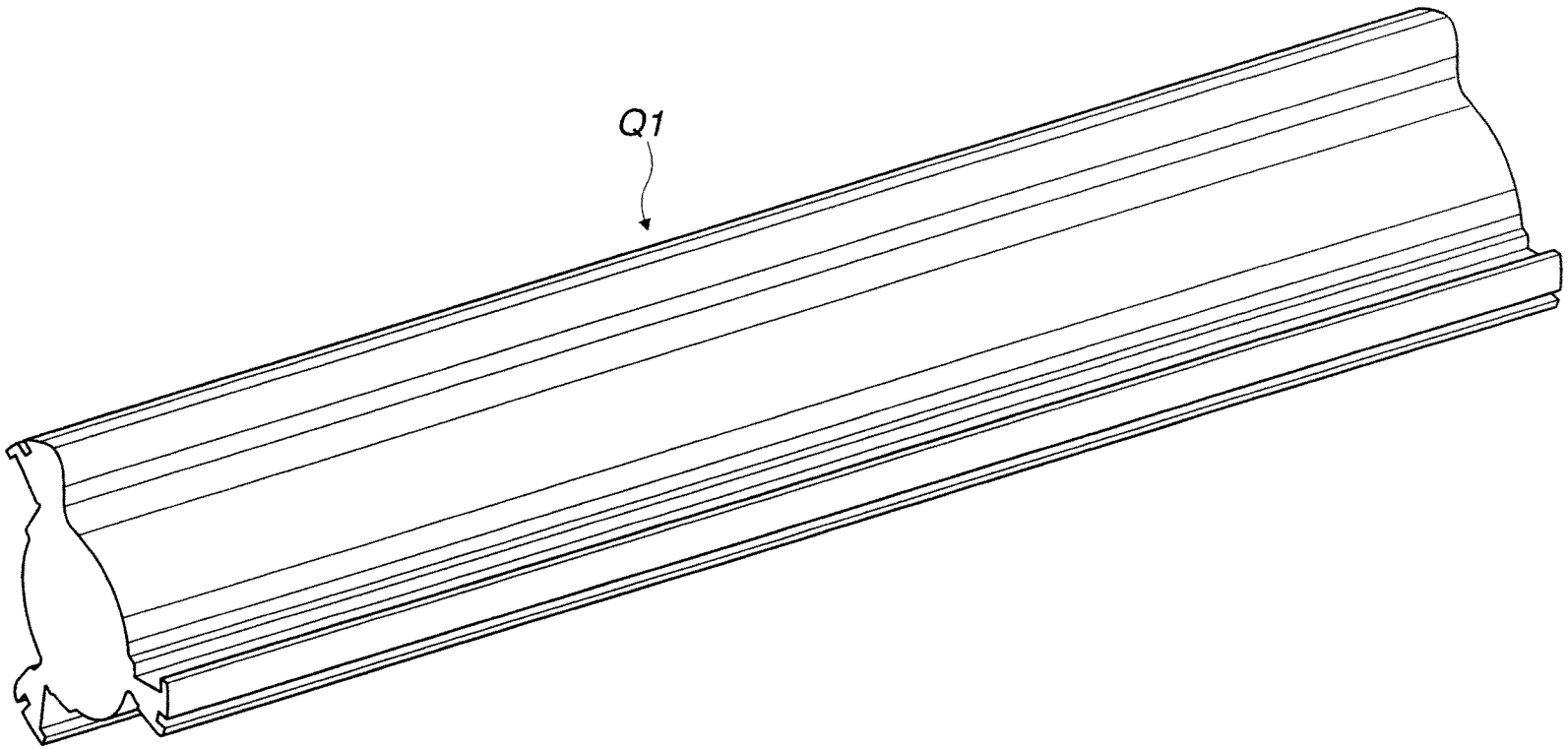
FIG. 10 is a perspective view of a first workpiece for the vane rotor of the intake valve timing control apparatus or a vane rotor of the exhaust valve timing control apparatus.
Figure 11:
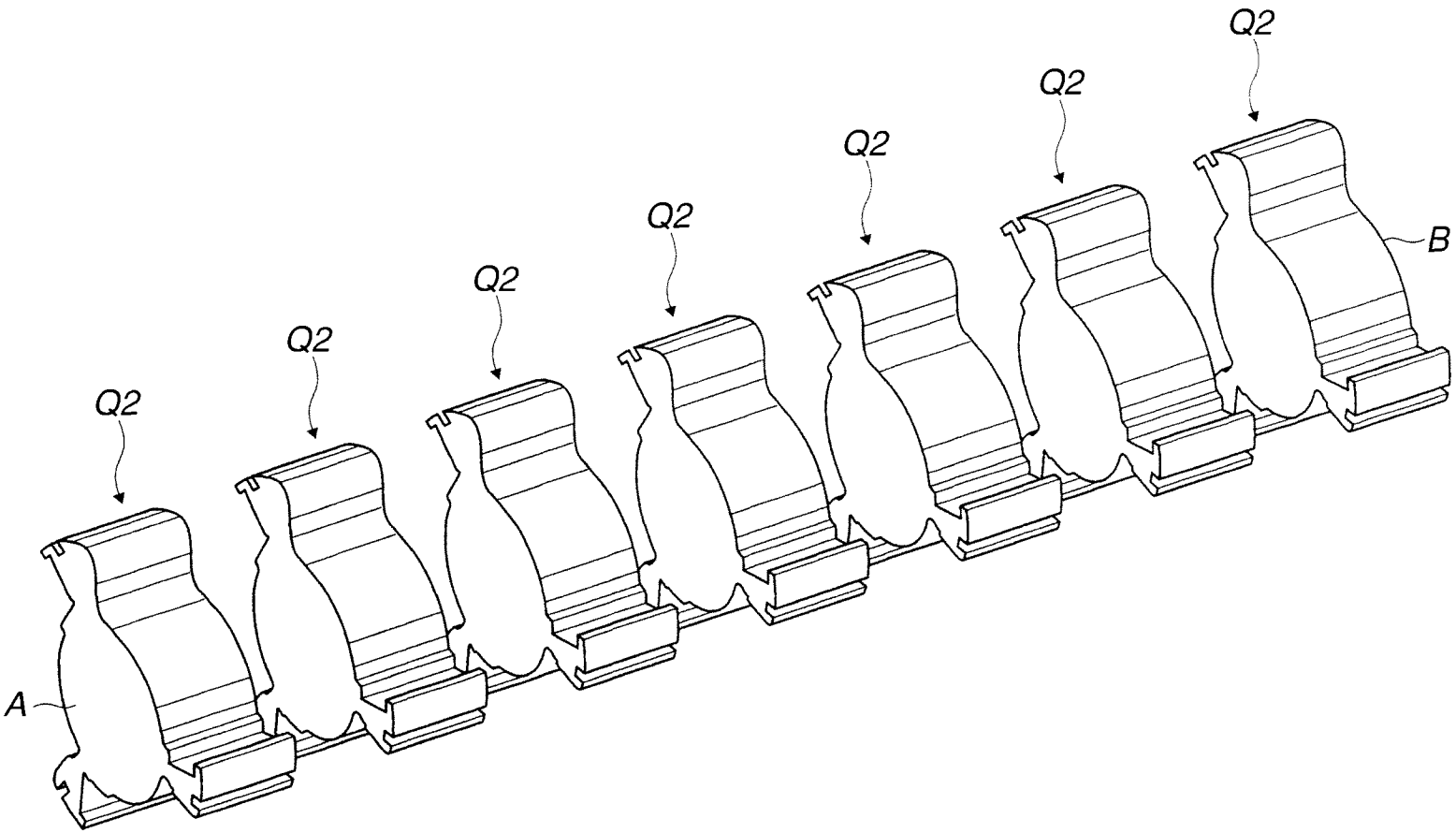
FIG. 11 is a perspective view of a second workpiece for the vane rotor of the intake valve timing control apparatus or exhaust valve timing control apparatus.

FIGS. 9A and 9B are views of vane rotor 4, where FIG. 9A is a front view along the axis of rotation from the X-axis positive side, and FIG. 9B is a side sectional view taken along a plane indicated by F9B-F9B in FIG. 9A. In FIG. 9B, the opening of one retard fluid passage 408 and the opening of advance fluid passage 409 are shown. FIGS. 10 and 11 are perspective views of workpieces during a process of manufacturing the vane rotor 4.

Vane rotor 4 is formed from an aluminum extrusion shown in FIG. 10. First, an aluminum-based metal material is extruded from a mold, to form a first workpiece Q1 shown in FIG. 10 in which continuous shapes of rotor 40 and first, second and third vanes 41, 42 and 43 are formed. Second, first workpiece Q1 is cut laterally at intervals of a predetermined distance along the axial direction, to form a plurality of identically-shaped second workpieces Q2, as shown in FIG. 11. Third, second workpiece Q2 is treated with a cutting process, to form a boss portion 401, a fitting hole 402, etc., as described in detail below, and thereby form a final shape of vane rotor 4 shown in FIGS. 9A and 9B. Finally, the entire outside peripheral surfaces of second workpiece Q2 are treated with an anodizing process, to form a third workpiece Q3 which has hardened surfaces.

Vane rotor 4 is a driven member or driven rotator which can rotate relative to pulley 100 or housing HSG, and serves as a vane member which rotates in the clockwise direction in FIG. 4 as a unit with intake camshaft 3*a*. Vane rotor 4 includes rotor 40, and first, second and third vanes 41, 42 and 43.

Rotor 40 is fixed coaxially by three camshaft bolts 31, 32 and 33 to an X-axis positive side end portion 30 (inserted portion 301) of intake camshaft 3*a*. Rotor 40 includes a rotor body 400 and a boss portion 401 which are arranged coaxially. Rotor body 400 is supported for rotation in sliding contact with sealing members 118, 128 and 138 which are mounted in first, second and third shoes 11, 12 and 13 respectively.

Boss portion 401 is formed to project from rotor body 400 in the X-axis negative direction. Boss portion 401 is inserted in a support hole 92 of rear plate 9, and mounted with a slight clearance to support hole 92. Boss portion 401 has a slightly smaller outer diameter than rotor body 400. The length of boss portion 401 in the X-axis direction, L3, is slightly shorter than the length of sealing recess 101 of housing body 10 in the X-axis direction, L2. The length of rotor body 400 in the X-axis direction is substantially equal to the length of housing body 10 except the sealing recess 101, L1.

Rotor 40 is formed with a fitting hole 402 which is positioned coaxially with rotor 40, and extends inside of boss portion 401 and rotor body 400, where fitting hole 402 has a diameter that is substantially equal to the diameter of intake camshaft 3*a*. Fitting hole 402 extends over the entire axial length of boss portion 401 and a range of two thirds or less of the axial length of rotor body 400, as shown in FIG. 9B. Rotor body 400 is also formed with a recess 403 at the X-axis positive side, which is positioned coaxially with rotor 40. Recess 403 extends over a range of about 13% of the entire axial length of rotor body 400 from the X-axis positive side end in the X-axis negative direction.

Rotor body 400 is formed with bolt holes 404, 405 and 406 through which camshaft bolts 31, 32 and 33 pass, as shown in FIG. 9A. Bolt holes 404, 405 and 406 extend in the X-axis direction, which are connected between recess 403 and fitting hole 402. Bolt holes 404, 405 and 406 are arranged and substantially evenly spaced in the circumferential direction about the axis of rotation O of rotor 40. Rotor body 400 is formed with an air relief hole 407 in the axis of rotation O, which is connected between fitting hole 402 and recess 403.

Rotor body 400 is formed with first, second and third vanes 41, 42 and 43 at the outside periphery, which are arranged and substantially evenly spaced in the circumferential direction, extending outwardly in the radial direction from the axis of rotation O. First, second and third vanes 41, 42 and 43 are arranged in this order in the clockwise direction in FIG. 4. First, second and third vanes 41, 42 and 43 are formed integrally with rotor 40 (rotor body 400), and have a cross section having a substantially trapezoidal shape spreading outwardly in the radial direction, as viewed in the X-axis direction.

The length of first, second and third vanes 41, 42 and 43 in the X-axis direction is set equal to the length of rotor body 400 in the X-axis direction, L1. When vane rotor 4 is mounted in housing HSG, the X-axis positive side surfaces of first, second and third vanes 41, 42 and 43 face with a quite slight clearance the X-axis negative side surface of front plate 8. On the other hand, the X-axis negative side surfaces of first, second and third vanes 41, 42 and 43 face with a quite slight clearance the X-axis positive side surface of rear plate 9.

The lengths of second vane 42 and third vane 43 in the circumferential direction of vane rotor 4 are substantially equal to each other. The circumferential length of first vane 41 is set larger that those of second vane 42 and third vane 43, so as to provide a space where a lock mechanism 5 is mounted.

The centers of gravity of first, second and third vanes 41, 42 and 43 are arranged and substantially evenly spaced in the circumferential direction. However, first vane 41 is slightly heavier than the other vanes, because first vane 41 is large and provided with lock mechanism 5. Accordingly, the space between first vane 41 and second vane 42, and the space between third vane 43 and first vane 41, are set slightly larger than the space between second vane 42 and third vane 43, so that the center of gravity of the entire vane rotor 4 is conformed to the axis of rotation O.

When vane rotor 4 is mounted in housing HSG, first vane 41 is mounted between first shoe 11 and second shoe 12, second vane 42 is mounted between second shoe 12 and third shoe 13, and third vane 43 is mounted between third shoe 13 and first shoe 11.

Outside peripheral surfaces 411, 421 and 431 of first, second and third vanes 41, 42 and 43 are curved to have arced shapes which are fitted with the inside peripheral surface of housing body 10, as viewed in the X-axis direction, as shown in FIG. 4. Outside peripheral surface 411 of first vane 41 is formed with a groove 412 which extends in the X-axis direction. A sealing member 413 and a sealing spring such as a leaf spring 414 not shown are fitted and retained in groove 412. Sealing member 413 is in liquid-tight sliding contact with the inside peripheral surface of housing body 10. Leaf spring 414 presses the sealing member 413 onto the inside peripheral surface of housing body 10. Similarly, outside peripheral surfaces 421 and 431 of second vane 42 and third vane 43 are formed with grooves 422 and 432, sealing members 423 and 433, and leaf springs 424 and 434 not shown, respectively, as shown in FIG. 2.

The counterclockwise side of first vane 41 is formed with a flat portion 415 as viewed from the X-axis positive side, as shown in FIG. 9A. Flat portion 415 is substantially in a straight line passing through the axis of rotation O of rotor 40 as viewed in the X-axis direction. First vane 41 is formed with a recess 416 between flat portion 415 and the root of first vane 41. Recess 416 has an inwardly curved and substantially arced edge having a predetermined curvature, as viewed in the X-axis direction. Similarly, second vane 42 and third vane 43 are formed with flat portions 425 and 435, and recesses 426 and 436, respectively.

As viewed from the X-axis positive side, the counterclockwise side of first vane 41 is formed with a rounded portion 417 at a tip portion outside of flat portion 415. Rounded portion 417 has an outwardly curved and substantially arced edge having a predetermined curvature that is slightly larger than the curvature of rounded portion 112 of first shoe 11, and substantially equal to the curvature of a recess 900 of rear plate 9 which is described in detail below. Rounded portion 417 serves to allow the flat portion 415 of first vane 41 to be in surface-to-surface contact with the flat portion 111 of first shoe 11, and serves to reduce the weight of first vane 41.

On the other hand, as viewed from the X-axis positive side, the clockwise sides of first, second and third vanes 41, 42 and 43 are formed with recesses 418, 428 and 438 respectively, where recesses 418, 428 and 438 are relatively wide recesses extending over the entire axial length of vane rotor 4.

As viewed from the X-axis positive side, the clockwise side of first vane 41 is formed with a projection that is located at the root and extends over a predetermined distance, along the outside periphery of rotor 40 (rotor body 400) in the clockwise direction. The projection is formed continuous with the root of first vane 41, and projects from the outside periphery of rotor 40 (rotor body 400) outwardly in the radial direction. The projection serves as a stopper portion 419. Similarly, the clockwise side of the root of second vane 42 is formed with a stopper portion 429.

Rotor body 400 is formed with three retard fluid passages 408 and three advance fluid passages 409 which are connected between fitting hole 402 and the outside peripheral surface of rotor 40 (rotor body 400). In the case of first vane 41, retard fluid passage 408 is formed substantially in a midpoint in the X-axis direction as shown in FIG. 9B, and in the clockwise side of the root of first vane 41 as viewed from the X-axis positive side, where retard fluid passage 408 is formed to extend through in the radial direction, as shown in FIG. 4. On the other hand, advance fluid passage 409 is formed on the X-axis negative side in first vane 41 as shown in FIG. 9B, and in the counterclockwise side of the root of first vane 41 as viewed from the X-axis positive side, as shown in FIG. 4, where advance fluid passage 409 is formed to extend through in the radial direction, as shown in FIG. 4. Similarly, retard fluid passages 408 and advance fluid passages 409 are formed in the roots of second vane 42 and third vane 43, extending through in the radial direction.

Vane rotor 4 defines, in the space between vane rotor 4 and housing HSG, first, second and third advance chambers A1, A2 and A3, and first, second and third retard chambers R1, R2 and R3, which working fluid is supplied to or drained from. Namely, as viewed in the X-axis direction, three chambers are formed by two adjacent shoes and the outside peripheral surface of rotor 40 (rotor body 400), and each of the three chambers is divided by vane 41, 42 or 43 into one advance chamber and one retard chamber. First, second and third advance chambers A1, A2 and A3, and first, second and third retard chambers R1, R2 and R3 are separated liquid-tightly from each other by sealing member 413, etc. Working fluid is supplied from an oil pump 1020 to first, second and third advance chambers A1, A2 and A3, and first, second and third retard chambers R1, R2 and R3, and serves to transmit a torque between vane rotor 4 and housing HSG.

More specifically, first, second and third advance chambers A1, A2 and A3, and first, second and third retard chambers R1, R2 and R3 are defined by the X-axis negative side surface of front plate 8, the X-axis positive side surface of rear plate 9, the circumferentially-facing surfaces of first, second and third vanes 41, 42 and 43, and the circumferentially-facing surfaces of first, second and third shoes 11, 12 and 13. For example, first advance chamber A1 is defined between the clockwise surface of first shoe 11, the counterclockwise surface of first vane 41, whereas first retard chamber R1 is defined between the clockwise surface of first vane 41 and the counterclockwise surface of second shoe 12, as shown in FIG. 4.

Similarly, second advance chamber A2 is defined between second shoe 12 and second vane 42, second retard chamber R2 is defined between second vane 42 and third shoe 13, third advance chamber A3 is defined between third shoe 13 and third vane 43, and third retard chamber R3 is defined between third vane 43 and first shoe 11.

When vane rotor 4 rotates with respect to housing HSG in the counterclockwise direction by a predetermined angle, flat portion 111 of first shoe 11, which is formed in the clockwise surface of first shoe 11, is brought into surface-to-surface contact with flat portion 415 of first vane 41, which is formed in the counterclockwise surface of first vane 41. Under this condition, flat portion 121 of second shoe 12 and flat portion 425 of second vane 42 face each other with a slight clearance, namely the circumferentially-facing surfaces of second shoe 12 and second vane 42 are maintained out of contact with each other. Similarly, flat portion 131 of third shoe 13 and flat portion 435 of third vane 43 face each other with a slight clearance, and are maintained out of contact with each other.

In this way, rotation of vane rotor 4 with respect to housing HSG in the counterclockwise direction is restricted by contact between flat portion 111 of first shoe 11 and flat portion 415 of first vane 41. Flat portion 111 of the circumferentially-facing surface of first shoe 11 and flat portion 415 of the circumferentially-facing surface of 41 serve as first stopper portions constituting a first stopper mechanism for restricting relative rotation of vane rotor 4 in the counterclockwise direction (in the retard direction).

In FIG. 4 where relative rotation between vane rotor 4 and housing HSG is restricted, an angle $\alpha$, which is defined about the axis of rotation O by the clockwise side end surface of stopper portion 419 and the counterclockwise side end surface of tip 126 of second shoe 12, is slightly smaller than an angle $\beta$, which is defined about the axis of rotation O by the clockwise side end surface of stopper portion 429 and the counterclockwise side end surface of tip 136 of third shoe 13.

According to the above relationship, when vane rotor 4 rotates with respect to housing HSG from the position shown in FIG. 4 by the angle $\alpha$ in the clockwise direction, the tip 126 of second shoe 12 and the stopper portion 419 of first vane 41 are brought into surface-to-surface contact with each other. Under this condition, the tip 136 of third shoe 13 and the stopper portion 429 of second vane 42 face each other with a predetermined slight clearance in the circumferential direction, so that third shoe 13 and second vane 42 are maintained out of contact with each other. Similarly, first shoe 11 and third vane 43 face each other with a predetermined slight clearance, and thus maintained out of contact with each other.

In this way, rotation of vane rotor 4 with respect to housing HSG in the clockwise direction is restricted by contact between tip 126 of second shoe 12 and stopper portion 419 of first shoe 11. The clockwise surface of stopper portion 419 and the counterclockwise surface of tip 126 of second shoe 12 serve as second stopper portions constituting a second stopper mechanism for restricting relative rotation of vane rotor 4 in the clockwise direction (in the advance direction). The first and second stopper mechanisms define a range of relative rotation of vane rotor 4 with respect to housing HSG.

The contact area between tip 126 of second shoe 12 and stopper portion 419 of first shoe 11, i.e. the contact area of the second stopper mechanism, SS2, is set smaller than the contact area between flat portion 111 of first shoe 11 and the flat portion 415 of first vane 41, i.e. the contact area of the first stopper mechanism, SS1 (SS1>SS2).

Incidentally, all over a possible range of the rotational angle of vane rotor 4 with respect to housing HSG, the volumetric capacities of first, second and third advance chambers A1, A2 and A3, and first, second and third retard chambers R1, R2 and R3 are prevented from becoming zero. Also, the openings of retard fluid passages 408 and advance fluid passages 409 in first, second and third advance chambers A1, A2 and A3, and first, second and third retard chambers R1, R2 and R3 are constantly prevented from being closed. For example, in FIG. 4, the volumetric capacity of first advance chamber A1 and the opening of advance fluid passage 409 are provided by the space defined between recess 113 of first shoe 11 and recess 416 of first vane 41. Similarly, the volumetric capacity of second advance chamber A2 and the opening of advance fluid passage 409 are provided by the space, i.e. the clearance described above, which is defined by flat portion 121 of second shoe 12, and recess 426 and flat portion 425 of second vane 42. Similarly, the volumetric capacity of third advance chamber A3 and the opening of advance fluid passage 409 are provided by the space, i.e. the clearance described above, which is defined by flat portion 131 of third shoe 13, and recess 436 and flat portion 435 of third vane 43.

Front plate 8 is formed by forging an iron-based metal material such as an iron alloy, into a disc shape which is thinner than rear plate 9. Front plate 8 closes and seals the front axial end of housing body 10, namely closes and seals the X-axis positive side ends of first, second and third advance chambers A1, A2 and A3, and first, second and third retard chambers R1, R2 and R3 defined in housing body 10.

As shown in FIG. 3, the diameter of front plate 8 is set slightly larger than the diameter, specifically, the maximum diameter, of pulley 100, so that an outside periphery 80 of front plate 8 projects from pulley 100 outwardly in the radial direction as viewed in the X-axis direction.

As shown in FIG. 2, front plate 8 is formed with a female thread portion 82 located substantially at the center of the X-axis positive side surface of front plate 8. Female thread portion 82 projects in the X-axis positive direction. Female thread portion 82 is formed with a large-diameter hole 81 at its center, which extends through front plate 8 in the X-axis direction, and through which camshaft bolts 31, 32 and 33 are inserted to pass, when intake valve timing control apparatus 1*a* is assembled. Large-diameter hole 81 of female thread portion 82 is formed with a female thread 820 to which a male thread 700 of a plug 7 is screwed. The annular X-axis positive side surface of female thread portion 82 is formed with an annular groove 821 in which a sealing ring S4 is mounted.

Front plate 8 is formed with bolt holes 83, 84 and 85 located between female thread portion 82 and outside periphery 80. Bolt holes 83, 84 and 85 are arranged and evenly spaced in the circumferential direction as viewed in the X-axis direction, through which bolts b1, b2 and b3 inserted to pass. In the X-axis direction, bolt holes 83, 84 and 85 are located to face or conform to bolt holes 110, 120 and 130, which are formed in first, second and third shoes 11, 12 and 13 of housing body 10, respectively.

Front plate 8 is formed with thicker portions 86, 87 and 88 around bolt holes 83, 84 and 85 respectively. Thicker portions 86, 87 and 88 are slightly thicker than the other portion in the X-axis direction, in order to bear the axial force applied by bolts b1, b2 and b3. Each of thicker portions 86, 87 and 88 has a shape that is spreading inwardly in the radial direction, and continuous with female thread portion 82. In other words, front plate 8 is formed as thin as possible, except thicker portions 86, 87 and 88 for providing a strength enough to bear the axial force applied by bolts b1, b2 and b3.

Figure 12:
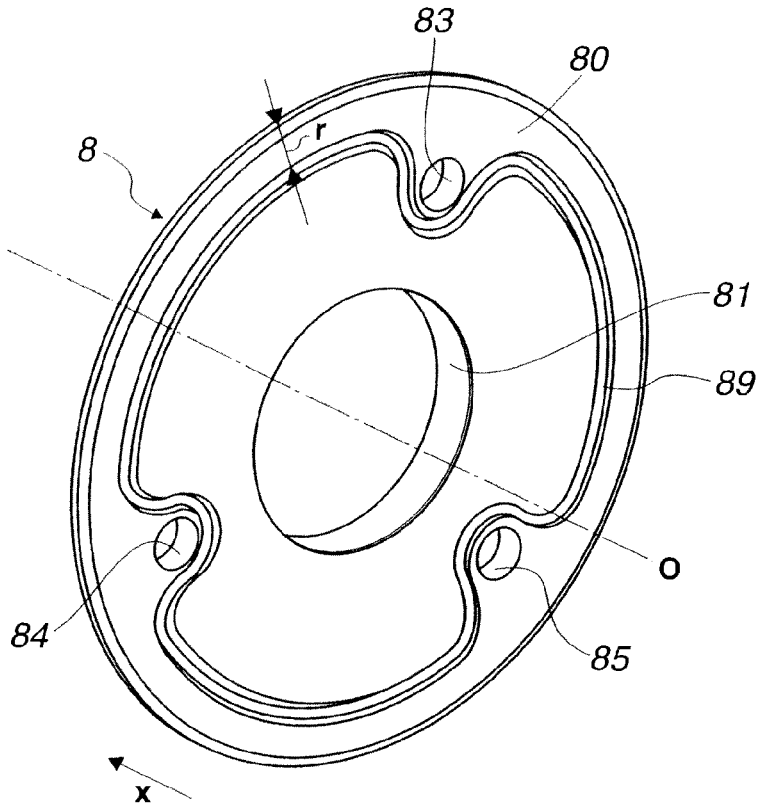
FIG. 12 is a perspective view of a front plate of the intake valve timing control apparatus.

FIG. 12 is a perspective view of front plate 8 as viewed from the X-axis negative side. The X-axis negative side surface of front plate 8 is formed with an annular groove 89 in which a sealing ring S3 is mounted. Annular groove 89 has a shape including three inwardly curved sections like a three-leaved clover, so that annular groove 89 extends circumferentially along the outside periphery 80 with a slight radial clearance r, and passes inside of bolt holes 83, 84 and 85, i.e. passes between the axis of rotation O and each of bolt holes 83, 84 and 85.

Plug 7 is formed by forging an iron-based metal material, into a hollow cylindrical shape with a bottom. Plug 7 includes a male thread portion 70, a division wall portion 71, and a flange 72. Male thread portion 70 has a hollow cylindrical shape, extending in the X-axis direction. Division wall portion 71 closes the opening of male thread portion 70. Flange 72 spreads outwardly in the radial direction from the X-axis positive side end of male thread portion 70. Male thread portion 70 is formed with a male thread 700 at the outside periphery. Division wall portion 71 is formed with a bolt head portion 710 at the center, which has the form of a regular hexagonal prism. Bolt head portion 710 is turned so that plug 7 is screwed into front plate 8, i.e. male thread 700 of plug 7 is screwed into female thread 820 of front plate 8, and that large-diameter hole 81 of front plate 8 is closed and sealed.

Rear plate 9 is fixedly inserted in sealing recess 101 of housing body 10, so as to close and seal the rear axial end of housing body 10, i.e. the X-axis negative side end of first, second and third advance chambers A1, A2 and A3, and first, second and third retard chambers R1, R2 and R3 which are defined in housing body 10. Rear plate 9 is formed by forging an iron-based metal material such as S45C or S48. Rear plate 9 includes a plate body 90 and a bearing portion 91.

Bearing portion 91 has a cylindrical shape extending in the X-axis negative direction from the X-axis negative side of plate body 90. As viewed in the X-axis direction, bearing portion 91 is located substantially at the center of plate body 90, coaxially with the axis of rotation O. Bearing portion 91 is formed with a support hole 92 inside, through which intake camshaft 3*a* is inserted to pass. Support hole 92 is formed to extend in the X-axis direction and pass through rear plate 9. The diameter of support hole 92 is set slightly smaller than that of large-diameter hole 81 of front plate 8.

Boss portion 401 of vane rotor 4 is inserted in support hole 92, and mounted with a slight clearance with support hole 92. The insertion of boss portion 401 into support hole 92 serves to position vane rotor 4 with respect to rear plate 9. Vane rotor 4 (boss portion 401) is thus rotatably supported by rear plate 9 (bearing portion 91).

Bearing portion 91 is provided with an oil seal not shown at the outside peripheral surface of its X-axis negative side portion, and is rotatably supported through the oil seal by the cylinder block of the internal combustion engine. The oil seal serves to maintain liquid-tightness between the cylinder clock and bearing portion 91, in order to guide, into the inside of the cylinder block of the internal combustion engine, working fluid which leaks from intake valve timing control apparatus 1*a* through a clearance CL shown in FIG. 3 between the outside periphery of intake camshaft 3*a* and the inside periphery of bearing portion 91. This prevents the working fluid that leaks from intake valve timing control apparatus 1*a* through clearance CL from contacting the timing belt 1010 or other auxiliary devices.

Incidentally, rear plate 9 is made of an iron-based metal material, so that bearing portion 91 is also made of the iron-based metal material, and thereby has a high hardness.

The feature that plug 7, front plate 8, and rear plate 9 are formed by forging the iron-based materials, serves to prevent working fluid from seeping and leaking through the inside of plug 7, front plate 8, and rear plate 9, as compared to cases where plug 7, front plate 8, and rear plate 9 are formed by sintering iron-based materials.

The length of plate body 90 in the X-axis direction is set at most slightly larger than the depth of sealing recess 101 (the length in the X-axis direction, L2).

The length of an outside peripheral surface 93 of plate body 90 in the X-axis direction is set substantially equal to the depth of sealing recess 101 (the length in the X-axis direction, L2). The diameter of plate body 90 is set substantially equal to the diameter of sealing recess 101 (R×2).

Plate body 90 is formed with female thread portions 901, 902 and 903 around bearing portion 91, which are arranged and evenly spaced in the circumferential direction. Female thread portions 901, 902 and 903 are formed with bolt holes extending through plate body 90 in the X-axis direction. The bolt holes are formed with female threads in the inside peripheral surfaces, respectively. Male threads of an X-axis negative side end portions of bolts b1, b2 and b3 are screwed into the female threads respectively. As viewed in the X-axis direction, female thread portions 901, 902 and 903 (bolt holes) are located to face or conform to the bolt holes 110, 120 and 130 of first, second and third shoes 11, 12 and 13, and bolt holes 83, 84 and 85 of front plate 8.

As shown in FIG. 2, plate body 90 is formed with a recess 900 which is located adjacent to and in the clockwise direction from one female thread portion 901 which faces bolt hole 110 of first shoe 11, as viewed from the X-axis positive side. Recess 900 is formed to extend in the X-axis negative direction to a predetermined depth in plate body 90.

Figure 13:
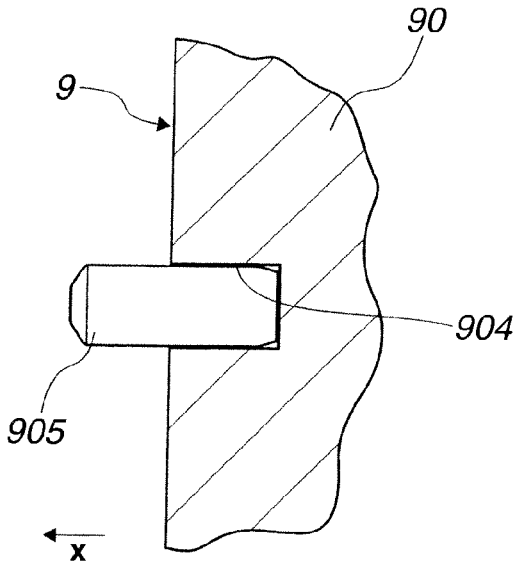
FIG. 13 is a partial side sectional view taken along a plane passing through a central longitudinal axis of a pin hole to which a positioning pin is fixed according to the embodiment.

Plate body 90 is formed with a pin hole 904 having a bottom, which is located at the outside periphery of the X-axis positive side surface of plate body 90, and adjacent to and in the counterclockwise direction from recess 900. Specifically, pin hole 904 is located between recess 900 and female thread portion 901, and in a position in the radial direction of plate body 90 which faces positioning recess 114 of housing body 10 shown in FIG. 6C. FIG. 13 is a partial side sectional view taken along a plane passing through the central longitudinal axis of pin hole 904. As shown in FIG. 13, pin hole 904 is formed to extend to a predetermined depth in plate body 90. A positioning pin 905 is press-fitted and fixed in pin hole 904.

Positioning pin 905 is a dowel pin whose longitudinal end projects to a predetermined height in the X-axis positive direction from the X-axis positive side surface of plate body 90. The diameter of the longitudinal end of positioning pin 905 is set slightly smaller than positioning recess 114, and adapted to be inserted and fitted from the X-axis negative side into positioning recess 114. The diameter of the longitudinal end of positioning pin 905 and the diameter of positioning recess 114 are set so as to prevent play between housing body 10 and rear plate 9 in the circumferential direction under a condition that positioning pin 905 is inserted and fitted in positioning recess 114.

Pin hole 904 is located in rear plate 9 so that under the condition that positioning pin 905 is inserted and fitted in positioning recess 114, bolt hole 110 of first shoe 11 of housing body 10 is in substantially the same position as female thread portion 901 of rear plate 9 as viewed in the X-axis direction, and that when flat portion 415 of first vane 41 of vane rotor 4 is in contact with flat portion 111 of first shoe 11 as shown in FIG. 4, a slide hole 501 of first vane 41 is in substantially the same position as recess 900 of rear plate 9, as viewed in the X-axis direction. Pin hole 904 is located closer to first retard chamber R1 than grooves 906 and 907, and positioning pin 905 is located adjacent to recess 900.

The outside peripheral surface 93 of plate body 90 is formed with a groove 906 which extends in the circumferential direction, and in which a sealing ring S1 is mounted. The X-axis positive side surface of plate body 90 is formed with annular grooves 907, 908 and 909 which extend circumferentially around female thread portions 901, 902 and 903 respectively, and in which sealing rings S2 are mounted.

<Structure of Sealing Between Housing Body and Plates> Front plate 8, housing body 10, and rear plate 9 are fixed together in the X-axis direction by bolts b1, b2 and b3. Bolts b1, b2 and b3 are inserted from the X-axis positive side to pass through bolt holes 83, 84 and 85 of front plate 8, and bolt holes 110, 120 and 130 of housing body 10, and screwed into female thread portions 901, 902 and 903 of rear plate 9, so as to fix front plate 8 and rear plate 9 to housing body 10. Sealing rings S1, S2 and S3 are inserted between housing body 10 and rear plate 9, and between front plate 8 and housing body 10. A sealing ring S4 is inserted between plug 7 and front plate 8. Sealing rings S1, S2, S3 and S4 serve to maintain liquid tightness of housing HSG. Sealing rings S1, S2, S3 and S4 are formed of a rubber such as an acrylic rubber or fluorine rubber.

Sealing ring S1 is an annular sealing member such as an O-ring having a circular cross section, which is arranged between the inside peripheral surface 103 of sealing recess 101 of housing body 10 and outside peripheral surface 93 of plate body 90 of rear plate 9. Under the condition that sealing ring 51 is mounted in groove 906 of rear plate 9, the inside peripheral surface 103 of sealing recess 101 is pressed onto sealing ring S1, so that sealing ring S1 is compressed. This construction provides a function of sealing, so as to prevent working fluid from leaking through the boundary between rear plate 9 and housing body 10.

Each sealing ring S2 is an annular sealing member such as an O-ring having a circular cross section, which is arranged between a portion surrounding a respective one of female thread portions 901, 902 and 903 in the X-axis positive side end surface of rear plate 9 and the X-axis negative side end surface of a respective one of first, second and third shoes 11, 12 and 13 of housing body 10. Under the condition that sealing rings S2 are mounted in annular grooves 907, 908 and 909 around female thread portions 901, 902 and 903, the X-axis negative side end surface of housing body 10 (first, second and third shoes 11, 12 and 13) is pressed onto sealing ring S2 by the axial force of blots b1, b2 and b3, so that sealing ring S2 is compressed. This configuration provides a function of sealing, so as to prevent working fluid from leaking through the boundary between rear plate 9 and housing body 10, and the bolt holes of female thread portions 901, 902 and 903.

Sealing ring S3 is an annular sealing member such as an O-ring having a circular cross section, which is arranged between portions of front plate 8 and housing body 10 which face each other, i.e. between the X-axis negative side end surface of front plate 8 and the X-axis positive side end surface of housing body 10. Sealing ring S3 has the form of a three-leaved clover which is substantially identical to the form of annular groove 89 of front plate 8. Under the condition that sealing ring S3 is mounted in annular groove 89 of front plate 8, the X-axis positive side end surface of housing body 10 is pressed onto sealing ring S3, so that sealing ring S3 is compressed. This construction provides a function of sealing, so as to prevent working fluid from leaking through the boundary between front plate 8 and housing body 10.

Sealing ring S4 is an annular sealing member such as an O-ring having a circular cross section, which is arranged between the X-axis positive side end surface of female thread portion 82 of front plate 8 and the X-axis negative side end surface of flange 72 of plug 7. Under the condition that sealing ring S4 is mounted in groove 821 of female thread portion 82 of front plate 8, the X-axis negative side end surface of flange 72 of plug 7 is pressed onto sealing ring S4, so that sealing ring S4 is compressed. This construction provides a function of sealing, so as to prevent working fluid from leaking through the boundary between plug 7 and front plate 8.

Intake camshaft 3*a* is made of iron, and rotatably supported on bearings in a laterally-inside portion of an upper end portion of the cylinder head of the internal combustion engine. Intake camshaft 3*a* is formed with drive cams (intake cams) at the outside peripheral surface, which are located to face or conform to positions of the intake valves. When intake camshaft 3*a* is rotated, the intake cams open and close the intake valves via valve lifters, rocker arms, etc.

As shown in FIG. 3, the X-axis positive side end portion 30 of intake camshaft 3*a* is formed with an inserted portion 301 which is inserted and fitted in fitting hole 402 of vane rotor 4. As described above, vane rotor 4 is formed with boss portion 401 which surrounds the fitting hole 402. Boss portion 401 is inserted in support hole 92 of rear plate 9. Accordingly, the end portion 30 of intake camshaft 3*a* is inserted to pass through support hole 92 of rear plate 9, under a condition that inserted portion 301 of intake camshaft 3*a* is fitted and fixed in fitting hole 402 of vane rotor 4. In other words, vane rotor 4 is fixed to the end portion 30 of intake camshaft 3*a* through the support hole 92. It is easy to insert the end portion 30 into fitting hole 402, because boss portion 401 is already inserted in support hole 92 so that fitting hole 402 of vane rotor 4 is positioned with respect to rear plate 9 or housing HSG.

The X-axis positive side portion of intake camshaft 3*a* is formed with an air relief hole 310 which extends along the axis of rotation O in the X-axis direction, and opens in the X-axis positive side surface. Camshaft bolt 31 hydraulically communicates with the inside of the internal combustion engine. The end portion 30 of intake camshaft 3*a* is formed with three female thread portions 320 which are arranged around the axis of rotation O or camshaft bolt 31 and evenly spaced in the circumferential direction, and located to face the bolt holes 404, 405 and 406 of vane rotor 4 in the X-axis direction. Each female thread portion 320 is formed with a female thread hole which extends from the X-axis positive side surface to a predetermined depth in end portion 30.

Under the condition that the inserted portion 301 of intake camshaft 3*a* is inserted in fitting hole 402 of vane rotor 4, camshaft bolts 31, 32 and 33 are inserted from the X-axis positive side into bolt holes 404, 405 and 406 of vane rotor 4, and the tip portions of camshaft bolts 31, 32 and 33 are inserted and screwed into female thread portions 320, so that end portion 30 of intake camshaft 3*a* and vane rotor 4 are fixed together. Under this condition, recess 403 of vane rotor 4 hydraulically communicates with the inside of the internal combustion engine through the air relief hole 407 and air relief hole 310.

For example, if intake camshaft 3*a* is fixed to vane rotor 4 by a single camshaft bolt, slippage of vane rotor 4 with respect to intake camshaft 3*a* may occur, or the axial force of the camshaft bolt may cause a large contact pressure to act on vane rotor 4, so as to deform vane rotor 4 which is made of an aluminum material. On the other hand, according to the present embodiment, the fixation by three camshaft bolts 31, 32 and 33 is effective for preventing such slippage, and suppress the contact pressure and deformation, by reduction of the axial force of each camshaft bolt.

Intake valve timing control apparatus 1*a* is provided with an arrangement that an engagement member such as a lock piston 51 locks relative rotation between vane rotor 4 and housing HSG when vane rotor 4 is in a most retarded position which is defined by the first stopper mechanism. Lock piston 51 is a plunger which is provided in vane rotor 4, and arranged to move forward or rearward in the X-axis direction according to a state of operation of the internal combustion engine.

Figure 14:
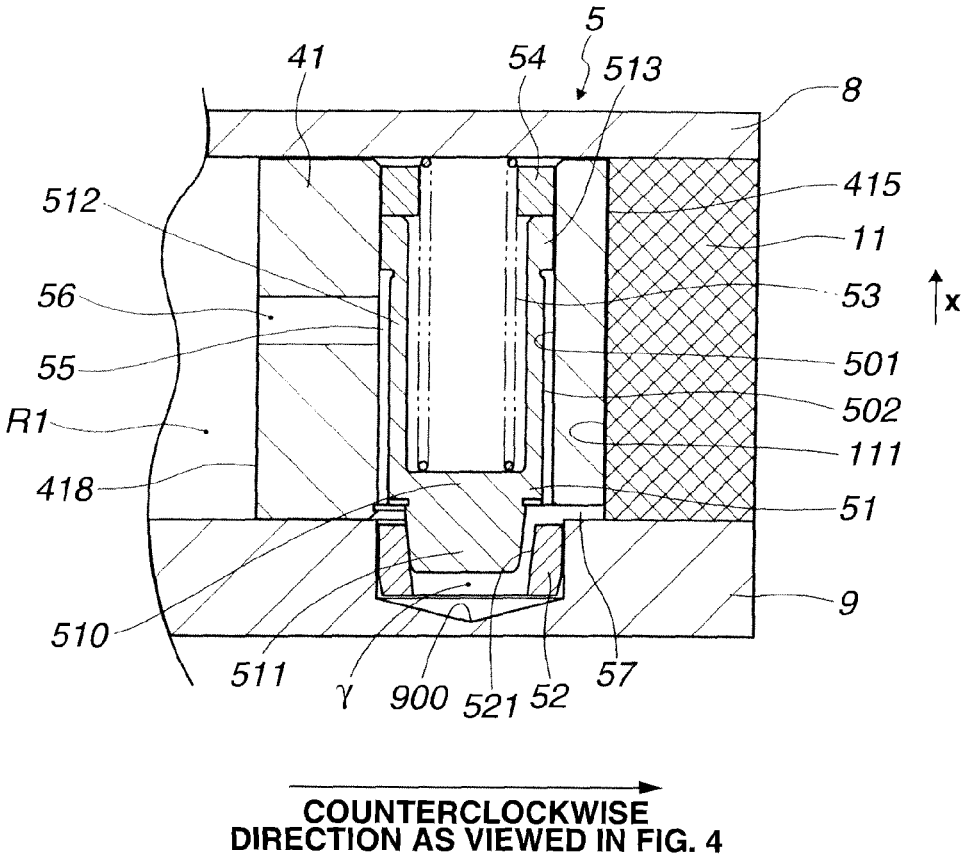
FIG. 14 is a partial side sectional view taken along a plane passing through a central longitudinal axis of a lock mechanism according to the embodiment.

Lock mechanism 5 is arranged between first vane 41 and rear plate 9, for locking or releasing relative rotation of vane rotor 4 with respect to rear plate 9 (or housing HSG). Lock mechanism 5 includes lock piston 51, a lock hole constituent member such as a sleeve 52, a coil spring 53, and a spring retainer 54. FIG. 14 is a partial side sectional view taken along a plane passing through a central longitudinal axis of lock mechanism 5, showing a state of operation of lock piston 51 when the internal combustion engine is at rest, or the internal combustion engine is started.

First vane 41 is formed with slide hole 501 which extends through first vane 41 in the X-axis direction. A sealing member 502, which has a hollow cylindrical shape, is pressed-fitted in an X-axis negative side portion of slide hole 501. Sealing member 502 is formed of an iron alloy such as a carbon steel such as S45C, into a ring shape, and carburized. Lock piston 51 is mounted in slide hole 501 for sliding in the X-axis direction.

Lock piston 51 is formed of iron into a pin, having a hollow cylindrical shape with a bottom portion 510 at the X-axis negative side. Lock piston 51 is formed with a tip portion 511 which is adjacent to and in the X-axis negative direction from bottom portion 510, where a step is formed between bottom portion 510 and tip portion 511. Tip portion 511 has the form of a substantially truncated cone having a substantially trapezoidal longitudinal section. Lock piston 51 is formed with a cylindrical sliding portion 512 which is adjacent to and on the X-axis positive side of bottom portion 510. Lock piston 51 is formed with an annular flange 513 at the X-axis positive side end, which is adjacent to and on the X-axis positive side of sliding portion 512.

The outer diameter of sliding portion 512 is set substantially equal to the diameter of the inside peripheral surface of sealing member 502. The X-axis negative side portion of sliding portion 512 is mounted inside the sealing member 502 for sliding with respect to the inside peripheral surface of sealing member 502 in the X-axis direction. Sealing member 502 is made of iron, having a high hardness, so as to prevent wear resulting from sliding motion of sliding portion 512. The outer diameter of flange 513 is set substantially equal to the diameter of the inside peripheral surface of slide hole 501. Flange 513 is mounted in slide hole 501 for sliding with respect to slide hole 501. First vane 41 is formed with a pressure-receiving chamber 55 inside, which is defined by the X-axis positive side surface of sealing member 502, the X-axis negative side surface of flange 513, the inside peripheral surface of slide hole 501, and the outside peripheral surface of sliding portion 512.

On the other hand, rear plate 9 is formed with recess 900 which is located to face or conform to lock piston 51 as viewed in the X-axis direction, when intake valve timing control apparatus 1*a* is in the most retarded state shown in FIG. 4. Recess 900 is located in the chamber between first shoe 11 and second shoe 12, and more adjacent to first shoe 11 on the clockwise side of first shoe 11. Recess 900 has a bottom in rear plate 9, without passing through rear plate 9.

Sleeve 52, which is formed in a hollow cylindrical shape separately from rear plate 9, and referred to as engagement recess portion, or lock hole constituent member, is press-fitted in recess 900 of rear plate 9. In other words, sleeve 52 is fixed to rear plate 9, so that sleeve 52 is fixedly engaged with recess 900. Sleeve 52 is formed with a lock hole 521 inside. Sleeve 52 has a substantially trapezoidal section taken along a plane passing through the central longitudinal axis of sleeve 52. Lock hole 521 gradually spreads toward the X-axis positive side opening. Since the position of recess 900 is set as discussed above, the rotational position of vane rotor 4 with respect to housing HSG is set to the most retarded position which is optimal at start of the internal combustion engine, under the condition that lock piston 51 is engaged with lock hole 521 of sleeve 52.

An annular spring retainer 54 is mounted in the X-axis positive side end of slide hole 501. The outer diameter of spring retainer 54 is substantially equal to the diameter of the inside peripheral surface of slide hole 501. The X-axis positive side surface of spring retainer 54 is in contact with the X-axis negative side surface of front plate 8, whereas the X-axis negative side surface of spring retainer 54 is in contact with the X-axis positive side surface of flange 513 of lock piston 51.

A coil spring 53 is mounted in a compressed state between the X-axis negative side surface of front plate 8 and bottom portion 510 of lock piston 51. Front plate 8 is made of an iron-based metal material, and thereby has a high hardness. This prevents wear resulting from sliding motion of coil spring 53 on the X-axis negative side surface of front plate 8.

Coil spring 53 constantly biases lock piston 51 in the X-axis negative direction, i.e. toward rear plate 9, specifically toward lock hole 521 of sleeve 52. The X-axis positive side end portion of coil spring 53 is fitted with the inside periphery of spring retainer 54, so as to prevent coil spring 53 from deviating with respect to slide hole 501 in the lateral direction of lock piston 51.

When vane rotor 4 relatively rotates to the most retard side, and rotation of vane rotor 4 is restricted by the first stopper mechanism, namely, when flat portion 415 of first vane 41 is brought into contact with flat portion 111 of first shoe 11 so that the volumetric capacity of first advance chamber A1 is minimized, then the position of lock piston 51 is identical to the position of lock hole 521 as viewed in the X-axis direction. Under this condition, lock piston 51 is pressed by coil spring 53 to move in the X-axis negative direction so that the tip portion 511 moves out of slide hole 501 of first vane 41, and engages with lock hole 521. The engagement of lock piston 51 with lock hole 521 restricts or locks relative rotation between rear plate 9 and vane rotor 4, or relative rotation between housing HSG and intake camshaft 3*a*.

Since tip portion 511 has the form of a truncated cone as described above, lock piston 51 can be easily engaged with lock hole 521. Both of the diameters of tip portion 511 and lock hole 521 decrease when followed in the X-axis negative direction. The angle of inclination or tapering of the inside peripheral surface of lock hole 521 with respect to the X-axis is substantially equal to that of the outside peripheral surface of tip portion 511.

As shown in FIG. 14, the central longitudinal axis of lock hole 521 is slightly offset from the central longitudinal axis of tip portion 511 in the counterclockwise direction toward first shoe 11, as viewed in FIG. 4. Accordingly, when tip portion 511 moves in the X-axis negative direction, and engages with lock hole 521, the clockwise surface of tip portion 511 is brought into sliding contact with the counterclockwise surface of lock hole 521, so that a reaction force is applied to tip portion 511 of lock piston 51 in the counterclockwise direction due to a wedging effect. The counterclockwise reaction force acts on first vane 41, in which the lock piston 51 is mounted, and presses the first vane 41 onto the first shoe 11.

First vane 41 is formed with a communication hole 56 which hydraulically communicates first retard chamber R1 with pressure-receiving chamber 55. First vane 41 is also formed with a communication groove 57 at the X-axis negative side surface, which hydraulically communicates first advance chamber A1 with lock hole 521. The flange 513 of lock piston 51 is subject to a hydraulic force in the X-axis positive direction by the hydraulic pressure of working fluid which is supplied from first retard chamber R1 to pressure-receiving chamber 55 through the communication hole 56. Moreover, the tip portion 511 of lock piston 51 is subject to a hydraulic force in the X-axis positive direction by the hydraulic pressure of working fluid which is supplied from first advance chamber A1 to lock hole 521 through the communication groove 57.

Under the influence of the hydraulic forces described above, lock piston 51 moves in the X-axis positive direction against the elastic force of coil spring 53, so that the tip portion 511 moves out of lock hole 521, and lies inside the slide hole 501 of first vane 41. Engagement between lock piston 51 and lock hole 521 is thus released. In this way, communication hole 56 and communication groove 57 constitute a releasing hydraulic circuit. On the other hand, coil spring 53 serves as an engaging elastic member or lock state maintaining mechanism. Communication hole 56, communication groove 57, and coil spring 53 serve as an engagement and disengagement mechanism for lock piston 51.

As shown in FIG. 9A, the X-axis positive side surface of vane rotor 4 is formed with a rectangular groove 58 which hydraulically communicates recess 403 of rotor 40 with slide hole 501 of first vane 41. The depth of groove 58 is substantially equal to that of recess 403. Groove 58 extends from recess 403 outwardly in the radial direction, so as to hydraulically communicate recess 403 with the X-axis positive side of lock piston 51. On the other hand, recess 403 hydraulically communicates with the inside of the internal combustion engine through the air relief hole 407 and air relief hole 310, as shown in FIG. 3.

According to the construction described above, air on the X-axis positive side of lock piston 51 (where coil spring 53 is mounted) is carried through groove 58, recess 403, air relief hole 407, and air relief hole 310 to the inside of the internal combustion engine. This relieves the back pressure of lock piston 51, and provides improved operation of lock piston 51 (or sliding motion of lock piston 51 in slide hole 501) all over the possible range of relative rotation of vane rotor 4.

Hydraulic fluid supply and drainage mechanism 2 supplies working fluid to or drains working fluid from first, second and third advance chambers A1, A2 and A3, and first, second and third retard chambers R1, R2 and R3, so that vane rotor 4 rotates with respect to housing HSG by a predetermined angle in the advance direction or retard direction. Specifically, supply and drainage of working fluid causes changes in the volumetric capacities of first, second and third advance chambers A1, A2 and A3, and first, second and third retard chambers R1, R2 and R3, to generate a torque to rotate vane rotor 4 with respect to housing HSG, so that the torque is transmitted therebetween, and the phase of rotation of intake camshaft 3*a* with respect to rotation of the crankshaft is changed. Hydraulic fluid supply and drainage mechanism 2 includes an oil pump 1020 as a hydraulic pressure source, and a directional control valve 24 as a hydraulic control actuator.

The hydraulic circuit includes a retard passage 20 through which working fluid is supplied to or drained from first, second and third retard chambers R1, R2 and R3, and an advance passage 21 through which working fluid is supplied to or drained from first, second and third advance chambers A1, A2 and A3. Retard passage 20 and advance passage 21 are connected through the directional control valve 24 to a supply passage 22 and a drain passage 23. Oil pump 1020 is provided in supply passage 22 for pressurizing and supplying working fluid from oil pan 25 to directional control valve 24. Oil pump 1020 is mounted to the crankshaft, and may be implemented by a unidirectional variable displacement vane pump. The downstream end of drain passage 23 is hydraulically connected to oil pan 25.

Advance passage 21 includes a part formed inside the intake camshaft 3*a*. Specifically, extending from directional control valve 24, the advance passage 21 includes a radial fluid passage 210, and an axial fluid passage 211 which is formed to extend through the end portion 30 of intake camshaft 3*a* in the X-axis direction. Axial fluid passage 211 is hydraulically connected to second port 213 through a radial fluid passage 212. Second port 213 is in the form of an annular groove which extends circumferentially around the outside periphery of the X-axis positive side end portion of intake camshaft 3*a*. Similar to advance passage 21, retard passage 20 includes a part formed inside the intake camshaft 3*a*. Specifically, extending from directional control valve 24, retard passage 20 includes a radial fluid passage and an axial fluid passage 214. Retard passage 20 is hydraulically connected to a first port 215 through the radial fluid passage and axial fluid passage 214.

The position of first port 215 is substantially identical to the position of each retard fluid passage 408 in the X-axis direction, so that the retard fluid passage 408 hydraulically communicates at the inside periphery of rotor 40 with first port 215, and hydraulically communicates at the outside periphery of rotor 40 with first, second and third retard chambers R1, R2 and R3. Similarly, the position of second port 213 is substantially identical to the position of each advance fluid passage 409 in the X-axis direction, so that the advance fluid passage 409 hydraulically communicates at the inside periphery of rotor 40 with second port 213, and hydraulically communicates at the outside periphery of rotor 40 with first, second and third advance chambers A1, A2 and A3.

Directional control valve 24 is a direct-acting type solenoid valve with four ports and three positions, for controlling the hydraulic pressures of working fluid which is supplied to or drained from first, second and third advance chambers A1, A2 and A3, and first, second and third retard chambers R1, R2 and R3. Directional control valve 24 includes a valve body fixed to the cylinder head, a solenoid "SOL" fixed to the valve body, and a spool valve element slidably mounted inside the valve body. The valve body is formed with a supply port 240 hydraulically connected to supply passage 22, a first port 241 hydraulically connected to retard passage 20, a second port 242 hydraulically connected to advance passage 21, and a drain port 243 hydraulically connected to drain passage 23.

When an electromagnetic coil of solenoid SOL is energized, then solenoid SOL presses the spool valve element to move. The electromagnetic coil is electrically connected to controller CU through a harness. Each of first port 241 and second port 242 opens or closes according to movement of the spool valve element.

When solenoid SOL is de-energized, the spool valve element is biased by return spring RS to a position such that the supply port 240 (supply passage 22) and second port 242 (advance passage 21) are hydraulically connected to each other, and first port 241 (retard passage 20) and drain port 243 (drain passage 23) are hydraulically connected to each other. On the other hand, when solenoid SOL is energized, the spool valve element is controlled according to a control current from controller CU, to move against the elastic force of return spring RS to a predetermined intermediate position such that the supply port 240 (supply passage 22) and first port 241 (retard passage 20) are hydraulically connected to each other, and second port 242 (advance passage 21) and drain port 243 (drain passage 23) are hydraulically connected to each other.

Controller CU is an electrical control unit which is configured to measure a current operating state of the internal combustion engine on the basis of signals from sensors such as a crank angle sensor for measuring engine rotational speed, an air flow meter for measuring a quantity of intake air, a throttle valve opening sensor, and a coolant temperature sensor for measuring a coolant temperature of the internal combustion engine. Moreover, controller CU performs a flow direction control of selectively supplying working fluid to or draining working fluid from first, second and third advance chambers A1, A2 and A3, and first, second and third retard chambers R1, R2 and R3, by energizing or de-energizing the solenoid SOL of directional control valve 24 with a pulse control signal, according to the measured operating state of the internal combustion engine.

Figure 15:
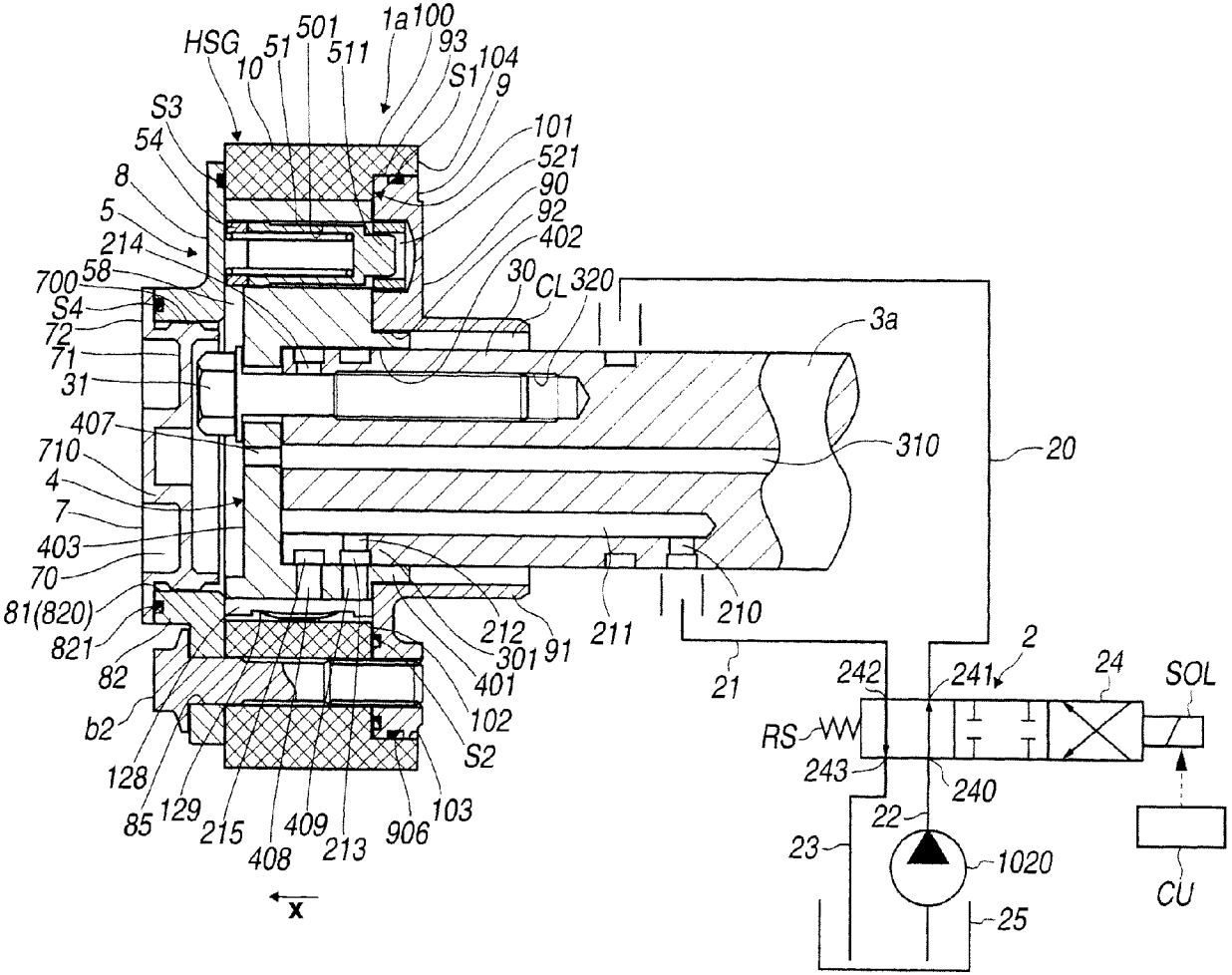
FIG. 15 is a partial side sectional view of the exhaust valve timing control apparatus, taken along a plane passing through an axis of rotation of the exhaust valve timing control apparatus.
Figure 16:
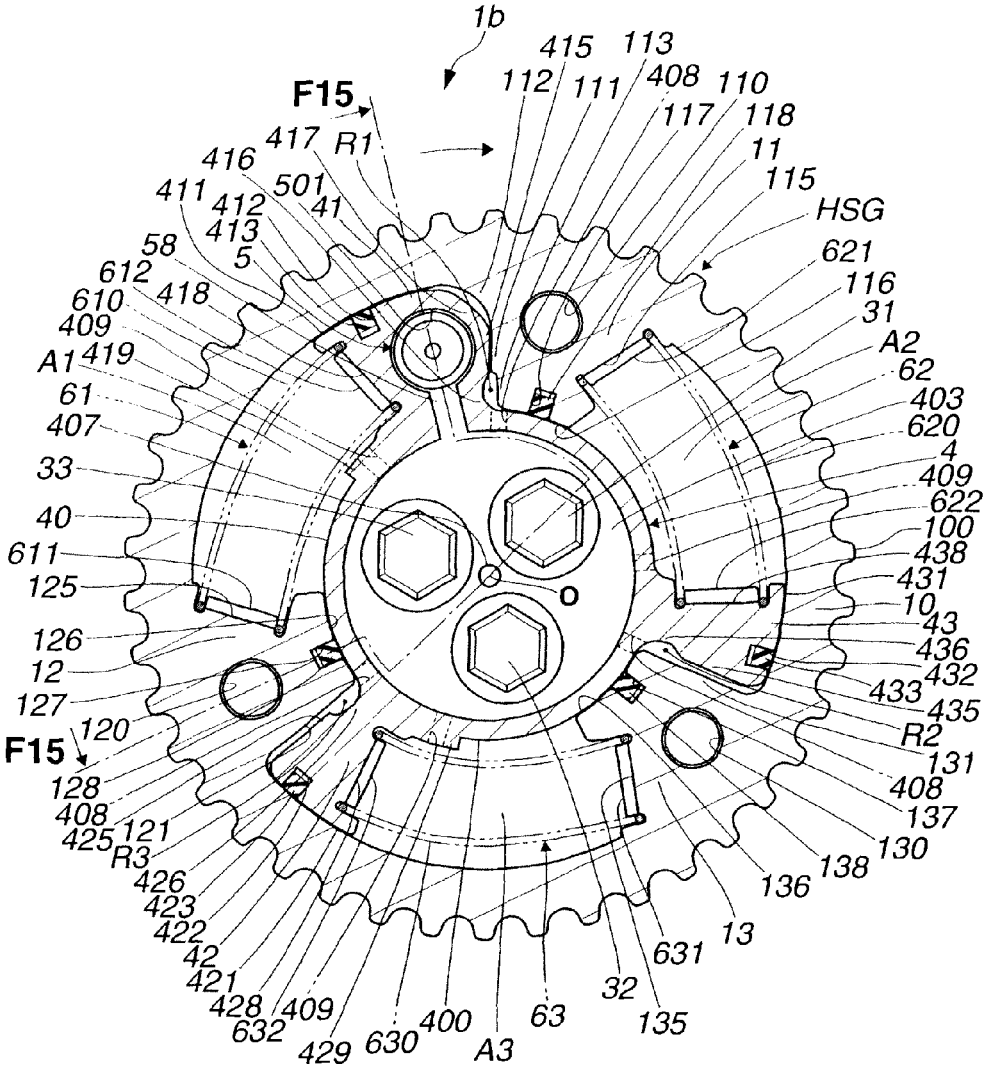
FIG. 16 is a front view of the exhaust valve timing control apparatus in a most advanced state, as viewed along the axis of rotation.
Figure 17:
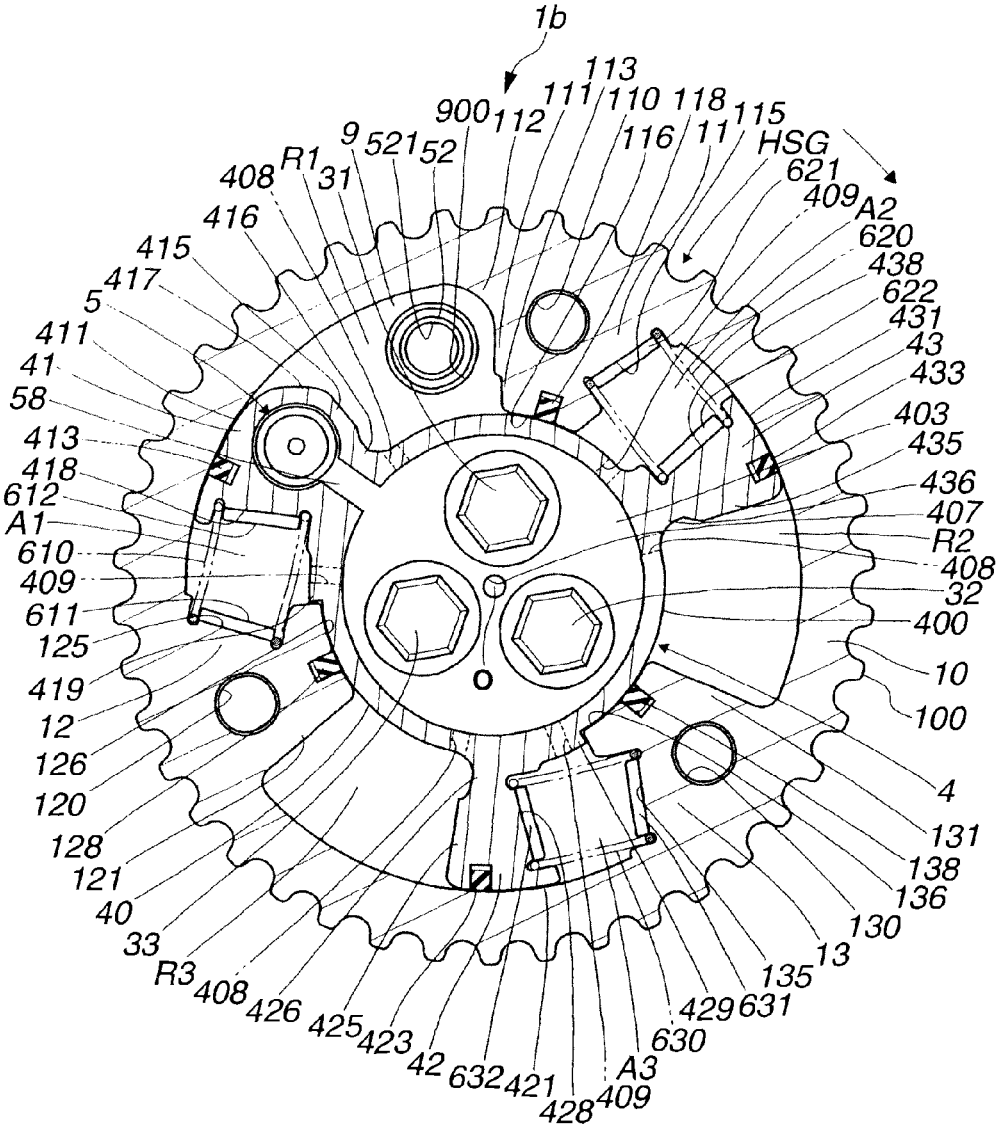
FIG. 17 is a front view of the exhaust valve timing control apparatus in a most retarded state, as viewed along the axis of rotation.

<Construction of Exhaust Valve Timing Control Apparatus> The following describes construction of exhaust valve timing control apparatus 1*b* which is provided for the exhaust valves of the internal combustion engine, with reference to FIGS. 15 to 19. In the following, constituent parts of exhaust valve timing control apparatus 1*b*, which are identical or similar to those of intake valve timing control apparatus 1*a*, are provided with identical reference characters, and with no duplicate description, and only different constituent parts are described. FIG. 15 is a partial side sectional view of exhaust valve timing control apparatus 1*b*, taken along a plane passing through an axis of rotation "O" (shown in FIG. 16) of exhaust valve timing control apparatus 1*b*, i.e. taken along a plane indicated by a long dashed short dashed line F15-F15 in FIG. 16. FIGS. 16 and 17 are front views of exhaust valve timing control apparatus 1*b* under the condition that the front plate 8, etc. are removed, as viewed from the X-axis positive side.

Exhaust valve timing control apparatus 1*b* controls variable valve timing of the exhaust valves by continuously changing a rotational phase of exhaust camshaft 3*b* with respect to the crankshaft by supplied working fluid. Pulley 100, as well as housing body 10, is rotated by the crankshaft of the internal combustion engine, in the clockwise direction in FIG. 16, according to movement of timing belt 1010 shown by the arrow in FIG. 1.

As shown in FIG. 15, front plate 8 of exhaust valve timing control apparatus 1*b* is provided with no outside periphery 80 which is provided in intake valve timing control apparatus 1*a*, so that the diameter of front plate 8 of exhaust valve timing control apparatus 1*b* is smaller than the diameter, or maximum diameter, of pulley 100. The outside periphery of front plate 8 is more adjacent to annular groove 89 with a shorter distance than distance r shown in FIG. 12. Accordingly, as shown in FIG. 1, as viewed in the X-axis direction, the outside periphery of pulley 100 of exhaust valve timing control apparatus 1*b* projects radially outwardly from the outside periphery of front plate 8. In other words, the diameter of exhaust valve timing control apparatus 1*b* is set smaller than that of intake valve timing control apparatus 1*a* where outside periphery 80 of front plate 8 projects radially outwardly from the outside periphery of pulley 100.

Figures 18A, 18B, 18C:
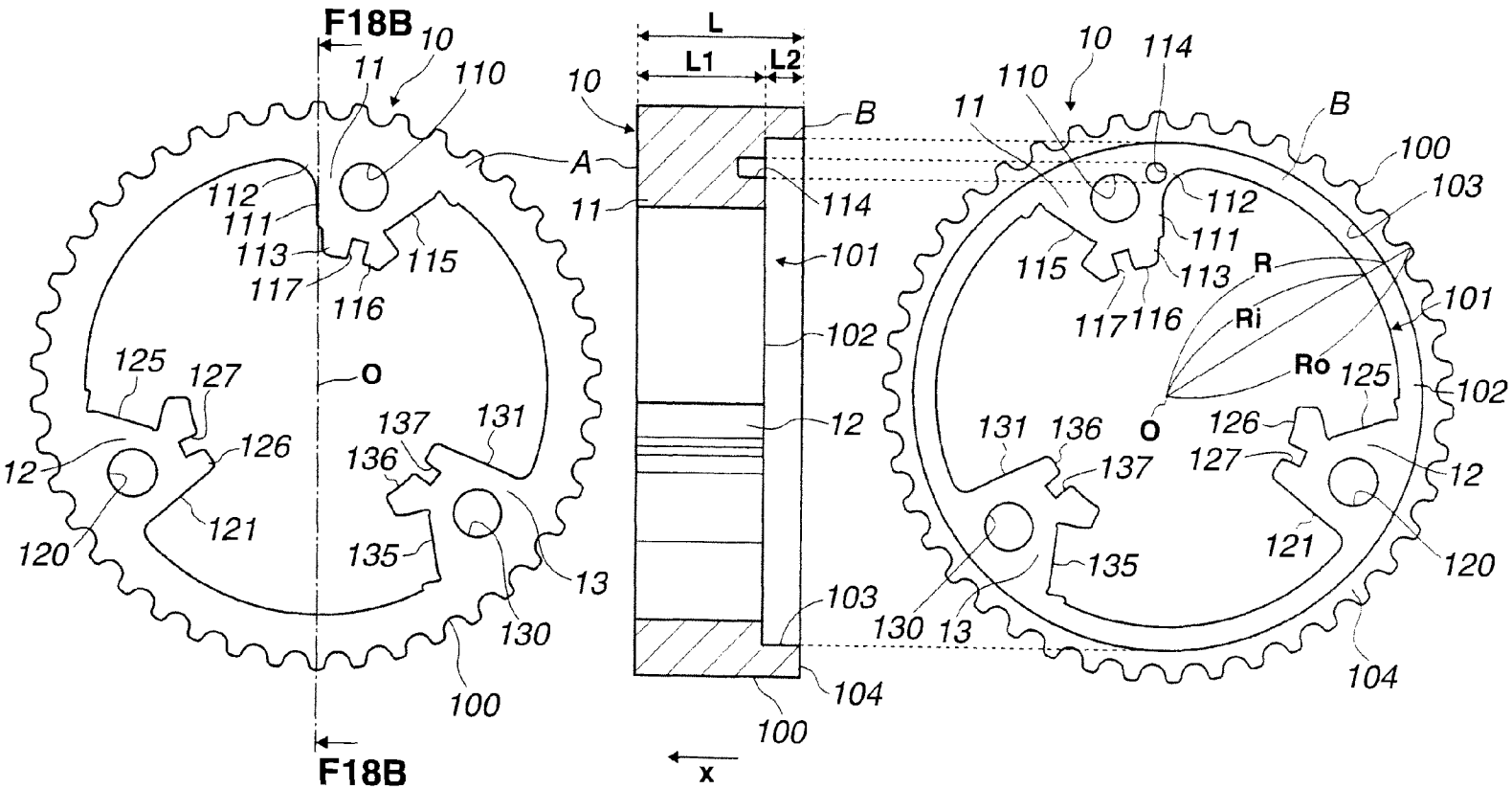
FIGS. 18A, 18B and 18C are views of the housing body of the exhaust valve timing control apparatus, where

Housing body 10 of exhaust valve timing control apparatus 1*b* is a mirror image of the housing body of intake valve timing control apparatus 1*a* with respect to a plane perpendicular to the X-axis. FIGS. 18A, 18B and 18C are views of housing body 10 of exhaust valve timing control apparatus 1*b*, where FIG. 18A is a front view as viewed from the X-axis positive side, FIG. 18B is a side sectional view taken along a plane indicated by F18B-F18B in FIG. 18A, and FIG. 18C is a rear view as viewed from the X-axis negative side. FIGS. 7 and 8 are perspective views of workpieces during a process of manufacturing the housing body 10 also for exhaust valve timing control apparatus 1*b*.

Housing body 10 of exhaust valve timing control apparatus 1*b* is formed from an aluminum extrusion shown in FIG. 7, similar to intake valve timing control apparatus la. Third workpiece P3 shown in FIG. 8 is obtained through the second workpiece P2 from first workpiece P1. Finally, third workpiece P3 is treated with a cutting process, to form a sealing recess 101, bolt hole 110, etc., and thereby form a final shape of housing body 10 shown in FIGS. 18A, 18B and 18C. In contrast to intake valve timing control apparatus 1*a* where sealing recess 101 and positioning recess 114 are formed in the side "A" (shown in FIG. 8) of third workpiece P3 as shown in FIGS. 6A, 6B and 6C, sealing recess 101 and positioning recess 114 are formed in the side "B" (shown in FIG. 8) of third workpiece P3 for exhaust valve timing control apparatus 1*b*, as shown in FIGS. 18A, 18B and 18C.

Figure 19B:
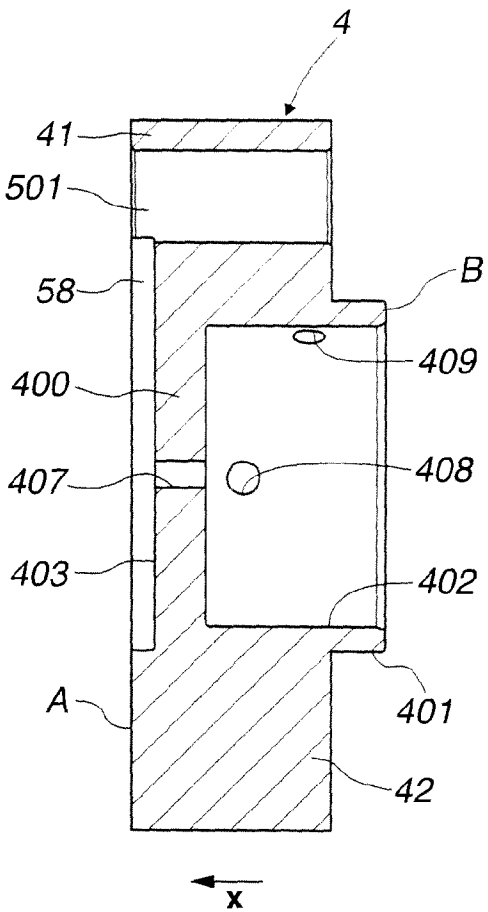
FIGS. 19A and 19B are views of the vane rotor of the exhaust valve timing control apparatus, where
Figure 19A:
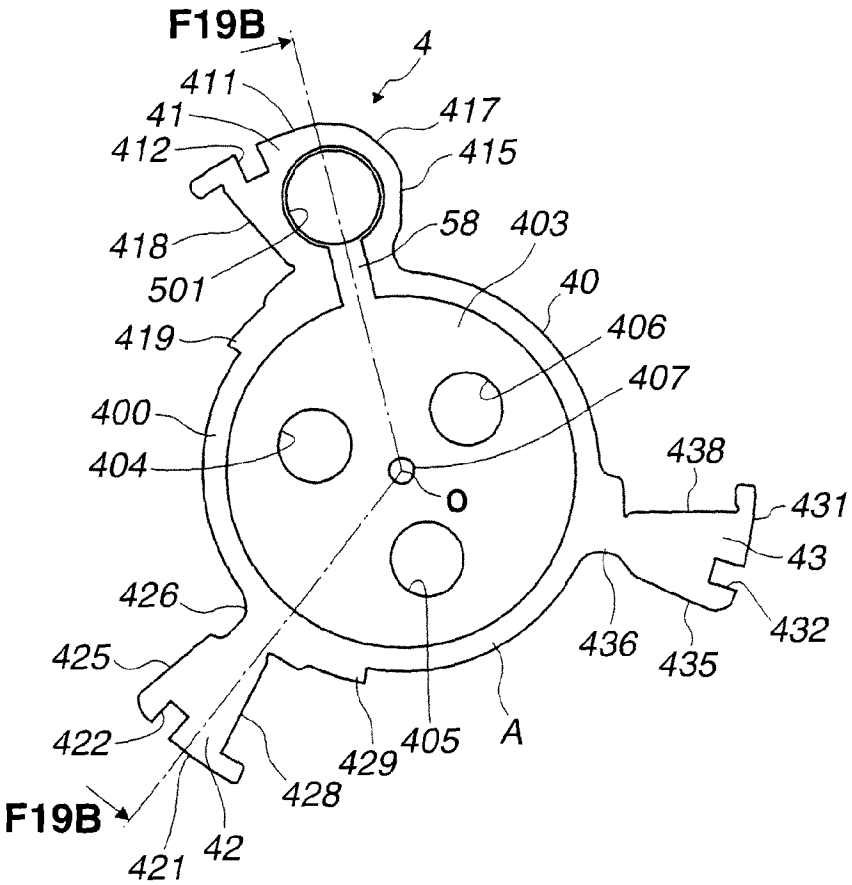

Also, vane rotor 4 of exhaust valve timing control apparatus 1*b* is a mirror image of the vane rotor of intake valve timing control apparatus 1*a* with respect to a plane perpendicular to the X-axis. FIGS. 19A, 19B and 19C are views of vane rotor 4 of exhaust valve timing control apparatus 1*b*, where FIG. 19A is a front view as viewed from the X-axis positive side, and FIG. 19B is a side sectional view taken along a plane indicated by F19B-F19B in FIG. 19A. FIGS. 10 and 11 are perspective views of workpieces during a process of manufacturing the vane rotor 4 also for exhaust valve timing control apparatus 1*b*.

Vane rotor 4 of exhaust valve timing control apparatus 1*b* is formed from an aluminum extrusion (first workpiece Q1) shown in FIG. 10, similar to intake valve timing control apparatus 1*a*. Then, second workpiece Q2, which is obtained from first workpiece Q1, is treated with a cutting process, to form a boss portion 401, a fitting hole 402, etc., and thereby form a final shape of vane rotor 4 shown in FIGS. 19A and 19B. In contrast to intake valve timing control apparatus 1*a* where boss portion 401 and fitting hole 402 are formed on the side "A" of second workpiece Q2, boss portion 401 and fitting hole 402 are formed on the side "B" of second workpiece Q2 for exhaust valve timing control apparatus 1*b*, as shown in FIGS. 19A and 19B. Finally, the entire outside surfaces of second workpiece Q2 are treated with an anodizing process, to form a third workpiece Q3 with has hardened surfaces.

In this way, housing bodies 10 and vane rotors 4 of intake valve timing control apparatus 1*a* and exhaust valve timing control apparatus 1*b* are mirror images which are formed from the identical or common workpieces P3 and Q2 which are formed before the cutting processes. As shown in FIGS. 16 and 4, the shapes and relative positions of housing body 10 and vane rotor 4 of exhaust valve timing control apparatus 1*b* are mirror images of those of intake valve timing control apparatus 1*a* as viewed from the X-axis positive side.

First, second and third shoes 11, 12 and 13 are arranged in this order in the counterclockwise direction in FIG. 16. As viewed from the X-axis positive side, the clockwise surfaces of first, second and third shoes 11, 12 and 13 are formed with recesses 115, 125 and 135 respectively. The counterclockwise surfaces of first, second and third shoes 11, 12 and 13 are formed with flat portions 111, 121 and 131 respectively.

First, second and third vanes 41, 42 and 43 are arranged in this order in the counterclockwise direction in FIG. 16. As viewed from the X-axis positive side, the clockwise surfaces of first, second and third vanes 41, 42 and 43 are formed with flat portions 415, 425 and 435 respectively. The counterclockwise surfaces of first, second and third vanes 41, 42 and 43 are formed with recesses 418, 428 and 438 respectively. The counterclockwise surfaces of the roots of first and second vanes 41 and 42 are formed with stopper portions 419 and 429 respectively.

Under the condition that the vane rotor 4 is mounted in housing HSG, first vane 41 is mounted in the space between first shoe 11 and second shoe 12, second vane 42 is mounted in the space between second shoe 12 and third shoe 13, and third vane 43 is mounted in the space between third shoe 13 and first shoe 11.

Rotor body 400 is formed with three retard fluid passages 408 and three advance fluid passages 409 which are connected between fitting hole 402 and the outside peripheral surface of rotor 40 (rotor body 400). In the case of first vane 41, retard fluid passage 408 is formed substantially in a midpoint in the X-axis direction as shown in FIG. 19B, and in the clockwise side of the root of first vane 41 as viewed from the X-axis positive side, as shown in FIG. 16, where retard fluid passage 408 is formed to extend through in the radial direction, as shown in FIG. 16. On the other hand, advance fluid passage 409 is formed in the X-axis negative side in first vane 41, and in the counterclockwise side of the root of first vane 41 as viewed from the X-axis positive side, as shown in FIG. 16, where advance fluid passage 409 is formed to extend through in the radial direction, as shown in FIG. 16. Similarly, retard fluid passages 408 and advance fluid passages 409 are formed in the roots of second vane 42 and third vane 43, extending through in the radial direction.

First, second and third advance chambers A1, A2 and A3, and first, second and third retard chambers R1, R2 and R3 are defined by the X-axis negative side surface of front plate 8, the X-axis positive side surface of rear plate 9, the circumferentially-facing surfaces of first, second and third vanes 41, 42 and 43, and the circumferentially-facing surfaces of first, second and third shoes 11, 12 and 13. For example, first advance chamber A1 is defined between the clockwise surface of second shoe 12, the counterclockwise surface of first vane 41, whereas first retard chamber R1 is defined between the clockwise surface of first vane 41 and the counterclockwise surface of first shoe 11, as shown in FIG. 16. Similarly, second advance chamber A2 is defined between first shoe 11 and third vane 43, second retard chamber R2 is defined between third vane 43 and third shoe 13, third advance chamber A3 is defined between third shoe 13 and second vane 42, and third retard chamber R3 is defined between second vane 42 and second shoe 12.

Rotation of vane rotor 4 with respect to housing HSG in the clockwise direction is restricted by contact between flat portion 111 of first shoe 11 and flat portion 415 of first vane 41, where rotation of vane rotor 4 is locked by lock piston 51, similar to intake valve timing control apparatus 1*a*, as shown in FIG. 16. Flat portion 111 of the circumferentially-facing surface of first shoe 11 and flat portion 415 of the circumferentially-facing surface of 41 serve as first stopper portions constituting a first stopper mechanism for restricting relative rotation of vane rotor 4 in the clockwise direction (in the advance direction).

On the other hand, rotation of vane rotor 4 with respect to housing HSG in the counterclockwise direction is restricted by contact between tip 126 of second shoe 12 and stopper portion 419 of first shoe 11, where vane rotor 4 is in the end position in the direction away from the position where rotation of vane rotor 4 is locked by lock piston 51, similar to intake valve timing control apparatus 1*a*, as shown in FIG. 17. The counterclockwise surface of stopper portion 419 and the clockwise surface of tip 126 of second shoe 12 serve as second stopper portions constituting a second stopper mechanism for restricting relative rotation of vane rotor 4 in the counterclockwise direction (in the retard direction). The first and second stopper mechanisms define a range of relative rotation of vane rotor 4 with respect to housing HSG. As in intake valve timing control apparatus 1*a*, the contact area between tip 126 of second shoe 12 and stopper portion 419 of first shoe 11, i.e. the contact area of the second stopper mechanism, SS2, is set smaller than the contact area between flat portion 111 of first shoe 11 and the flat portion 415 of first vane 41, i.e. the contact area of the first stopper mechanism, SS1 (SS1>SS2).

Exhaust camshaft 3*b* is made of iron, and rotatably supported on bearings in a laterally-outside portion of the upper end portion of the cylinder head of the internal combustion engine. Exhaust camshaft 3*b* is formed with drive cams (exhaust cams) at the outside peripheral surface, which are located to face or conform to positions of the exhaust valves. When exhaust camshaft 3*b* is rotated, the exhaust cams open and close the exhaust valves via valve lifters, rocker arms, etc. Exhaust valve timing control apparatus 1*b*, which is fixed to exhaust camshaft 3*b*, is constructed to be locked by lock piston 51 as an engagement member, under the condition that rotation of vane rotor 4 is restricted by the first stopper mechanism at the most advanced position.

In contrast to intake valve timing control apparatus 1*a*, exhaust valve timing control apparatus 1*b* is provided with a biasing member for biasing the vane rotor 4 with respect to housing HSG in the advance direction. The biasing member, which is collectively referred to as biasing member 6, includes three spring units, i.e. first, second and third spring units 61, 62 and 63. First, second and third spring units 61, 62 and 63 are mounted in first, second and third advance chambers A1, A2 and A3 respectively, for biasing the first, second and third vanes 41, 42 and 43 of vane rotor 4 with respect to first, second and third shoes 11, 12 and 13 of housing body 10 in the clockwise direction.

Specifically, first spring unit 61 is mounted in first advance chamber A1 between second shoe 12 and first vane 41, second spring unit 62 is mounted in second advance chamber A2 between first shoe 11 and third vane 43, and third spring unit 63 is mounted in third advance chamber A3 between third shoe 13 and second vane 42. The longitudinal ends of first, second and third spring units 61, 62 and 63 are mounted in recesses 418, 428 and 438, and recesses 115, 125 and 135, where recesses 418, 428 and 438 are formed in the counterclockwise surfaces of first, second and third vanes 41, 42 and 43, respectively, and recesses 115, 125 and 135 are formed in the opposite clockwise surfaces of first, second and third shoes 11, 12 and 13, respectively.

First spring unit 61 includes a coil spring 610, and retaining portions 611 and 612 which are spring retainers provided at the longitudinal ends of coil spring 610. Retaining portion 611 includes a plate portion in which a through hole is formed, and a hollow cylindrical portion which projects from one side surface of the plate portion, and surrounds the through hole. One longitudinal end of coil spring 610 is fitted with the outside periphery of the hollow cylindrical portion of retaining portion 611.

The plate portion of retaining portion 611 has a rectangular shape adapted to be fitted in recess 125 of second shoe 12 without play, and is fitted in recess 125. Recess 125 restricts movement of retaining portion 611 with respect to second shoe 12 of housing HSG in the radial direction of housing HSG. Front plate 8 and rear plate 9, which are in contact with the X-axis ends of the plate portion of retaining portion 611, restrict movement of retaining portion 611 in recess 125 in the X-axis direction within a predetermined range.

First advance chamber A1 is hydraulically connected to pressure-receiving chamber 55 of lock mechanism 5 shown in FIG. 14 through the through hole of retaining portion 611 and communication hole 56 of first vane 41. First retard chamber R1 is hydraulically connected to lock hole 521 of lock mechanism 5 through the communication groove 57 of first vane 41.

Retaining portion 612 of first spring unit 61 is constructed similar to retaining portion 611. Specifically, the hollow cylindrical portion of retaining portion 612 retains the other longitudinal end of coil spring 610, and the plate portion of retaining portion 612 is supported in recess 418 of first vane 41 so that the recess 418 restricts movement of retaining portion 612 of first spring unit 61 with respect to first vane 41 of vane rotor 4 in the radial direction and in the axial direction of housing HSG. In this way, the positions of the longitudinal ends of coil spring 610 in the radial direction and the axial direction of housing HSG are restricted.

During assembling operation, first spring unit 61 is inserted in the X-axis direction into first advance chamber A1, so that the retaining portion 611 is fitted in recess 125, and retaining portion 612 is fitted in recess 418. Coil spring 610 is mounted in first advance chamber A1 in a compressed state, so as to constantly bias first vane 41 with respect to second shoe 12 of housing body 10 in the clockwise direction.

Second spring unit 62, and third spring unit 63 are constructed and mounted similar to first spring unit 61. Second spring unit 62 includes a coil spring 620, and retaining portions 621 and 622, and third spring unit 63 includes a coil spring 630, and retaining portions 631 and 632. The biasing forces of coil springs 610, 620 and 630 are set substantially equal to each other. The diameters of coil springs 610, 620 and 630 are equal to about 70% of the maximum widths of first, second and third advance chambers A1, A2 and A3 in the radial direction, respectively.

When vane rotor 4 rotates with respect to housing HSG in the counterclockwise direction, coil springs 610, 620 and 630 are compressed. The clockwise side portion of coil spring 610 is located outside of stopper portion 419 of first vane 41 in the radial direction of housing HSG. The height of stopper portion 419 in the radial direction of vane rotor 4 is set so that the outside periphery of stopper portion 419 is close to the outside periphery of coil spring 610 with a slight clearance.

Accordingly, when coil spring 610 is compressed and deformed, the periphery of coil spring 610 facing the stopper portion 419 is brought into contact with the outside peripheral surface of stopper portion 419, so that coil spring 610 is prevented from deforming over a predetermined distance inwardly in the radial direction of vane rotor 4. Namely, stopper portion 419 serves to guide the coil spring 610. Stopper portion 429 of second vane 42 is constructed similar to stopper portion 419, so as to guide coil spring 630 when vane rotor 4 relatively rotates so as to compress coil spring 630.

As shown in FIG. 17, when rotation of vane rotor 4 in the counterclockwise direction is restricted by contact between tip 126 of second shoe 12 and stopper portion 419 of first shoe 11, the opposite shoe-side and vane-side retaining portions 611 and 612 or 621 and 622 or 631 and 632 of each of first, second and third spring units 61, 62 and 63 are out of contact with each other, and wounded wires of each of coil springs 610, 620 and 630 are out of contact with each other. In other words, when the counterclockwise rotation is restricted by the second stopper mechanism, the circumferential length of each of first, second and third advance chambers A1, A2 and A3 is set larger than the length of the respective one of coil springs 610, 620 and 630 under the condition the wounded wires are completely in contact with each other.

Hydraulic fluid supply and drainage mechanism 2 of exhaust valve timing control apparatus 1*b* is constructed similar to intake valve timing control apparatus 1*a*. Exhaust valve timing control apparatus 1*b* includes directional control valve 24 other than directional control valve 24 of intake valve timing control apparatus 1*a*, but shares oil pump 1020 and oil pan 25 with intake valve timing control apparatus 1*a*.

<<Operations and Produced Effects by Valve Timing Control Apparatus>> The following describes operations of intake valve timing control apparatus 1*a* and exhaust valve timing control apparatus 1*b*.

<Operations and Produced Effects Related to Phase Change> The following describes control operations and produced effects related to phase change by intake valve timing control apparatus 1*a* and exhaust valve timing control apparatus 1*b*. However, the control operations may be adjusted or modified as appropriate. First, the following describes how intake valve timing control apparatus 1*a* performs a phase change control. FIG. 4 shows the most retarded state when the internal combustion engine is at rest or at start. FIG. 5 shows the most advanced state when the internal combustion engine is operating.

At start of the internal combustion engine, lock mechanism 5 maintains vane rotor 4 locked in the most retarded position as an initial position which is optimal for cranking the internal combustion engine, as shown in FIG. 4. When an ignition switch is turned on, intake valve timing control apparatus 1*a* achieves smooth cranking operation, improving the startability of the internal combustion engine.

In a predetermined low speed and low load region after start of the internal combustion engine, the controller CU maintains a condition that no control current is outputted to directional control valve 24. Accordingly, in directional control valve 24, the spool valve element is maintained by the elastic force of return spring RS at the position such that the supply port 240 is hydraulically connected to second port 242, and first port 241 is hydraulically connected to drain port 243. Accordingly, working fluid, which is discharged by oil pump 1020, flows in supply passage 22, enters the valve body through supply port 240, flows through the second port 242 into advance passage 21, flows in advance fluid passages 409 of vane rotor 4, and finally flows into first, second and third advance chambers A1, A2 and A3. The internal pressures of first, second and third advance chambers A1, A2 and A3 increase with an increase in the discharge pressure of oil pump 1020. On the other hand, working fluid is drained from first, second and third retard chambers R1, R2 and R3 to oil pan 25 through retard passage 20 and drain passage 23, so that the internal pressures of first, second and third retard chambers R1, R2 and R3 are held low.

As the internal pressure of first advance chamber A1 rises, this hydraulic pressure is supplied through the communication groove 57 shown in FIG. 14 to lock hole 521, so that the tip portion 511 of lock piston 51 is subject to a hydraulic force in the X-axis positive direction. When the hydraulic force is above the elastic force of coil spring 53, lock piston 51 moves in the X-axis positive direction. When tip portion 511 has moved completely out of lock hole 521, the lock state is canceled. This allows vane rotor 4 to rotate freely, so that the valve timing can be changed arbitrarily.

Under the hydraulic pressures supplied to first, second and third advance chambers A1, A2 and A3, vane rotor 4 rotates with respect to housing HSG from the position shown in FIG. 4, so as to change the rotational phase (relative rotational angle) of intake camshaft 3*a* with respect to the crankshaft in the advance direction. This results in a large valve overlap which is a period when both of the intake valves and exhaust valves are opened. As a result, the opening and closing timing of the intake valves is advanced, so that in the low speed and low load region, the combustion efficiency is improved because of use of inertial charge, thereby stabilizing the rotation of the internal combustion engine, and improving the fuel efficiency. As shown in FIG. 5, when vane rotor 4 rotates with respect to housing HSG and reaches the most advanced position such that the volumetric capacities of first, second and third advance chambers A1, A2 and A3 are maximized, and the volumetric capacities of first, second and third retard chambers R1, R2 and R3 are minimized, then the valve overlap is maximized.

On the other hand, when the internal combustion engine shifts to an operating state in a predetermined high speed and high load region, the controller CU outputs a control current to directional control valve 24. In directional control valve 24, the spool valve element moves against the elastic force of return spring RS to the position such that the supply port 240 is hydraulically connected to first port 241, and second port 242 is hydraulically connected to drain port 243. Accordingly, working fluid, which is discharged by oil pump 1020, flows through the first port 241 of directional control valve 24 into retard passage 20, and flows through the retard fluid passages 408 to first, second and third retard chambers R1, R2 and R3, so that the internal pressures of first, second and third retard chambers R1, R2 and R3 rise. On the other hand, working fluid is drained from first, second and third advance chambers A1, A2 and A3 to oil pan 25 through the advance passage 21 and drain passage 23, so that the internal pressures of first, second and third advance chambers A1, A2 and A3 fall.

Under the condition described above, in lock mechanism 5, the hydraulic pressure in lock hole 521 falls. On the other hand, as the internal pressure of first retard chamber R1 increases, this hydraulic pressure is supplied through the communication hole 56 shown in FIG. 14 to pressure-receiving chamber 55, so as to apply a hydraulic force to a pressure-receiving surface of flange 513 of lock piston 51. Accordingly, lock mechanism 5 is maintained in a released state in which lock piston 51 is brought out of lock hole 521 against the elastic force of coil spring 53.

When the internal pressures of first, second and third retard chambers R1, R2 and R3 are above the internal pressures of first, second and third advance chambers A1, A2 and A3, then the vane rotor 4 rotates with respect to housing HSG in the counterclockwise direction which is opposite to the direction of rotation of housing HSG indicated by the arrow in FIG. 4, so as to change the rotational phase (relative rotational angle) of intake camshaft 3*a* with respect to the crankshaft in the retard direction. As a result, the opening and closing timing of the intake valves is retarded, so as to enhance the output of the internal combustion engine in the high speed and high load region. As shown in FIG. 4, when vane rotor 4 rotates with respect to housing HSG and reaches the most retarded position such that the volumetric capacities of first, second and third advance chambers A1, A2 and A3 are minimized, and the volumetric capacities of first, second and third retard chambers R1, R2 and R3 are maximized, the valve overlap is minimized.

Moreover, for example, when the internal combustion engine shifts into a predetermined middle speed and middle load region, the controller CU controls directional control valve 24 so as to hold the spool valve element in the intermediate operation position such that the supply passage 22 and drain passage 23 are hydraulically disconnected from each other. Accordingly, the internal pressures of first, second and third retard chambers R1, R2 and R3, and first, second and third advance chambers A1, A2 and A3 are held constant, and vane rotor 4 is set in an intermediate rotational position. This serves to achieve a suitable valve timing control in the middle speed and middle load region, and a suitable balance between the fuel efficiency and the output of the internal combustion engine.

When the internal combustion engine is operating, and intake camshaft 3*a* is rotating, an alternating torque acts on intake camshaft 3*a* due to a reaction torque that is transmitted to the intake cams of intake camshaft 3*a* from the valve springs which bias the intake valves in a closing direction. Namely, depending on the shape of the intake cams, intake camshaft 3*a* is subject to alternately a negative torque which is a counterclockwise torque against clockwise rotation of intake camshaft 3*a*, and a positive torque which is a clockwise torque against counterclockwise rotation of intake camshaft 3*a*. The alternating toque is offset to the negative side as a whole. Namely, if the positive torques and negative torques, which are generated in each period of rotation of intake camshaft 3*a*, are integrated with time, the integral is negative. Accordingly, intake camshaft 3*a* is subject to a negative torque as a whole.

When the internal combustion engine is stopped, then operation of oil pump 1020 is stopped, and energization of directional control valve 24 by controller CU is turned off. Accordingly, supply of working fluid to first, second and third advance chambers A1, A2 and A3, and first, second and third retard chambers R1, R2 and R3 is stopped. In summary, immediately after the internal combustion engine is stopped, the friction or alternating torque offset to the negative side, which is applied to intake camshaft 3*a*, serves to rotate vane rotor 4 with respect to housing HSG in the direction opposite to the direction of rotation of housing HSG indicated by the arrow in FIG. 4, i.e. serves to rotate vane rotor 4 with respect to housing HSG in the retard direction.

As a result, after the internal combustion engine is stopped, vane rotor 4 mechanically moves to the predetermined initial position suitable for start or restart of the internal combustion engine, i.e. vane rotor 4 mechanically moves to the most retarded position shown in FIG. 4, under the friction or alternating torque applied to intake camshaft 3*a*. In other words, after the internal combustion engine is stopped, the valve timing is mechanically brought to a phase suitable for start or restart of the internal combustion engine.

When vane rotor 4 rotates with respect to housing HSG, and reaches the most retarded position, then lock piston 51 overlaps with lock hole 521 in lock mechanism 5 as viewed in the X-axis direction. When the internal combustion engine is stopped, the tip portion 511 of lock piston 51 fits and engages with lock hole 521 by the elastic force of coil spring 53, so that the lock piston 51 prevents free rotation of vane rotor 4.

As discussed above, in intake valve timing control apparatus 1*a*, vane rotor 4 is mechanically rotated to the most retarded position with respect to housing HSG as an initial position, when the internal combustion engine is stopped. This is effective for setting the intake valve timing control apparatus 1*a* in the initial position when the internal combustion engine is restarted, and achieving a stable start and operation of intake valve timing control apparatus 1*a*.

The following describes how exhaust valve timing control apparatus 1*b* performs a phase change control. Exhaust valve timing control apparatus 1*b* operates similar to intake valve timing control apparatus 1*a*, except that the advance side and the retard side are reversed. FIG. 16 shows the most advanced state when the internal combustion engine is at rest or at start. FIG. 17 shows the most retarded state when the internal combustion engine is operating.

At start of the internal combustion engine, lock mechanism 5 holds vane rotor 4 in the most advanced position as an initial position which is optimal for cranking the internal combustion engine, as shown in FIG. 16. When the ignition switch is turned on, exhaust valve timing control apparatus 1*b* achieves smooth cranking operation, improving the startability of the internal combustion engine.

In the predetermined low speed and low load region after start of the internal combustion engine, the rotational phase of exhaust camshaft 3*b* is retarded by the hydraulic pressures supplied to first, second and third retard chambers R1, R2 and R3, so as to increase the valve overlap. As shown in FIG. 17, when vane rotor 4 rotates with respect to housing HSG and reaches the most retarded position such that the volumetric capacities of first, second and third advance chambers A1, A2 and A3 are minimized, and the volumetric capacities of first, second and third retard chambers R1, R2 and R3 are maximized, the valve overlap is maximized.

On the other hand, when the internal combustion engine shifts to an operating state in the high speed and high load region, working fluid is supplied to first, second and third advance chambers A1, A2 and A3. When the sum of a torque resulting from the hydraulic pressures of first, second and third advance chambers A1, A2 and A3, and a torque resulting from the biasing forces of first, second and third spring units 61, 62 and 63 is above a torque resulting from the hydraulic pressures of first, second and third retard chambers R1, R2 and R3, then the vane rotor 4 relatively rotates in the advance direction. Accordingly, the rotational phase (relative rotational angle) of exhaust camshaft 3*b* is advanced so as to reduce the valve overlap. In other words, first, second and third spring units 61, 62 and 63 also serve to assist the phase change in the advance direction. As shown in FIG. 16, when vane rotor 4 rotates with respect to housing HSG and reaches the most advanced position such that the volumetric capacities of first, second and third advance chambers A1, A2 and A3 are maximized, and the volumetric capacities of first, second and third retard chambers R1, R2 and R3 are minimized, the valve overlap is minimized.

When the internal combustion engine is operating, exhaust camshaft 3*b* is subject to an alternating torque which is a negative torque or counterclockwise torque as a whole against clockwise rotation of exhaust camshaft 3*b*. When the internal combustion engine is stopped so as to turn off energization of directional control valve 24, then the alternating torque acts on the vane rotor 4 in the counterclockwise direction or in the retard direction with respect to housing HSG.

On the other hand, biasing member 6 (first, second and third spring units 61, 62 and 63) constantly biases vane rotor 4 with respect to housing HSG in the clockwise direction or advance direction. Accordingly, after the internal combustion engine is stopped, vane rotor 4 is moved by the biasing force of biasing member 6 under little influence of the alternating torque, to the initial position suitable for start or restart of the internal combustion engine, i.e. to the most advanced position. In other words, the valve timing is mechanically brought to the phase suitable for start or restart of the internal combustion engine.

When vane rotor 4 rotates with respect to housing HSG, and reaches the most advanced position, then lock piston 51 overlaps with lock hole 521 in lock mechanism 5 as viewed in the X-axis direction. When the internal combustion engine is stopped, tip portion 511 of lock piston 51 fits and engages with lock hole 521 by the elastic force of coil spring 53, so that lock piston 51 prevents free rotation of vane rotor 4.

As discussed above, in exhaust valve timing control apparatus 1*b*, vane rotor 4 is rotated by the biasing force of biasing member 6 to the most advanced position as an initial position with respect to housing HSG, when the internal combustion engine is stopped. This is effective for setting the exhaust valve timing control apparatus 1*b* in the initial position when the internal combustion engine is restarted, and achieving a stable start and operation of exhaust valve timing control apparatus 1*b*.

<Operation and Produced Effects by Lock Mechanism> As discussed above, when intake valve timing control apparatus 1*a* is in the initial position shown in FIG. 4, or when exhaust valve timing control apparatus 1*b* is in the initial position shown in FIG. 16, lock mechanism 5 of each of intake valve timing control apparatus 1*a* and exhaust valve timing control apparatus 1*b* is operated to prevent rotation of vane rotor 4 with respect to housing HSG. This serves to hold the housing HSG and vane rotor 4 even under the condition that no hydraulic pressure is generated at start or restart of the internal combustion engine, and allows to start operation of intake valve timing control apparatus 1*a* and exhaust valve timing control apparatus 1*b* from the initial positions independently of presence of hydraulic pressures. This is effective for stably operating the internal combustion engine, intake valve timing control apparatus 1*a*, and exhaust valve timing control apparatus 1*b*, even when the internal combustion engine is at start or at idle, while preventing vibration (abnormal noise due to collision) between vane rotor 4 and housing HSG, knocking, etc., which result from the alternating torques applied to intake camshaft 3*a* and exhaust camshaft 3*b* when the internal combustion engine is restarted.

Lock mechanism 5, as a locking means, includes lock piston 51 which is mounted inside the first vane 41 for moving in the longitudinal direction, in order to lock relative rotation between housing HSG and vane rotor 4, or release the locking state. Lock piston 51 mechanically engages with lock hole 521, when vane rotor 4 is rotated by the alternating torque and/or the biasing force of biasing member 6 to the predetermined initial position. This eliminates the necessity of provision of an actuator for actuating the locking operation. This is also effective for simplifying the mechanism, and reducing the manufacturing cost, and enhancing the reliability of the locking operation, as compared to cases where the locking means is implemented by a clutch mechanism or lever mechanism.

<Effects Produced by Positioning Means> The following describes operation of the positioning means including the positioning pin 905, etc. First, the following briefly describes a process of assembling the intake valve timing control apparatus 1*a* and exhaust valve timing control apparatus 1*b*.

First, rear plate 9 is inserted and mounted in sealing recess 101 of housing body 10. This is implemented by: mounting the sleeve 52 in recess 900 of rear plate 9; setting the rear plate 9 so that the X-axis positive side surface of rear plate 9 is directed upwardly in the vertical direction; mounting the sealing ring 51 in groove 906, and sealing rings S2 in annular grooves 907, 908 and 909 in rear plate 9; and assembling the housing body 10 from the X-axis positive side (from above in the vertical direction) to rear plate 9 so that the rear plate 9 is fitted in sealing recess 101.

In assembling the housing body 10 to rear plate 9, the rotational position of housing body 10 with respect to rear plate 9 is adjusted so that the positioning recess 114 of housing body 10 faces or conforms to positioning pin 905 of rear plate 9. Then, positioning pin 905 is inserted into and engaged with positioning recess 114. In this way, the position of housing body 10 with respect to rear plate 9 in the circumferential direction is set suitably. Under this condition, the bolt holes of female thread portions 901, 902 and 903 of rear plate 9 face or conform to bolt holes 110, 120 and 130 of housing body 10, respectively, as viewed in the X-axis direction.

Next, vane rotor 4 is inserted and mounted in housing body 10. This is implemented by: inserting the lock piston 51 in sealing member 502 press-fitted in slide hole 501 of vane rotor 4; inserting the coil spring 53 into the inside of lock piston 51; and inserting the spring retainer 54 into slide hole 501. According to the positioning by positioning pin 905, the sleeve 52, which is fixed in lock hole 521 in rear plate 9, faces and conforms to lock piston 51 in slide hole 501, under the condition that first vane 41 of vane rotor 4 is in contact with first shoe 11 of housing body 10.

Then, front plate 8 is brought from the X-axis positive side (from above in the vertical direction) into contact with housing body 10, and bolts b1, b2 and b3 are used to fix the front plate 8, housing body 10, and rear plate 9 together. Front plate 8 is mounted to housing body 10 under the condition sealing ring S3 is mounted in annular groove 89 of front plate 8.

In this way, positioning pin 905 in pin hole 904 and positioning recess 114 serve as a positioning means for adjusting and defining the rotational position of rear plate 9 with respect to housing body 10 by adjusting relative circumferential position between lock piston 51 and lock hole 521 during assembling operation of intake valve timing control apparatus 1*a* or exhaust valve timing control apparatus 1*b*. The radial positions of lock piston 51 and lock hole 521 are set substantially identical, when rear plate 9 is fitted in sealing recess 101 of housing body 10. In this way, lock piston 51 and sleeve 52 are correctly positioned, so that the lock piston 51 can smoothly engage with sleeve 52.

The construction that the positioning pin 905 is located adjacent to recess 900 (lock hole 521) is effective for correctly positioning the lock piston 51 and lock hole 521. The construction that the pin hole 904 is located on the side of grooves 906 and 907 where first retard chamber R1 is located, is effective for preventing the sealing performance of the sealing rings S1 and S2 from being adversely affected.

Vane rotor 4 is supported in support hole 92 which is formed in the center of rear plate 9 and through which intake camshaft 3*a* passes, and fixed to the end portion 30 of intake camshaft 3*a*. Accordingly, under the influence of a force applied from timing belt 1010 which is wound around pulley 100 of housing HSG, housing HSG may be inclined within a slight angle range with respect to the axis of rotation of vane rotor 4 (i.e. the X-axis), and swing about bearing portion 91 of rear plate 9 in which support hole 92 is formed.

However, according to the present embodiment where rear plate 9 is formed with lock hole 521, the distance (moment arm) between lock hole 521 and bearing portion 91 as a fulcrum, is shorter than in the case where the lock hole is formed in front plate 8 alternatively. Accordingly, displacement of lock hole 521 due to swinging motion of housing HSG in a direction perpendicular to the X-axis, is smaller, so that deviation of lock piston 51 from lock hole 521 is smaller or suppressed. Moreover, the construction that the boss portion 401 of vane rotor 4 is inserted in support hole 92, is effective for suppressing the inclination and displacement of vane rotor 4 with respect to housing HSG within a predetermined range.

<Effects Produced by Biasing Member> In exhaust valve timing control apparatus 1*b*, the biasing member 6 includes coil springs 610, 620 and 630 which are mounted in first, second and third advance chambers A1, A2 and A3 respectively. As compared to cases where another biasing member such as a leaf spring is used, the use of coil springs is effective for easily adjusting the biasing force, and enhancing the mountability to first, second and third advance chambers A1, A2 and A3. The construction that a single coil spring is mounted in each of first, second and third advance chambers A1, A2 and A3, is effective for making the exhaust valve timing control apparatus 1*b* compact in the axial direction, as compared to cases where two coil springs are arranged in double layers in the X-axis direction in each of first, second and third advance chambers A1, A2 and A3.

In cases where double coil springs are mounted in each of first, second and third advance chambers A1, A2 and A3, it may be difficult to assemble the coil springs to first, second and third advance chambers A1, A2 and A3, unless the double coil springs are mounted to retaining portions to form a single spring unit. On the other hand, according to the present embodiment where a single coil spring is mounted in each of first, second and third advance chambers A1, A2 and A3, it is easy to mount the coil spring to from a spring unit. Moreover, it is also possible as an alternative to directly mount the coil spring in first, second and third advance chambers A1, A2 and A3 (recesses 418, 125, etc.), without mounting each of coil springs 610, 620 and 630 to retaining portions to form a spring unit.

First, second and third spring units 61, 62 and 63 (coil springs 610, 620 and 630) are mounted to recesses 418, 428 and 438 which are formed in the counterclockwise surfaces of first, second and third vanes 41, 42 and 43 respectively, and to recesses 115, 125 and 135 which are formed in the clockwise surfaces of first, second and third shoes 11, 12 and 13. This achieves normal operations of biasing member 6 and exhaust valve timing control apparatus 1*b*, with no special support member, because recesses 418, 428 and 438, and recesses 115, 125 and 135 restrict deviations of first, second and third spring units 61, 62 and 63. For example, retaining portions 611 and 612 may be omitted. However, the provision of retaining portions 611 and 612 according to the present embodiment is effective for more securely preventing deviations of first, second and third spring units 61, 62 and 63.

<Effects Produced by Stopper Mechanisms> As discussed above, under the condition that directional control valve 24 is inoperative, for example, when the internal combustion engine is stopped, vane rotor 4 is mechanically moved with respect to housing HSG back to the predetermined initial position. In intake valve timing control apparatus 1*a*, vane rotor 4 is rotated by the alternating torque, in the retard direction with respect to housing HSG, and relative rotation of vane rotor 4 is restricted by the first stopper mechanism. In exhaust valve timing control apparatus 1*b*, vane rotor 4 is rotated by the biasing force of biasing member 6 against the alternating torque, in the advance direction with respect to housing HSG, and relative rotation of vane rotor 4 is restricted by the first stopper mechanism. In this way, contact between the first stopper portions of the first stopper mechanism is frequently repeated, when vane rotor 4 is in the initial position where vane rotor 4 is locked by lock mechanism 5.

When normal control is performed with directional control valve 24, hard contact in the first stopper mechanism is rare, because rotation of vane rotor 4 with respect to housing HSG is controlled by controller CU. However, when directional control valve 24 is inoperative so that no hydraulic pressure is applied, for example, when the internal combustion engine is stopped, hard contact may occur in the first stopper mechanism, because movement of vane rotor 4 with respect to housing HSG cannot be controlled by controller CU. Accordingly, the first stopper mechanism may deform due to frequency and hardness of contact in the first stopper mechanism, so that the limit of rotation of vane rotor 4, i.e. the initial position of vane rotor 4 may change or deviate.

According to the present embodiment, in intake valve timing control apparatus 1*a* and exhaust valve timing control apparatus 1*b*, the contact area of the first stopper SS1 is set larger than the contact area of the second stopper SS2 (SS1>SS2). Accordingly, the contact pressure resulting from contact in the first stopper mechanism which is generated when vane rotor 4 is rotated with respect to housing HSG in the direction toward the initial position, is smaller than the contact pressure resulting from contact in the second stopper mechanism which is generated when vane rotor 4 is rotated with respect to housing HSG in the opposite direction.

Accordingly, even when directional control valve 24 is not under control, the first stopper mechanism is prevented from causing a had contact when vane rotor 4 is in the initial position where lock mechanism 5 functions. This prevents the first stopper mechanism from deforming or deviating the position within which rotation of vane rotor 4 is restricted. Incidentally, the first stopper mechanism according to the present embodiment is advantageous for increasing the contact area SS1, because the first stopper mechanism is composed of the circumferentially-facing surfaces of first vane 41 and first shoe 11, i.e. flat portion 415 of first vane 41 and flat portion 111 of first shoe 11.

According to the present embodiment, the first stopper mechanism is constituted by the circumferentially-facing surface of first vane 41, where first vane 41 is provided with lock mechanism 5. Accordingly, the root of first vane 41 has a longer circumferential length, which is advantageous because first vane 41 has a high rigidity, and has a strength enough to restrict and receive relative rotation of vane rotor 4.

In general, it is difficult to provide such a stopper mechanism with an enough contact area, when the stopper mechanism and a biasing member are arranged in a hydraulic chamber. On the other hand, a stopper mechanism for restricting the motion of a vane rotor in the direction in which the biasing member biases the vane rotor, is subject to a large contact force. This is significant, when a housing body and the vane rotor are formed of a soft material such as an aluminum alloy. On the other hand, in exhaust valve timing control apparatus 1*b* according to the present embodiment, the contact area of the first stopper mechanism SS1, where the first stopper mechanism is provided in first retard chamber R1 for restricting the motion of vane rotor 4 in the direction in which biasing member 6 biases vane rotor 4, is set larger than the contact area of the second stopper mechanism SS2, where the second stopper mechanism is provided in first advance chamber A1 in which first spring unit 61 of biasing member 6 is mounted (SS1>SS2). This construction solves the problem described above, while avoiding interference between the second stopper mechanism and the biasing member 6.

Incidentally, although the contact area of the second stopper mechanism SS2 is small, the contact force and contact pressure are small, because the second stopper mechanism is to restrict motion of vane rotor 4 in the direction opposite to the direction in which biasing member 6 biases vane rotor 4, so that the second stopper mechanism is subject to only the hydraulic force of the retard chamber, and further subject to a negative force resulting from the biasing force of biasing member 6. In intake valve timing control apparatus 1*a* and exhaust valve timing control apparatus 1*b*, the frequency of contact in the second stopper mechanism is low, because relative rotation of vane rotor 4 with respect to housing HSG is actually restricted only when the controlled hydraulic pressure overshoots under control of directional control valve 24. In summary, the small contact area is sufficient for the second stopper mechanism, to prevent the second stopper mechanism from deforming or changing the position within which vane rotor 4 is restricted.

The root (the inside portion in the radial direction) of each of first, second and third vanes 41, 42 and 43 is less rigid than the tip (the outside portion in the radial direction), because each of first, second and third vanes 41, 42 and 43 has a substantially trapezoidal shape whose circumferential length spreads when followed outwardly in the radial direction. Stopper portion 419 of the second stopper mechanism is formed at the root of first vane 41, extending outwardly in the radial direction from rotor 40. As compared to cases where the second stopper mechanism is constituted by the tip of first vane 41, the bending moment or moment arm about the root of first vane 41 in the circumferential direction when the second stopper mechanism functions to restrict rotation of vane rotor 4, is smaller so that the root of first vane 41 is generally subject to no excessive force. This is advantageous for enhancing the durability of first vane 41, because the second stopper mechanism is formed continuous with first vane 41.

In exhaust valve timing control apparatus 1*b*, the second stopper mechanism also serves to limit the amount of displacement (amount of compression) of biasing member 6 (coil springs 610, 620 and 630) to a predetermined amount. This prevents plastic deformation of biasing member 6 (coil springs 610, 620 and 630), and prevents the biasing force of biasing member 6 from changing in an irreversible form.

Stopper portion 429 of second vane 42 and the tip of third shoe 13 serve as a backup stopper mechanism instead of the second stopper mechanism, even when errors occur during manufacturing and assembling operations, or when the stopper portions of the second stopper mechanism are worn. This improves the reliability and accuracy of intake valve timing control apparatus 1*a* and exhaust valve timing control apparatus 1*b*. Especially in exhaust valve timing control apparatus 1*b*, this is effective for securely preventing the biasing member 6 from plastically deforming.

Coil springs 610 and 630 are arranged outside of stopper portions 419 and 429 of first and second vanes 41 and 42, respectively, so that stopper portions 419 and 429, which constitute the second stopper mechanism and backup stopper mechanism respectively, guide the coil springs 610 and 630 of biasing member 6. When vane rotor 4 relatively rotates to compress coil springs 610 and 630, coil springs 610 and 630 are prevented from deforming by a predetermined amount or larger inwardly in the radial direction of vane rotor 4. This ensures suitable elastic deformation of coil springs 610 and 630, while preventing plastic deformation of coil springs 610 and 630. In this way, normal operations of biasing member 6 and exhaust valve timing control apparatus 1*b* are ensured.

<Effects Produced by Mirror Image Arrangement> In the present embodiment, the components of intake valve timing control apparatus 1*a* have basic structures similar to those of exhaust valve timing control apparatus 1*b*, except that the direction in which vane rotor 4 shifts the rotational phase of intake camshaft 3*a* in response to energization or de-energization of directional control valve 24 is opposite to the direction in which vane rotor 4 shifts the rotational phase of exhaust camshaft 3*b* in response to energization or de-energization of directional control valve 24. Accordingly, intake valve timing control apparatus 1*a* and exhaust valve timing control apparatus 1*b* are constituted by the common third workpiece P3 for housing body 10, and the common second workpiece Q2 for vane rotor 4. Housing body 10 and vane rotor 4 of intake valve timing control apparatus 1*a*, and housing body 10 and vane rotor 4 of exhaust valve timing control apparatus 1*b*, are formed as mirror images of each other, by applying cutting processes to respective ones of the opposite surfaces (side A, or side B) of the common extrusions (P3, Q2). This is advantageous for simplifying the process of manufacturing, and thereby reducing the manufacturing cost.

In a typical valve timing control apparatus, a housing member and a vane rotor are provided with an advance-side stopper and a retard-side stopper for restricting relative rotation between the housing member and the vane rotor. For example, the stoppers are implemented by contact between the housing member and the vane rotor. However, in case an exhaust valve timing control apparatus is provided with a biasing member which is mounted in a retard chamber, and arranged to return the vane rotor to an initial position, a possible contact area in the retard chamber between the housing member and the vane rotor is limited, and smaller than a contact area in an advance chamber between the housing member and the vane rotor. Accordingly, it is generally difficult to set the contact area (contact pressure) of the stopper for restricting the relative rotation in one direction and the area (contact pressure) of the stopper for restricting the relative rotation in the other direction to be equal to each other, because of various design requirements for the exhaust valve timing control apparatus. This may result in that the shape of the housing member or vane rotor of the exhaust valve timing control apparatus may be asymmetrical, i.e. the shape of the clockwise side of the housing member or vane rotor may be different from the shape of the counterclockwise side.

On the other hand, the direction of operation of the intake valve timing control apparatus (the direction of relative rotation in which the rotational phase of the vane rotor is shifted with respect to the housing member) is opposite to that of the exhaust valve timing control apparatus, and the direction of relative rotation in which the vane rotor is returned with respect to the housing member to the initial position. Namely, the direction of relative rotation under no hydraulic pressure in the intake valve timing control apparatus is opposite to that in the exhaust valve timing control apparatus.

In consideration of the foregoing, simple use of the components of the exhaust valve timing control apparatus for the intake valve timing control apparatus, may adversely affect the durability of the stoppers. For example, if the vane rotor 4 and housing body 10 of exhaust valve timing control apparatus 1*b* according to the present embodiment was simply used for intake valve timing control apparatus 1*a*, i.e. if the components of exhaust valve timing control apparatus 1*b* shown in FIG. 16 except the biasing member 6 (first, second and third spring units 61, 62 and 63) are simply used for intake valve timing control apparatus 1*a*, the second stopper mechanism defines an initial position where lock mechanism 5 locks movement of vane rotor 4. This may cause deformation of the second stopper mechanism, and change of the position within which rotation of vane rotor 4 is restricted, because the second stopper mechanism has a smaller contact area.

On the other hand, according to the present embodiment, the vane rotor 4 and housing body 10 of exhaust valve timing control apparatus 1*b* are transformed into mirror images, and the stoppers are arranged in mirror positions, to constitute the intake valve timing control apparatus 1*a*. Accordingly, in each of intake valve timing control apparatus 1*a* and exhaust valve timing control apparatus 1*b*, the first stopper mechanism functions at the initial position, where the first stopper mechanism has a larger contact area, as shown in FIGS. 4 and 16. In other words, commonality and compatibility of components and workpieces for vane rotor 4, housing body 10, etc., are provided between intake valve timing control apparatus 1*a* and exhaust valve timing control apparatus 1*b*. The mirror arrangement is effective for preventing the stopper mechanisms from deforming and changing the rotation limit position.

<Effects Produced by Extrusion of Aluminum> The construction that the housing body 10 and vane rotor 4 are formed of aluminum-based metal materials, is effective for reducing the weight of each of intake valve timing control apparatus 1*a* and exhaust valve timing control apparatus 1*b*. The feature that the housing body 10 is formed by extrusion is effective for preventing working fluid from seeping from the inside of housing HSG to pulley 100, and thereby preventing degradation of timing belt 1010 which is made of rubber. For example, if die-casting such as high-pressure die-casting is used for forming the housing body 10, it is impossible to eliminate a tapered shape which is provided so that a formed material can be drawn from a mold. If the outside periphery of housing body 10 has a tapered shape, when housing body 10 is formed integrally with pulley 100, it is difficult to form the teeth of pulley 100 with high accuracy. On the other hand, according to the present embodiment, housing body 10 is formed by extrusion, and formed with no tapered shape, so that it is possible to form the pulley 100 with pulley 100, etc. with high accuracy.

In the case of housing body 10, the anodizing process is applied to the entire outside peripheral surface and inside peripheral surface of first workpiece P1 which is extruded from an aluminum material. Specifically, the anodizing process hardens the outside peripheral surface of housing body 10, which timing belt 1010 is wounded around, and a driving torque is applied to, and hardens the inside peripheral surface of housing body 10, which is in sliding contact with first, second and third vanes 41, 42 and 43. This is advantageous for reducing the cost of manufacturing the housing body 10, as compared to cases where the anodizing process is applied to each of the plurality of second workpieces P2 which are formed by cutting the first workpiece P1. Although the axial end surfaces of first workpiece P1, and the axial end surfaces of second workpieces P2, are not treated with the anodizing process, there is no problem, because the axial surfaces are contacted and fixed to front plate 8 and rear plate 9, not in sliding contact.

In the case of vane rotor 4, the anodizing process is applied to the entire outside surfaces of the third workpiece Q3 which is a final basic article. Specifically, outside peripheral surfaces 411, 421 and 431 of first, second and third vanes 41, 42 and 43, which are in sliding contact with the inside peripheral surface of housing body 10, and the axial end surfaces of vane rotor 4, which are in sliding contact with front plate 8 and rear plate 9, are treated and hardened. Incidentally, although housing body 10 is formed of a relatively soft aluminum-based metal in order to achieve a high accuracy of the teeth of pulley 100, vane rotor 4 may be formed of a relatively hard aluminum-based metal, because vane rotor 4 is not subject to such a requirement.

In the case of housing body 10, a plurality of base workpieces (third workpiece P3) are formed simultaneously by obtaining a long continuous member (first workpiece P1, second workpiece P2), and cutting it. This is true also in the case of vane rotor 4. In this way, many base workpieces (third workpiece P3, second workpiece Q2) are obtained by a few steps, and commonly used to construct the intake valve timing control apparatus 1*a* and exhaust valve timing control apparatus 1*b*. This is effective for further simplifying the process of manufacturing, and thereby reducing the manufacturing cost.

<Effects Produced by Pulley> In the present embodiment, the construction that the outside periphery of the housing member (housing body 10) is formed integrally with pulley 100, is effective for reducing the radius of intake valve timing control apparatus 1*a* and exhaust valve timing control apparatus 1*b*. The construction that the pulley 100 is formed over the entire axial length of the outside periphery of housing body 10, is effective for providing the teeth of pulley 100 with a width enough to engage with timing belt 1010, even if the width of timing belt 1010 is required to be above a predetermined lower limit. Namely, even when the axial length of housing HSG is set as small as the width of timing belt 1010 where rear plate 9 is fixedly inserted in sealing recess 101 of housing body 10, it is possible to provide the teeth of pulley 100 with a width enough to engage with timing belt 1010 and transmit a torque to timing belt 1010.

In intake valve timing control apparatus 1*a*, the diameter of front plate 8 is set slightly larger than that of pulley 100. Specifically, outside periphery 80 is formed to project from pulley 100 outwardly in the radial direction as viewed in the X-axis direction. Timing belt 1010, which is wound around the pulley 100, cannot move in the X-axis positive direction, because movement of timing belt 1010 is restricted by outside periphery 80. In this way, outside periphery 80 serves as a belt guide portion to prevent timing belt 1010 from deviating in the X-axis positive direction. On the other hand, timing belt 1010 is prevented by the cylinder block from deviating in the X-axis negative direction, and dropping from pulley 100.

On the other hand, in exhaust valve timing control apparatus 1*b*, the diameter of front plate 8 is set slightly smaller than that of pulley 100. Specifically, the diameter of exhaust valve timing control apparatus 1*b* is smaller than that of intake valve timing control apparatus 1*a* with outside periphery 80, as shown in FIG. 1. Accordingly, the lateral size of the internal combustion engine provided with intake valve timing control apparatus 1*a* and exhaust valve timing control apparatus 1*b* can be minimized as a whole. This is effective for enhancing the flexibility of engine room layout. Incidentally, the construction that the exhaust valve timing control apparatus 1*b* is provided with no belt guide portion, causes no problem, because timing belt 1010 is prevented by outside periphery 80 of intake valve timing control apparatus 1*a* from deviating in the X-axis positive direction, as discussed above.

<Effects Produced by Sealing Recess> In intake valve timing control apparatus 1*a* and exhaust valve timing control apparatus 1*b*, the axial ends of housing body 10 are closed and sealed by front plate 8 and rear plate 9 respectively, where housing body 10 is formed integrally with pulley 100 so that the diameter of housing body 10 is minimized. The construction that the rear plate 9 is fixedly inserted in sealing recess 101 of housing body 10, is effective for reducing the axial size of intake valve timing control apparatus 1*a* and exhaust valve timing control apparatus 1*b*, as compared to cases where front plate 8 and rear plate 9 are simply fixed to the axial end surfaces of housing body 10. The construction that the entire axial length of the outside periphery of rear plate 9 in the X-axis direction, i.e. the entire axial length of plate body 90 in the X-axis direction, is fixedly inserted in sealing recess 101, is further effective for minimizing the axial size of intake valve timing control apparatus 1*a* and exhaust valve timing control apparatus 1*b*.

Rear plate 9 is formed with lock hole 521 (or recess 900 for fixing the sleeve 52) which extends in the X-axis direction, where lock hole 521 engages with lock piston 51 which is mounted to move in and out from vane rotor 4 in the X-axis direction. Accordingly, the axial length of rear plate 9 is set larger than that of front plate 8. If the thicker rear plate 9 is simply fixed to the axial end surface of housing body 10, the axial length of the entire intake valve timing control apparatus 1*a* and exhaust valve timing control apparatus 1*b*. According to the present embodiment, the construction that the sealing recess 101 is formed in one axial end of housing body 10, and rear plate 9 (not front plate 8) is fixedly inserted in sealing recess 101, is effective for efficiently reducing the axial size of intake valve timing control apparatus 1*a* and exhaust valve timing control apparatus 1*b*. This enhances the flexibility of layout of an engine room to which intake valve timing control apparatus 1*a* and exhaust valve timing control apparatus 1*b* are mounted.

Front plate 8, rear plate 9 and housing body 10 are fixed by the plurality of bolts b1, b2 and b3. The male thread of each of bolts b1, b2 and b3 may be screwed into a female thread hole which is formed in rear plate 9 or front plate 8. The female thread hole has a some length, so that one of rear plate 9 and front plate 8 in which the female thread is formed is set thicker than the other. If the thicker plate is simply fixed to the axial end surface of housing body 10, the entire axial size of intake valve timing control apparatus 1*a* and exhaust valve timing control apparatus 1*b* becomes large. According to the present embodiment, the construction that both of lock hole 521 and the female thread holes are formed in rear plate 9, is further effective for minimizing the axial size of intake valve timing control apparatus 1*a* and exhaust valve timing control apparatus 1*b*.

On the other hand, front plate 8 may be formed thinner than rear plate 9, because front plate 8 is formed with no female thread hole, etc. Accordingly, even when front plate 8 is simply fixed to the axial end surface of housing body 10, the axial length of intake valve timing control apparatus 1*a* and exhaust valve timing control apparatus 1*b* is little increased. On the other hand, the female thread holes are formed in rear plate 9 which is formed thicker because rear plate 9 is formed with lock hole 521, and the thicker rear plate 9 is fixedly inserted in sealing recess 101. In other words, lock hole 521 is formed in rear plate 9 which is formed thicker because rear plate 9 is formed with the female thread holes, and the thicker rear plate 9 is fixedly inserted in sealing recess 101. This is effective for minimizing the axial size of intake valve timing control apparatus 1*a* and exhaust valve timing control apparatus 1*b*.

Housing body 10 may be formed with another sealing recess to which front plate 8 is fixedly inserted. However, front plate 8 is simply fixed to the axial side surface of housing body 10, in order to provide lock piston 51 with a required range of movement in the axial direction or provide slide hole 501 of vane rotor 4 with a required length in the X-axis direction.

<Effects Produced by Sealing Members> As described above, the construction that the sealing recess 101 is formed in the axial end of housing body 10, and rear plate 9 is fixedly inserted in sealing recess 101, is effective for reducing the axial length of intake valve timing control apparatus 1*a* and exhaust valve timing control apparatus lb. In intake valve timing control apparatus 1*a* and exhaust valve timing control apparatus 1*b* where rotation of the crankshaft is transmitted through the timing belt 1010, when working fluid adheres to pulley 100 around which timing belt 1010 is wounded, working fluid may damage the timing belt 1010. Accordingly, in order to prevent working fluid from leaking out of housing HSG, the boundary between sealing recess 101 and rear plate 9 is sealed.

However, it is generally difficult to provide a space for a sealing member, in cases where the boundary between the axial end surfaces of housing body 10 and rear plate 9 is sealed, i.e. the boundary between the bottom surface 102 of sealing recess 101 and the X-axis negative side surface of rear plate 9 is sealed. Specifically, as shown in FIG. 6C, the radial length of bottom surface 102 of sealing recess 101 except the portions where first, second and third shoes 11, 12 and 13 are formed, (R−Ri), is short to form a sealing groove where a sealing member is mounted. Accordingly, when the boundary (bottom surface 102 of sealing recess 101) where the axial end surfaces are in contact with each other is provided with an adequate space where a sealing member is mounted or a sealing groove is formed, the diameter of housing body 10 in the radial direction is increased.

On the other hand, the length of sealing recess 101 in the X-axis direction and the length of rear plate 9 in the X-axis direction are large so that a sealing member can be mounted or a sealing groove can be formed. However, the radial length (Ro−R) of housing body 10 is small to form a sealing groove in the inside peripheral surface of housing body 10 (inside peripheral surface 103 of sealing recess 101). Accordingly, if the sealing groove is formed in the inside peripheral surface of housing body 10 (inside peripheral surface 103 of sealing recess 101), the radial size of housing body 10 must be increased so as to increase the radial length (Ro−R).

On the other hand, according to the present embodiment, the radial length (Ro−R), i.e. the radial thickness of housing body 10 is set small. Instead of the inside peripheral surface of housing body 10, the outside periphery of rear plate 9 is formed with groove 906 to which sealing ring S1 is mounted, so as to seal the boundary between sealing recess 101 and rear plate 9. This sealing structure is effective for preventing working fluid from leaking from housing HSG, while minimizing increase in the axial size of intake valve timing control apparatus 1*a* and exhaust valve timing control apparatus 1*b*, where the provision of sealing recess 101 minimizes the axial size of intake valve timing control apparatus 1*a* and exhaust valve timing control apparatus 1*b*.

On the other hand, the X-axis negative side surfaces of first, second and third shoes 11, 12 and 13 have adequate spaces where sealing members are mounted around bolt holes 110, 120 and 130. Accordingly, rear plate 9 is formed with annular grooves 907, 908 and 909 around female thread portions 901, 902 and 903, where annular grooves 907, 908 and 909 faces bolt holes 110, 120 and 130, and sealing rings S2 are mounted in annular grooves 907, 908 and 909 for preventing working fluid from leaking from the inside of housing HSG through the bolt holes of female thread portions 901, 902 and 903.

It is possible as an alternative to prevent working fluid from leaking through the bolt holes of female thread portions 901, 902 and 903 by a construction that the bolt holes of female thread portions 901, 902 and 903 are formed with bottoms, without passing through the rear plate 9. In this case, however, the provision of the bottoms may cause an increase in the axial length of rear plate 9, because the lengths of female thread portions 901, 902 and 903 are increased to maintain the axial lengths of the female threads for bolts b1, b2 and b3. In contrast, according to the present embodiment, the construction that the bolt holes of female thread portions 901, 902 and 903 are formed to extend through the rear plate 9 with no bottoms, is effective for reducing the axial length of rear plate 9.

Incidentally, the construction that the recess 900 of rear plate 9 and pin hole 904 have bottoms, causes no increase in the axial length of rear plate 9, because the length of recess 900 in the X-axis direction is only required to allow engagement of lock piston 51, and the length of pin hole 904 in the X-axis direction is only required to allow fixation of the positioning pin 905. This feature is effective for preventing working fluid from leaking from housing HSG to outside without sealing for recess 900 and pin hole 904.

The inside peripheries of female thread portions 901, 902 and 903 of rear plate 9 are formed with the female threads where bolts b1, b2 and b3 are screwed. Under the condition that the bolts b1, b2 and b3 are screwed in the female threads, the sealing rings S2, which are mounted around female thread portions 901, 902 and 903, are compressed. The elastic forces of sealing rings S2 in the direction to expand the sealing rings S2, serve to tighten the engagement of bolts b1, b2 and b3 with the female threads, and to prevent release of the engaged bolts b1, b2 and b3.

On the other hand, the boundary between front plate 8 and housing body 10 includes a space having an adequate radial size where a sealing member can be mounted, because the X-axis positive side surface of housing body 10 is formed with no sealing recess. Specifically, as shown in FIG. 6A, the radial length Ro−Ri of housing body 10 is large enough to mount a sealing member or form a sealing groove.

Accordingly, sealing ring S3 is arranged between the contact axial end surfaces of housing body 10 and front plate 8, i.e. between the X-axis negative side surface of housing body 10 and the X-axis positive side surface of front plate 8. Sealing ring S3 and annular groove 89 are have the form of a three-leaved clover, passing inside of bolt holes 83, 84 and 85, so that the bolt holes 83, 84 and 85 are hydraulically separated from the inside of housing HSG. This is effective for reducing the number of parts, and improving the facility of assembling, because no individual sealing members are required for bolt holes 83, 84 and 85.

Under the condition that the bolts b1, b2 and b3 are screwed in the female threads of female thread portions 901, 902 and 903, sealing ring S3 which is mounted around bolt holes 83, 84 and 85 are compressed. The elastic force of sealing ring S3 in the direction to expand the sealing ring S3 serves to tighten the engagement of bolts b1, b2 and b3 with the female threads, and to prevent release of the engaged bolts b1, b2 and b3.

The construction that each of sealing rings S1, S2 and S3 is an O-ring having a circular cross section, is effective for easily mounting the sealing members in grooves 906, etc. The same is true for sealing ring S4. The construction that the O-rings are compressed under the condition that the front plate 8, rear plate 9 and housing body 10 are fixed together by bolts b1, b2 and b3 to constitute the housing HSG, is effective for enhancing the function of sealing the housing HSG.

<<Advantageous Effects Produced by Features of Present Embodiment>> The following describes features of valve timing control apparatus 1 (intake valve timing control apparatus 1*a*, exhaust valve timing control apparatus 1*b*) according to the present embodiment, and advantageous effects produced by the features.

<Main Technical Features> The following describes a main group of technical features, and advantageous effects produced by the features.

<1> A valve timing control apparatus (1) for an internal combustion engine, comprises: a housing body (10) having a hollow cylindrical shape having at least an open axial end, wherein the housing body (10) is formed with a plurality of shoes (11, 12, 13) at an inside periphery of the housing body (10), wherein each of the shoes (11, 12, 13) projects inwardly in a radial direction of the housing body (10), and is formed with a first bolt hole (110, 120, 130), wherein the first bolt holes (110, 120, 130) extend through the housing body (10) in an axial direction of the housing body (10), and wherein the housing body (10) is formed with a sealing recess (101) at the open axial end of the housing body (10); a vane rotor (4) rotatably mounted in the housing body (10), wherein the vane rotor (4) includes a vane (41, 42, 43), wherein the vane (41, 42, 43) and the shoes (11, 12, 13) define an advance chamber (A1, A2, A3) and a retard chamber (R1, R2, R3) between the vane rotor (4) and housing body (10), and wherein the advance chamber (A1, A2, A3) and the retard chamber (R1, R2, R3) are adapted to supply and drainage of fluid; a first plate (rear plate 9) fixedly inserted in the sealing recess (101) of the housing body (10), the first plate (rear plate 9) sealing an axial end opening of the advance chamber (A1, A2, A3) and an axial end opening of the retard chamber (R1, R2, R3), wherein the first plate (rear plate 9) is formed with second bolt holes (901, 902, 903) whose positions are conformed to positions of the first bolt holes (110, 120, 130) of the housing body (10) respectively, and wherein the second bolt holes (of female thread portions 901, 902 and 903) extend through the first plate (rear plate 9); a plurality of bolts (b1, b2, b3) that are inserted through respective ones of the first bolt holes (110, 120, 130) of the housing body (10) and respective ones of the second bolt holes (of female thread portions 901, 902 and 903) of the first plate (rear plate 9), for fixing the first plate (rear plate 9) to the housing body (10); and a pulley (100) adapted to winding of a belt (timing belt 1010), and arranged to rotate with the housing body (10); wherein a boundary between an inside periphery of the sealing recess (101) and an outside periphery of the first plate (rear plate 9) is sealed; and wherein a boundary between an axial end surface of one of the shoes (11, 12, 13) and an annular portion (annular groove 907) of the first plate (rear plate 9) is sealed, wherein the annular portion (annular groove 907) extends circumferentially around one of the second bolt holes (of female thread portions 901, 902 and 903). The feature that the second bolt holes (of female thread portions 901, 902 and 903) are formed to extend through the first plate (rear plate 9) is effective for reducing the axial size of the first plate (rear plate 9), whereas the feature that the first plate (rear plate 9) fixedly inserted in the sealing recess (101) of the housing body (10) is effective for reducing the axial size of the valve timing control apparatus (1). The feature that the boundary between the axial end surface of one of the shoes (11, 12, 13) and the annular portion (annular groove 907) of the first plate (rear plate 9) is sealed, wherein the annular portion (annular groove 907) extends circumferentially around one of the second bolt holes (of female thread portions 901, 902 and 903), is effective for preventing working fluid from leaking from the inside of the housing body (10) through the second bolt holes (of female thread portions 901, 902 and 903). The feature that the boundary between the inside periphery of the sealing recess (101) and the outside periphery of the first plate (rear plate 9) is sealed, is effective for preventing working fluid from leaking from the inside of the housing body (10) through the sealing recess (101). This is effective for preventing working fluid from flowing through the housing HSG to pulley 100, and thereby preventing degradation of timing belt 1010, while reducing the axial size of the valve timing control apparatus (1), and thereby enhancing the flexibility of layout of the engine room where the valve timing control apparatus (1) is mounted.

<2> The feature <1> is implemented by an annular first sealing ring (S1) arranged between an inside periphery of the sealing recess (101) and an outside periphery of the first plate (rear plate 9); and an annular second sealing ring (S2) arranged between the first plate (rear plate 9) and an axial end surface of one of the shoes (11, 12, 13), wherein the second sealing ring (S2) extends circumferentially around one of the second bolt holes (of female thread portions 901, 902 and 903). In addition to the advantageous effects according to the feature <1>, the provision of the annular first sealing ring (S1) arranged between the inside periphery of the sealing recess (101) and the outside periphery of the first plate (rear plate 9), is effective for reducing the radial size (R×2) of the sealing recess (101), because it is unnecessary to provide a sealing member between the contact axial end surfaces of the housing body (10) and the first plate (rear plate 9), i.e. between the bottom surface 102 of sealing recess 101 and the X-axis positive side end surface of the first plate (rear plate 9).

Namely, it is unnecessary to increase the radial size of the housing body (10), i.e. it is possible to reduce the radius Ro. This is effective for reducing the radial size of the valve timing control apparatus (1), and thereby enhancing the flexibility of layout of the engine room where the valve timing control apparatus (1) is mounted.

<3> The first sealing ring (S1) is inserted in a groove (906) formed in the outside periphery of the first plate (rear plate 9). In addition to the advantageous effect according to the feature <2>, this feature is effective for reducing the radial distance between the inside periphery and the outside periphery of the housing body (10) at the sealing recess (101) (Ro−R), and thereby reducing the radial thickness of the housing body (10). This is effective for further reducing the radial size of the valve timing control apparatus (1).

<4> In addition to the feature <2>, the second sealing ring (S2) is inserted in a groove (907, 908, 909) formed in the first plate (rear plate 9), wherein the groove (907, 908, 909) extends circumferentially around one of the second bolt holes (of the female thread portions 901, 902 and 903). This feature is effective for easily mounting the first plate (rear plate 9) to the housing body (10) while preventing the second sealing ring (S2) from dropping, which is implemented, for example, by directing the X-axis positive side surface of the first plate (rear plate 9) upward in the vertical direction, inserting the second sealing ring (S2) into the groove (907, 908, 909) of the first plate (rear plate 9), and mounting the first plate (rear plate 9) to the housing body (10).

<5> In addition to the feature <2>, an inside periphery of each of the second bolt holes (901, 902, 903) is formed with a female thread so that the bolts (b1, b2, b3) are screwed in the second bolt holes (901, 902, 903). In addition to the advantageous effects according to the feature <2>, the feature <5> is effective for preventing the bolts (b1, b2, b3) from being released, because the engagement between the bolts (b1, b2, b3) and the second bolt holes (901, 902, 903) are strengthened by the elastic force of the second sealing ring (S2) in the axial direction of the housing HSG, under the condition that the bolts (b1, b2, b3) are screwed in the second bolt holes (901, 902, 903).

<6> In addition to the feature <2>, the first sealing ring (S1) is an O-ring having a circular cross section, and wherein the second sealing ring (S2) is an O-ring having a circular cross section. This feature is effective for the mountability of the first sealing ring (S1) and the second sealing ring (S2) into the groove 906 and annular groove (907, 908 and 909). The feature is also effective for enhancing the level of sealing by compression of the second sealing ring (S2) in the form of the O-ring when the housing body 10 and the first plate (rear plate 9) are fixed together by the bolts b1, b2 and b3.

<7> The valve timing control apparatus (1) further comprises a second plate (front plate 8) sealing another axial end opening of the advance chamber (A1, A2, A3) and another axial end opening of the retard chamber (R1, R2, R3), wherein a boundary between surfaces of the second plate (front plate 8) and the housing body (10) which face each other. This feature is effective for preventing working fluid from leaking from the inside of the housing body (10) through the boundary between surfaces of the second plate (front plate 8) and the housing body (10) which face each other, and thereby preventing degradation of the timing belt (1010).

<8> Specifically, a valve timing control apparatus (1) for an internal combustion engine, comprises: a housing body (10) having a hollow cylindrical shape having first and second open axial ends, wherein the housing body (10) is formed with a plurality of shoes (11, 12, 13) at an inside periphery of the housing body (10), wherein each of the shoes (11, 12, 13) projects inwardly in a radial direction of the housing body (10), and is formed with a first bolt hole (bolt holes 110, 120 and 130), wherein the first bolt holes (bolt holes 110, 120 and 130) extend through the housing body (10) in an axial direction of the housing body (10), and wherein the housing body (10) is formed with a sealing recess (101) at the first open axial end of the housing body (10); a vane rotor (4) rotatably mounted in the housing body (10), wherein the vane rotor (4) includes a vane (41, 42, 43), wherein the vane (41, 42, 43) and the shoes (11, 12, 13) define an advance chamber (A1, A2, A3) and a retard chamber (R1, R2, R3) between the vane rotor (4) and housing body (10), and wherein the advance chamber (A1, A2, A3) and the retard chamber (R1, R2, R3) are adapted to supply and drainage of fluid; a first plate (rear plate 9) fixedly inserted in the sealing recess (101) of the housing body (10), the first plate (rear plate 9) sealing an axial end opening of the advance chamber (A1, A2, A3) and an axial end opening of the retard chamber (R1, R2, R3), wherein the first plate (rear plate 9) is formed with second bolt holes (of female thread portions 901, 902 and 903) whose positions are conformed to positions of the first bolt holes (bolt holes 110, 120 and 130) of the housing body (10) respectively, wherein the second bolt holes (of female thread portions 901, 902 and 903) extend through the first plate (rear plate 9), and wherein an inside periphery of each of the second bolt holes (of female thread portions 901, 902 and 903) is formed with a female thread; a second plate (front plate 8) sealing anther axial end of the advance chamber (A1, A2, A3) and another axial end of the retard chamber (R1, R2, R3), wherein the second plate (front plate 8) is formed with third bolt holes (bolt holes 83, 84 and 85) whose positions are conformed to the positions of the first bolt holes (bolt holes 110, 120 and 130) of the housing body (10) respectively; a plurality of bolts (b1, b2, b3) that are inserted through respective ones of the third bolt holes (bolt holes 83, 84 and 85) of the second plate (front plate 8) and respective ones of the first bolt holes (bolt holes 110, 120 and 130) of the housing body (10), and screwed in respective ones of the second bolt holes (of female thread portions 901, 902 and 903) of the first plate (rear plate 9), for fixing the first plate (rear plate 9) to the housing body (10); a pulley (100) adapted to winding of a belt (timing belt 1010), and arranged to rotate with the housing body (10); an annular first sealing ring (S1) arranged between an inside periphery of the sealing recess (101) and an outside periphery of the first plate (rear plate 9); an annular second sealing ring (S2) arranged between the first plate (9) and an axial end surface of one of the shoes (11, 12, 13), wherein the second sealing ring (S2) extends circumferentially around one of the second bolt holes (of female thread portions 901, 902 and 903); and an annular third sealing ring (S3) arranged between a portion of the second plate (front plate 8) and a portion of the housing body (10) which face each other, wherein the third sealing ring (S3) extends circumferentially inside of the first bolt holes (bolt holes 110, 120 and 130) of the housing body (10). In addition to the advantageous effects according to the feature <2> and <7>, the feature that the annular third sealing ring (S3) is arranged between a portion of the second plate (front plate 8) and a portion of the housing body (10) which face each other, wherein the third sealing ring (S3) extends circumferentially inside of the first bolt holes (bolt holes 110, 120 and 130) of the housing body (10), is effective for preventing working fluid from leaking from the inside of the housing body (10) through the third bolt holes (bolt holes 83, 84 and 85) of the second plate (front plate 8). This feature is also effective for reducing the number of parts wherein no individual sealing members are required for the third bolt holes (bolt holes 83, 84 and 85), and thereby enhancing the facility of assembling.

Moreover, the feature is effective for preventing the bolts (b1, b2, b3) from being released, because the engagement between the bolts (b1, b2, b3) and the second bolt holes (901, 902, 903) are strengthened by the elastic force of the second sealing ring (S2) in the axial direction of the housing HSG, under the condition that the bolts (b1, b2, b3) are screwed in the second bolt holes (901, 902, 903).

<9> In addition to the feature <8>, the third sealing ring (S3) is inserted in a groove (89) formed in the second plate (front plate 8). This feature is effective for easily mounting the second plate (front plate 8) to the housing body (10) while preventing the third sealing ring (S3) from dropping, which is implemented, for example, by directing the X-axis negative side surface of the second plate (front plate 8) upward in the vertical direction, inserting the third sealing ring (S3) into the groove (89) of the second plate (front plate 8), and mounting the second plate (front plate 8) to the housing body (10).

<10> The first plate (rear plate 9) is formed of an iron-based metal. When the inside periphery of each of the second bolt holes (of female thread portions 901, 902 and 903) is formed with a female thread into which a respective one of the bolts (b1, b2, b3), this feature is effective for providing the female threads of the second bolt holes (of female thread portions 901, 902 and 903) with adequate strengths.

<11> The first plate (rear plate 9) is formed by forging. This feature is effective for preventing working fluid from seeping and leaking from the inside of the housing (HSG) through the first plate (rear plate 9).

<12> The second plate (front plate 8) is formed by forging. This feature is effective for preventing working fluid from seeping and leaking from the inside of the housing (HSG) through the second plate (front plate 8).

<13> The housing body (10) is formed of an aluminum-based metal. This feature is effective for reducing the weight of the housing body (10).

<14> The housing body (10) is formed by extrusion. This feature is effective for preventing working fluid from seeping and leaking from the inside of the housing (HSG) through the housing body (10).

<15> The valve timing control apparatus (1) further comprises: an engagement member (lock piston 51) mounted in the vane rotor (4) for moving in an axial direction of the vane rotor (4) selectively out of and into the vane rotor (4) according to a state of operation of the internal combustion engine; an engagement recess portion (lock hole 521 of sleeve 52) arranged in the first plate (rear plate 9) to receive insertion of the engagement member (lock piston 51); a positioning pin (905) press-fitted in a recess (pin hole 904) formed in the first plate (rear plate 9), wherein the recess (pin hole 904) is located adjacent to the engagement recess portion (lock hole 521 of sleeve 52); and a positioning recess (114) formed in the housing body (10), where a position of the positioning recess (114) is conformed to a position of the positioning pin (905). This feature is effective for efficiently reducing the axial size of the valve timing control apparatus (1), because the first plate (rear plate 9) is fixedly inserted in the sealing recess (101) of the housing body (10), where the first plate (rear plate 9) is relatively thicker because of provision of the engagement recess portion (lock hole 521 of sleeve 52). The feature is effective for achieving smooth engagement of the engagement member (lock piston 51), because the engagement member (lock piston 51) is accurately positioned with respect to the engagement recess portion (lock hole 521 of sleeve 52) by the positioning means which is constituted by the positioning pin (905) and the positioning recess (positioning recess 114). The feature that the recess (pin hole 904) of the first plate (9) is located adjacent to the engagement recess portion (lock hole 521 of sleeve 52) is effective for further accurately positioning the engagement member (lock piston 51) with respect to the engagement recess portion (lock hole 521 of sleeve 52). The feature that the positioning pin (905) is press-fitted in the recess (pin hole 904) formed in the first plate (rear plate 9) is effective for more accurately fixing the positioning pin (905) to the first plate (rear plate 9), while preventing working fluid from leaking from the inside of the housing HSG through the recess (pin hole 904) with no sealing member.

<Other Technical Features (I)> The following describes a first group of technical features other than the main technical features, and advantageous effects produced by the features.

<2-1> A valve timing control apparatus (1; intake valve timing control apparatus 1*a*, or exhaust valve timing control apparatus 1*b*) for an internal combustion engine, comprises: a housing body (10) formed with a sealing recess (101) at an axial end of the housing body (10); a first plate (rear plate 9) fixedly inserted in the sealing recess (101) of the housing body (10), the first plate (rear plate 9) sealing the axial end of the housing body (10); and a second plate (front plate 8) sealing anther axial end of the housing body (10). This feature is effective for reducing the axial size of the valve timing control apparatus (1), and thereby enhancing the flexibility of layout of an engine room to which the valve timing control apparatus (1) is mounted.

<2-2> In addition to the feature <2-1>, an outside periphery of the first plate (rear plate 9) is fixedly inserted in the sealing recess (101) entirely in an axial direction of the housing body (10). This feature is further effective for reducing the axial size of the valve timing control apparatus (1), and thereby enhancing the flexibility of layout of the engine room to which the valve timing control apparatus (1) is mounted.

<2-3> In addition to the feature <2-1>, an outside periphery of the first plate (rear plate 9) is fixedly inserted in the sealing recess (101) partly in an axial direction of the housing body (10). This feature is an alternative to the feature <2-2>. In other words, the outside periphery of the first plate (rear plate 9) may extend out of the sealing recess (101) partly in the axial direction of the housing body (10). This feature is partly effective for providing the advantageous effects according to the feature <2-2>, and further effective for conforming to various design requirements, and enhancing the flexibility of adjustment of the axial length of the inside of the housing, the axial length of the first plate (rear plate 9), etc.

<2-4> A valve timing control apparatus (1) for an internal combustion engine, comprises: a housing body (10) having a hollow shape, wherein the housing body (10) is formed with a sealing recess (101) at an axial end of the housing body (10); a driven member (vane rotor 4) rotatably mounted in the housing body (10), and arranged to rotate with respect to the housing body (10) according to supply of fluid to and drainage of fluid from a hydraulic chamber (first, second and third advance chambers A1, A2 and A3, and first, second and third retard chambers R1, R2 and R3); a first plate (rear plate 9) fixedly inserted in the sealing recess (101) of the housing body (10), the first plate (rear plate 9) sealing the axial end of the housing body (10); a second plate (front plate 8) sealing anther axial end of the housing body (10); and an engagement member (lock piston 51) mounted in the driven member (vane rotor 4) for moving in an axial direction of the driven member (vane rotor 4) selectively out of and into the driven member (vane rotor 4) according to supply and drainage of fluid, wherein the first plate (rear plate 9) is provided with an engagement recess portion (lock hole 521 of sleeve 52) arranged to receive insertion of the engagement member (lock piston 51). The feature that the first plate (rear plate 9)

is fixedly inserted in the sealing recess (101) of the housing body (10), where the thickness of the first plate (rear plate 9) is relatively larger because of provision of the engagement recess portion (lock hole 521 of sleeve 52), is effective for efficiently reducing the axial size of the valve timing control apparatus (1).

<2-5> In addition to the feature <2-4>, the engagement recess portion (sleeve 52) is formed separately from the first plate (rear plate 9), and fixed to the first plate (rear plate 9). This feature is effective for making it easy to adapt the shape, size, material, etc., of the engagement recess portion (sleeve 52) to engagement and release of the engagement member (lock piston 51), and effective for preventing the first plate (rear plate 9) from being worn or damaged by engagement and release of the engagement member (lock piston 51).

<2-6> In addition to the feature <2-5>, the engagement recess portion (52) is press-fitted in a recess (900) of the first plate (rear plate 9). This feature is effective for securely fixing the engagement recess portion (sleeve 52) to the first plate (rear plate 9), and preventing working fluid from leaking through the engagement recess portion (sleeve 52), without sealing.

<2-7> In addition to the feature <2-4>, the engagement member (lock piston 51) is constantly subject to a biasing force toward the engagement recess portion (sleeve 52) of the first plate (rear plate 9), and wherein the engagement member (lock piston 51) has a tip (tip portion 511) that is arranged to receive a hydraulic pressure so that the engagement member (lock piston 51) moves out of the engagement recess portion (sleeve 52) against the biasing force. Specifically, as shown in FIG. 14, a space y enough to receive a hydraulic pressure is provided at the tip (tip portion 511) of the engagement member (lock piston 51) in the engagement recess portion (sleeve 52), even under the condition that the engagement member (lock piston 51) engages with the engagement recess portion (sleeve 52). This may require an increase in the axial size of the first plate (rear plate 9). However, the feature that the first plate (rear plate 9) is fixedly inserted in the sealing recess (101) of the housing body (10), where the axial length of the first plate (rear plate 9) is relatively larger because of provision of the engagement recess portion (lock hole 521 of sleeve 52), is effective for efficiently reducing the axial size of the valve timing control apparatus (1).

<2-8> A valve timing control apparatus (1) for an internal combustion engine, comprises: a housing body (10) having a hollow shape, wherein the housing body (10) is formed with a plurality of first bolt insertion holes (bolt holes 110, 120 and 130), wherein the first bolt insertion holes (bolt holes 110, 120 and 130) extend through the housing body (10) in the axial direction of the housing body (10), and wherein the housing body (10) is formed with a sealing recess (101) at an axial end of the housing body (10); a driven member (vane rotor 4) rotatably mounted in the housing body (10), and arranged to rotate with respect to the housing body (10) according to supply of fluid to and drainage of fluid from a hydraulic chamber (first, second and third advance chambers A1, A2 and A3, and first, second and third retard chambers R1, R2 and R3); a first plate (rear plate 9) fixedly inserted in the sealing recess (101) of the housing body (10), the first plate (rear plate 9) sealing the axial end of the housing body (10), wherein the first plate (rear plate 9) is formed with female thread portions (901, 902, 903) whose positions are conformed to positions of the first bolt insertion holes (bolt holes 110, 120 and 130) of the housing body (10) respectively; a second plate (front plate 8) sealing anther axial end of the housing body (10), wherein the second plate (front plate 8) is formed with second bolt insertion holes (bolt holes 83, 84 and 85) whose positions are conformed to the positions of the first bolt insertion holes (bolt holes 110, 120 and 130) of the housing body (10) respectively; and a plurality of bolts (b1, b2, b3) that are inserted through respective ones of the first bolt insertion holes (bolt holes 110, 120 and 130) of the housing body (10) and respective ones of the second bolt insertion holes (bolt holes 83, 84 and 85) of the second plate (front plate 8), and screwed in the female thread portions (901, 902, 903) of the first plate (rear plate 9). The feature that the first plate (rear plate 9) is fixedly inserted in the sealing recess (101) of the housing body (10), where the thickness of the first plate (rear plate 9) is relatively larger because of provision of the female thread portions (901, 902, 903) in which the bolts (b1, b2, b3) are screwed, is effective for efficiently reducing the axial size of the valve timing control apparatus (1).

<2-9> In addition to the feature <2-8>, the valve timing control apparatus (1) further comprises an engagement member (lock piston 51) mounted in the driven member (vane rotor 4) for moving in an axial direction of the driven member (vane rotor 4) selectively out of and into the driven member (vane rotor 4) according to supply and drainage of fluid, wherein the first plate (rear plate 9) is provided with an engagement recess portion (sleeve 52) arranged to receive insertion of the engagement member (lock piston 51). This feature is effective for providing the advantageous effects according to the features <2-4> and <2-8> simultaneously. Specifically, the feature that the first plate (rear plate 9) is fixedly inserted in the sealing recess (101) of the housing body (10), where the thickness of the first plate (rear plate 9) is relatively larger because of provision of the engagement recess portion (sleeve 52) and provision of the female thread portions (901, 902, 903), is effective for efficiently reducing the axial size of the valve timing control apparatus (1).

<2-10> The driven member (vane rotor 4) is fixed to an axial end of a camshaft (intake camshaft 3*a*; exhaust camshaft 3*b*) to form a rotating member (4, 3*a*; 4, 3*b*), wherein the rotating member (4, 3*a*; 4, 3*b*) extends through a camshaft insertion hole (support hole 92) that is formed in the first plate (rear plate 9) to extend through an inside portion of the first plate (rear plate 9). In this construction, a housing (HSG), which is constituted by the housing body (10) and the first plate (rear plate 9), may swing about the camshaft insertion hole (support hole 92) as a fulcrum with respect to the rotating member (4, 3*a*; 4, 3*b*), which is constituted by the driven member (vane rotor 4) and the camshaft (intake camshaft 3*a*; exhaust camshaft 3*b*). However, the feature <2-4> that the first plate (rear plate 9) is provided with an engagement recess portion (lock hole 521 of sleeve 52) arranged to receive insertion of the engagement member (lock piston 51), is effective for shortening the distance (moment arm) between the engagement recess portion (lock hole 521 of sleeve 52) and the camshaft insertion hole (support hole 92) as a fulcrum, thereby reducing the displacement of swinging motion of the engagement recess portion (lock hole 521 of sleeve 52), and thereby suppressing deviation of the engagement member (lock piston 51) from the engagement recess portion (lock hole 521 of sleeve 52).

<2-11> In addition to the feature <2-10>, the driven member (vane rotor 4) includes a boss portion (401) inserted in the camshaft insertion hole (support hole 92) of the first plate (rear plate 9). This feature is effective for positioning and rotatably supporting the driven member (vane rotor 4) with respect to the first plate (rear plate 9). When the valve timing control apparatus (1) is mounted to the camshaft (intake camshaft 3*a*; exhaust camshaft 3*b*), it is easy to fix one end (end portion 30) of the camshaft (intake camshaft 3*a*; exhaust camshaft 3*b*) to the driven member (vane rotor 4), because the driven member (vane rotor 4) is positioned with respect to the first plate (rear plate 9) by insertion of the boss portion (401) in the camshaft insertion hole (support hole 92). This is effective for enhancing the facility of assembling. The feature <2-10> is also effective for suppressing the amount of inclination or swing of the driven member (vane rotor 4) with respect to the housing (HSG). This is effective, especially for the construction <2-4> that the first plate (rear plate 9) is provided with an engagement recess portion (lock hole 521 of sleeve 52) arranged to receive insertion of the engagement member (lock piston 51).

<2-12> The housing body (10) is formed of an aluminum-based metal material, and the first plate (rear plate 9) is formed of an iron-based metal material. This feature is effective for reducing the weight of the housing body (10). This feature is also effective for providing the female thread portions (901, 902, 903) of the first plate (rear plate 9) with adequate strengths, in the case of the construction <2-8> that the first plate (rear plate 9) is formed with female thread portions (901, 902, 903) in which the bolts (b1, b2, b3) screwed. When the first plate (rear plate 9) is formed with a bearing portion (91) around the camshaft insertion hole (support hole 92), and an oil seal is mounted to the outside periphery of the bearing portion (91), the feature that the first plate (rear plate 9) is formed of an iron-based metal material, is effective for preventing wear of the bearing portion (91) of the first plate (rear plate 9), and thereby securely preventing working fluid from leaking from the inside of the valve timing control apparatus (1).

<2-13> The housing body (10) is formed by extrusion so that a pulley (100) is formed at an outside periphery of the housing body (10), and the pulley (100) extends in an axial direction of the housing body (10) all over the outside periphery of the housing body (10), and the first plate (rear plate 9) is formed by forging. The feature that the housing body (10) is formed by extrusion is effective for preventing working fluid from seeping and leaking from the housing body (10), and thereby preventing the timing belt (1010), which is wound around the pulley (100), from being damaged. The feature is also effective for accurately forming the pulley (100), because no tapering for drawing is provided by extrusion in contrast to die-casting. The feature that the first plate (rear plate 9) is formed by forging is effective for preventing working fluid from seeping and leaking from the first plate (rear plate 9).

<2-14> The valve timing control apparatus (1) according to <2-4> to <2-7> and <2-10> to <2-13> is of a vane type wherein the housing body (10) has a hollow cylindrical shape, wherein the housing body (10) is formed integrally with a shoe (11, 12, 13) at an inside periphery of the housing body (10), wherein the shoe (11, 12, 13) projects inwardly in a radial direction of the housing body (10); the driven member is a vane rotor (4) including a vane (41, 42, 43), wherein the vane (41, 42, 43) and the shoe (11, 12, 13) define an advance chamber (A1, A2, A3) and a retard chamber (R1, R2, R3) between the vane rotor (4) and housing body (10), and wherein the advance chamber (A1, A2, A3) and the retard chamber (R1, R2, R3) are adapted to supply and drainage of fluid; the engagement member (51) mounted in the vane rotor (4) for moving in an axial direction of the vane rotor (4) selectively out of and into the vane rotor (4) according to a state of operation of the internal combustion engine; the first plate (9) fixedly inserted in the sealing recess (101) of the housing body (10), the first plate (9) sealing an axial end of the advance chamber (A1, A2, A3) and an axial end of the retard chamber (R1, R2, R3); and the second plate (8) seals anther axial end of the advance chamber (A1, A2, A3) and another axial end of the retard chamber (R1, R2, R3). The vane type valve timing control apparatus (1) produces the advantageous effects according to the features <2-4> to <2-7> and <2-10> to <2-13>.

<2-15> The valve timing control apparatus (1) according to <2-8> to <2-13> is of a vane type, which comprises: a housing body (10) having a hollow cylindrical shape, wherein the housing body (10) is formed with a plurality of shoes (11, 12, 13) at an inside periphery of the housing body (10), wherein each of the shoes (11, 12, 13) projects inwardly in a radial direction of the housing body (10), and is formed with a first bolt insertion hole (bolt holes 110, 120 and 130), wherein the first bolt insertion holes (bolt holes 110, 120 and 130) extend through the housing body (10) in an axial direction of the housing body (10), and wherein the housing body (10) is formed with a sealing recess (101) at an axial end of the housing body (10); a vane rotor (4) rotatably mounted in the housing body (10), wherein the vane rotor (4) includes a vane (41, 42, 43), wherein the vane (41, 42, 43) and the shoes (11, 12, 13) define an advance chamber (A1, A2, A3) and a retard chamber (R1, R2, R3) between the vane rotor (4) and housing body (10), and wherein the advance chamber (A1, A2, A3) and the retard chamber (R1, R2, R3) are adapted to supply and drainage of fluid; a first plate (rear plate 9) fixedly inserted in the sealing recess (101) of the housing body (10), the first plate (9) sealing an axial end of the advance chamber (A1, A2, A3) and an axial end of the retard chamber (R1, R2, R3), wherein the first plate (rear plate 9) is formed with female thread portions (901, 902, 903) whose positions are conformed to positions of the first bolt insertion holes (bolt holes 110, 120 and 130) of the housing body (10) respectively; a second plate (front plate 8) sealing anther axial end of the advance chamber (A1, A2, A3) and another axial end of the retard chamber (R1, R2, R3), wherein the second plate (front plate 8) is formed with second bolt insertion holes (bolt holes 83, 84 and 85) whose positions are conformed to the positions of the first bolt insertion holes (bolt holes 110, 120 and 130) of the housing body (10) respectively; and a plurality of bolts (b1, b2, b3) that are inserted through respective ones of the first bolt insertion holes (bolt holes 110, 120 and 130) of the housing body (10) and respective ones of the second bolt insertion holes (bolt holes 83, 84 and 85) of the second plate (front plate 8), and screwed in the female thread portions (901, 902, 903) of the first plate (rear plate 9). The vane type valve timing control apparatus (1) produces the advantageous effects according to the features <2-8> to <2-13>.

<2-16> The housing body (10) has a hollow cylindrical shape, wherein the housing body (10) is formed integrally with a projection and a depression (pulley 100) at an outside periphery of the housing body (10), wherein the projection and depression (pulley 100) extend in an axial direction of the housing body (10) all over the outside periphery of the housing body (10), wherein the housing body (10) is formed with a plurality of first bolt insertion holes (bolt holes 110, 120 and 130), wherein the first bolt insertion holes (bolt holes 110, 120 and 130) extend through the housing body (10) in the axial direction of the housing body (10), and wherein the housing body (10) is formed with a sealing recess (101) at an axial end of the housing body (10). This is effective for reducing the radial size of the valve timing control apparatus (1) in addition to reduction of the axial size.

<Other Technical Features (II)> The following describes a second group of technical features other than the main technical features, and advantageous effects produced by the features.

The second group includes the following: <C3-1> A valve timing control apparatus for an internal combustion engine, comprising: an intake valve timing control apparatus fixed to an intake camshaft that actuates an intake valve of the internal combustion engine; and an exhaust valve timing control apparatus fixed to an exhaust camshaft that actuates an exhaust valve of the internal combustion engine; wherein each of the intake valve timing control apparatus and the exhaust valve timing control apparatus comprises: a housing having a hollow cylindrical shape, wherein the housing is formed integrally with a shoe at an inside periphery of the housing, and wherein the shoe projects inwardly in a radial direction of the housing; a vane rotor including: a rotor rotatably mounted in the housing, and fixed to a respective one of the intake camshaft and the exhaust camshaft; and a vane formed integrally with the rotor, projecting outwardly in a radial direction of the rotor, wherein the vane and the shoe define an advance chamber and a retard chamber between the vane rotor and housing, and wherein the advance chamber and the retard chamber are adapted to supply and drainage of fluid; and a lock member arranged to selectively lock and release the vane rotor with respect to the housing according to a state of operation of the internal combustion engine; wherein the vane rotor is provided with a first stopper portion, and the housing is provided with a first stopper portion, wherein the first stopper portion of the vane rotor and the first stopper portion of the housing constitute a first stopper mechanism, and wherein the first stopper portion of the vane rotor is brought into contact with the first stopper portion of the housing when the vane rotor rotates with respect to the housing in a first rotational direction; and wherein the vane rotor is provided with a second stopper portion, and the housing is provided with a second stopper portion, wherein the second stopper portion of the vane rotor and the second stopper portion of the housing constitute a second stopper mechanism, wherein the second stopper portion of the vane rotor is brought into contact with the second stopper portion of the housing when the vane rotor rotates with respect to the housing in a second rotational direction opposite to the first rotational direction, and wherein the second stopper mechanism has a larger contact area than the first stopper mechanism; wherein in the intake valve timing control apparatus, the lock member is arranged to lock the vane rotor with respect to the housing under a condition that the vane rotor is in a most retarded position within which rotation of the vane rotor is restricted by the first stopper mechanism; wherein in the exhaust valve timing control apparatus, the lock member is arranged to lock the vane rotor with respect to the housing under a condition that the vane rotor is in a most advanced position within which rotation of the vane rotor is restricted by the first stopper mechanism; and wherein the exhaust valve timing control apparatus further comprises a biasing member arranged to bias the vane rotor with respect to the housing in a direction toward the most advanced position. <C3-2> The valve timing control apparatus according to C3-1, wherein in each of the intake valve timing control apparatus and the exhaust valve timing control apparatus, each of the housing and the vane rotor is formed of an aluminum-based metal. <C3-3> The valve timing control apparatus according to C3-2, wherein in each of the intake valve timing control apparatus and the exhaust valve timing control apparatus, each of the housing and the vane rotor is formed by extrusion. <C3-4> The valve timing control apparatus according to C3-1 wherein in each of the intake valve timing control apparatus and the exhaust valve timing control apparatus, the first stopper mechanism is constituted by a circumferentially facing surface of the vane as the first stopper portion of the vane rotor, and a circumferentially facing surface of the shoe as the first stopper portion of the housing. <C3-5> The valve timing control apparatus according to C3-4, wherein in each of the intake valve timing control apparatus and the exhaust valve timing control apparatus: the housing is formed with a plurality of the shoes; the vane rotor includes a plurality of the vanes; the lock member is mounted in a first one of the vanes; the first stopper mechanism is constituted by a circumferentially facing surface of the first one of the vanes and a circumferentially facing surface of a respective one of the shoes; and a circumferentially facing surface of each of the vanes other than the first one and a circumferentially facing surface of a respective one of the shoes are maintained out of contact with each other. <C3-6> The valve timing control apparatus according to C3-1, wherein in each of the intake valve timing control apparatus and the exhaust valve timing control apparatus, the second stopper mechanism is constituted by a circumferentially facing surface of the shoe as the second stopper portion of the housing, and a circumferentially facing surface of a projection of the vane rotor as the second stopper portion of the vane rotor, and wherein the projection projects outwardly in a radial direction of the rotor from an outside periphery of the rotor to a position radially inside of a tip of the vane. <C3-7> The valve timing control apparatus according to C3-6, wherein the biasing member of the exhaust valve timing control apparatus includes a coil spring arranged between the vane and the shoe and radially outside of the projection of the vane rotor. <C3-8> The valve timing control apparatus according to C3-7, wherein in each of the intake valve timing control apparatus and the exhaust valve timing control apparatus, the circumferentially facing surface of the shoe is formed with a recess, and a circumferentially facing surface of the vane opposite to the circumferentially facing surface of the shoe is formed with a recess, and wherein in the exhaust valve timing control apparatus, the coil spring is mounted in the recess of the shoe and the recess of the vane. <C3-9> A valve timing control apparatus for an internal combustion engine, comprising: an intake valve timing control apparatus fixed to an intake camshaft that actuates an intake valve of the internal combustion engine; and an exhaust valve timing control apparatus fixed to an exhaust camshaft that actuates an exhaust valve of the internal combustion engine; wherein each of the intake valve timing control apparatus and the exhaust valve timing control apparatus comprises: a housing including: a housing body having a hollow cylindrical shape, wherein the housing body is formed integrally with a shoe at an inside periphery of the housing body, and wherein the shoe projects inwardly in a radial direction of the housing body; a front plate sealing a tip-side axial end of the housing body; and a rear plate sealing a camshaft-side axial end of the housing body; a vane rotor including: a rotor rotatably mounted in the housing, and fixed to a respective one of the intake camshaft and the exhaust camshaft; and a vane formed integrally with the rotor, projecting outwardly in a radial direction of the rotor, wherein the vane and the shoe define an advance chamber and a retard chamber between the vane rotor and housing, and wherein the advance chamber and the retard chamber are adapted to supply and drainage of fluid; and a lock member arranged to selectively lock and release the vane rotor with respect to the housing according to a state of operation of the internal combustion engine; wherein in the intake valve timing control apparatus, the lock member is arranged to lock the vane rotor with respect to the housing under a condition that the vane rotor is in a most retarded position; wherein in the exhaust valve timing control apparatus, the lock member is arranged to lock the vane rotor with respect to the housing under a condition that the vane rotor is in a most advanced position; wherein the exhaust valve timing control apparatus further comprises a biasing member arranged to bias the vane rotor with respect to the housing in a direction toward the most advanced position; wherein the housing body of the intake valve timing control apparatus and the housing body of the exhaust valve timing control apparatus are mirror images of each other, both of which are formed from an identical base workpiece by different cutting processes; and wherein the vane rotor of the intake valve timing control apparatus and the vane rotor of the exhaust valve timing control apparatus are mirror images of each other, both of which are formed from an identical base workpiece by different cutting processes. <C3-10> The valve timing control apparatus according to C3-9, wherein each of the base workpiece of the housing body and the base workpiece of the vane rotor is formed by extruding an aluminum-based metal material, and cutting an extruded workpiece. <C3-11> The valve timing control apparatus according to C3-9, wherein in each of the intake valve timing control apparatus and the exhaust valve timing control apparatus, the lock member is arranged to lock the vane rotor with respect to the housing when the vane rotor is in a first position such that a circumferentially facing surface of the vane is in contact with a circumferentially facing surface of the shoe. <C3-12> The valve timing control apparatus according to C3-11, wherein in each of the intake valve timing control apparatus and the exhaust valve timing control apparatus, when the vane rotor rotates in a direction away from the first position, a circumferentially facing surface of the shoe is brought into contact with a circumferentially facing surface of a projection of the vane rotor which projects outwardly in a radial direction of the rotor from an outside periphery of the rotor to a position radially inside of a tip of the vane. <C3-13> The valve timing control apparatus according to C3-12, wherein the biasing member of the exhaust valve timing control apparatus includes a coil spring arranged between the vane and the shoe and radially outside of the projection of the vane rotor. <C3-14> A valve timing control apparatus for an internal combustion engine, comprising: an intake valve timing control apparatus fixed to an intake camshaft that actuates an intake valve of the internal combustion engine; and an exhaust valve timing control apparatus fixed to an exhaust camshaft that actuates an exhaust valve of the internal combustion engine; wherein each of the intake valve timing control apparatus and the exhaust valve timing control apparatus comprises: a housing having a hollow cylindrical shape, wherein the housing is formed integrally with a shoe at an inside periphery of the housing, and wherein the shoe projects inwardly in a radial direction of the housing; a vane rotor including: a rotor rotatably mounted in the housing, and fixed to a respective one of the intake camshaft and the exhaust camshaft; and a vane formed integrally with the rotor, projecting outwardly in a radial direction of the rotor, wherein the vane and the shoe define an advance chamber and a retard chamber between the vane rotor and housing, and wherein the advance chamber and the retard chamber are adapted to supply and drainage of fluid; and a lock member arranged to selectively lock and release the vane rotor with respect to the housing according to a state of operation of the internal combustion engine; wherein in the intake valve timing control apparatus, the lock member is arranged to lock the vane rotor with respect to the housing under a condition that the vane rotor is in a most retarded position; wherein in the exhaust valve timing control apparatus, the lock member is arranged to lock the vane rotor with respect to the housing under a condition that the vane rotor is in a most advanced position; wherein in the intake valve timing control apparatus, a contact pressure between contact surfaces of the vane rotor and the housing which is caused by rotation of the vane rotor with respect to the housing in a first rotational direction toward the most retarded position, is smaller than a contact pressure between contact surfaces of the vane rotor and the housing which is caused by rotation of the vane rotor with respect to the housing in a second rotational direction opposite to the first rotational direction; and wherein in the exhaust valve timing control apparatus, a contact pressure between contact surfaces of the vane rotor and the housing which is caused by rotation of the vane rotor with respect to the housing in a first rotational direction toward the most advanced position, is smaller than a contact pressure between contact surfaces of the vane rotor and the housing which is caused by rotation of the vane rotor with respect to the housing in a second rotational direction opposite to the first rotational direction. <C3-15> The valve timing control apparatus according to C3-14, wherein in each of the intake valve timing control apparatus and the exhaust valve timing control apparatus, each of the housing and the vane rotor is formed of an aluminum-based metal. <C3-16> The valve timing control apparatus according to C3-15, wherein in each of the intake valve timing control apparatus and the exhaust valve timing control apparatus, each of the housing and the vane rotor is formed by extrusion. <C3-17> The valve timing control apparatus according to C3-14, wherein in each of the intake valve timing control apparatus and the exhaust valve timing control apparatus, when the vane rotor rotates in a direction toward a first position where the lock member is arranged to lock the vane rotor with respect to the housing, a circumferentially facing surface of the vane is brought into contact with a circumferentially facing surface of the shoe. <C3-18> The valve timing control apparatus according to C3-17, wherein in each of the intake valve timing control apparatus and the exhaust valve timing control apparatus, when the vane rotor rotates in a direction away from the first position, a circumferentially facing surface of the shoe is brought into contact with a circumferentially facing surface of a projection of the vane rotor which projects outwardly in a radial direction of the rotor from an outside periphery of the rotor to a position radially inside of a tip of the vane.

<C3-19> The valve timing control apparatus according to C3-18, wherein the biasing member of the exhaust valve timing control apparatus includes a coil spring arranged between the vane and the shoe and radially outside of the projection of the vane rotor. <C3-20> The valve timing control apparatus according to C3-19, wherein in each of the intake valve timing control apparatus and the exhaust valve timing control apparatus, the circumferentially facing surface of the shoe is formed with a recess, and a circumferentially facing surface of the vane opposite to the circumferentially facing surface of the shoe is formed with a recess, and wherein in the exhaust valve timing control apparatus, the coil spring is mounted in the recess of the shoe and the recess of the vane.

<3-1> A valve timing control apparatus (1) for an internal combustion engine, comprises: an intake valve timing control apparatus (1*a*) fixed to an intake camshaft (3*a*) that actuates an intake valve of the internal combustion engine; and an exhaust valve timing control apparatus (1*b*) fixed to an exhaust camshaft (3*b*) that actuates an exhaust valve of the internal combustion engine; wherein each of the intake valve timing control apparatus (1*a*) and the exhaust valve timing control apparatus (1*b*) comprises: a housing (HSG) including: a housing body (10) having a hollow cylindrical shape, wherein the housing body (10) is formed integrally with a shoe (11, 12, 13) at an inside periphery of the housing body (10), and wherein the shoe (11, 12, 13) projects inwardly in a radial direction of the housing body (10); a front plate (front plate 8) sealing a tip-side axial end of the housing body (10); and a rear plate (rear plate 9) sealing a camshaft-side axial end of the housing body (10); a vane rotor (4) including: a rotor (40) rotatably mounted in the housing (HSG), and fixed to a respective one of the intake camshaft (3*a*) and the exhaust camshaft (3*b*); and a vane (41, 42, 43) formed integrally with the rotor (40), projecting outwardly in a radial direction of the rotor (40), wherein the vane (41, 42, 43) and the shoe (11, 12, 13) define an advance chamber (A1, A2, A3) and a retard chamber (R1, R2, R3) between the vane rotor (4) and housing (HSG), and wherein the advance chamber (A1, A2, A3) and the retard chamber (R1, R2, R3) are adapted to supply and drainage of fluid; and a lock member (lock mechanism 5) arranged to selectively lock and release the vane rotor (4) with respect to the housing (HSG) according to a state of operation of the internal combustion engine; wherein in the intake valve timing control apparatus (1*a*), the lock member (lock mechanism 5) is arranged to lock the vane rotor (4) with respect to the housing (HSG) under a condition that the vane rotor (4) is in a most retarded position; wherein in the exhaust valve timing control apparatus (1*b*), the lock member (lock mechanism 5) is arranged to lock the vane rotor (4) with respect to the housing (HSG) under a condition that the vane rotor (4) is in a most advanced position; wherein the exhaust valve timing control apparatus (1*b*) further comprises a biasing member (6, coil springs 610, 620 and 630) arranged to bias the vane rotor (4) with respect to the housing (HSG) in a direction toward the most advanced position; wherein the housing body (10) of the intake valve timing control apparatus (1*a*) and the housing body (10) of the exhaust valve timing control apparatus (1*b*) are mirror images of each other, both of which are formed from an identical base workpiece (P3) by different cutting processes; and wherein the vane rotor (4) of the intake valve timing control apparatus (1*a*) and the vane rotor (4) of the exhaust valve timing control apparatus (1*b*) are mirror images of each other, both of which are formed from an identical base workpiece (Q2) by different cutting processes. This feature is effective for using the base workpiece (P3) and other components commonly for the housing body (10) of the intake valve timing control apparatus (1*a*) and the housing body (10) of the exhaust valve timing control apparatus (1*b*), the base workpiece (Q2) and other components commonly for the vane rotor (4) of the intake valve timing control apparatus (1*a*) and the vane rotor (4) of the exhaust valve timing control apparatus (1*b*). This is effective for simplifying the process of manufacturing, and thereby reducing the manufacturing cost.

<3-2> Each of the base workpiece (P3) of the housing body (10) and the base workpiece (Q2) of the vane rotor (4) is formed by extruding an aluminum-based metal material, and cutting an extruded workpiece (P1, Q1). This is effective for reducing the weights of the intake valve timing control apparatus (1*a*) and the exhaust valve timing control apparatus (1*b*). This is effective for further simplifying the process of manufacturing, and thereby further reducing the manufacturing cost, because the base workpieces are efficiently commonly used. The use of the extruded workpiece (P1, Q1) is effective for enhancing the accuracy of processing.

<3-3> In each of the intake valve timing control apparatus (1*a*) and the exhaust valve timing control apparatus (1*b*), the lock member (lock mechanism 5) is arranged to lock the vane rotor (4) with respect to the housing (HSG) when the vane rotor (4) is in a first position such that a circumferentially facing surface (flat portion 415) of the vane (41) is in contact with a circumferentially facing surface (flat portion 111) of the shoe (11). This feature is effective for stably operating the internal combustion engine, the intake valve timing control apparatus (1*a*) and the exhaust valve timing control apparatus (1*b*). The feature that the circumferentially facing surface (flat portion 415) of the vane (41) is in contact with the circumferentially facing surface (flat portion 111) of the shoe (11), is effective for increasing the contact area (SS1) between the vane (41) and the shoe (11), and thereby reducing the contact pressure, and thereby preventing the circumferentially facing surface (flat portion 415) of the vane (41) and the circumferentially facing surface (flat portion 111) of the shoe (11) from contacting hard with each other. This is effective for preventing deformation of the vane rotor (4) and the housing (HSG), enhancing the durability of the intake valve timing control apparatus (1*a*) and the exhaust valve timing control apparatus (1*b*), while maintaining the performance of the intake valve timing control apparatus (1*a*) and the exhaust valve timing control apparatus (1*b*) by preventing the initial position or the position within which rotation of the vane rotor (4) is restricted.

<3-4> In each of the intake valve timing control apparatus (1*a*) and the exhaust valve timing control apparatus (1*b*), when the vane rotor (4) rotates in a direction away from the first position, a circumferentially facing surface of the shoe (12) is brought into contact with a circumferentially facing surface of a projection (stopper portion 419) of the vane rotor (4) which projects outwardly in a radial direction of the rotor (40) from an outside periphery of the rotor (40) to a position radially inside of a tip of the vane (41). This feature is effective for restricting the relative rotation within the side opposite to the initial position. The biasing member (6) is easily mounted in the exhaust valve timing control apparatus (1*b*), because the contact area (SS2) of the projection (stopper portion 419) is small. This feature is effective for restricting the amount of displacement of biasing member (6) within a predetermined limit, and thereby preventing plastic deformation of the biasing member (6), thereby maintaining the performance of the exhaust valve timing control apparatus (1*b*).

<3-5> The biasing member (6) of the exhaust valve timing control apparatus (1*b*) includes a coil spring (61, 62, 63) arranged between the vane (41, 42, 43) and the shoe (11, 12, 13) and radially outside of the projection (stopper portion 419) of the vane rotor (4). The use of the coil spring (61, 62, 63) is effective for easily adjusting the biasing force, and easily mounting the biasing member (6). The projection (stopper portion 419) of the vane rotor (4) serves to guide the coil spring (610), thereby preventing excessive deformation of the coil spring (610) inwardly in the radial direction of the vane rotor (4). This is effective for maintaining normal operations of the biasing member (6) and the exhaust valve timing control apparatus (1*b*).

<3-6> A valve timing control apparatus (1) for an internal combustion engine, comprises: an intake valve timing control apparatus (1*a*) fixed to an intake camshaft (3*a*) that actuates an intake valve of the internal combustion engine; and an exhaust valve timing control apparatus (1*b*) fixed to an exhaust camshaft (3*b*) that actuates an exhaust valve of the internal combustion engine; wherein each of the intake valve timing control apparatus (1*a*) and the exhaust valve timing control apparatus (1*b*) comprises: a housing (HSG) having a hollow cylindrical shape, wherein the housing (HSG) is formed integrally with a shoe (11, 12, 13) at an inside periphery of the housing (HSG), and wherein the shoe (11, 12, 13) projects inwardly in a radial direction of the housing (HSG); a vane rotor (4) including: a rotor (40) rotatably mounted in the housing (HSG), and fixed to a respective one of the intake camshaft (3*a*) and the exhaust camshaft (3*b*); and a vane (41, 42, 43) formed integrally with the rotor (40), projecting outwardly in a radial direction of the rotor (40), wherein the vane (41, 42, 43) and the shoe (11, 12, 13) define an advance chamber (A1, A2, A3) and a retard chamber (R1, R2, R3) between the vane rotor (4) and housing (HSG), and wherein the advance chamber (A1, A2, A3) and the retard chamber (R1, R2, R3) are adapted to supply and drainage of fluid; and a lock member (lock mechanism 5) arranged to selectively lock and release the vane rotor (4) with respect to the housing (HSG) according to a state of operation of the internal combustion engine; wherein in the intake valve timing control apparatus (1*a*), the lock member (lock mechanism 5) is arranged to lock the vane rotor (4) with respect to the housing (HSG) under a condition that the vane rotor (4) is in a most retarded position; wherein in the exhaust valve timing control apparatus (1*b*), the lock member (5) is arranged to lock the vane rotor (4) with respect to the housing (HSG) under a condition that the vane rotor (4) is in a most advanced position; wherein in the intake valve timing control apparatus (1*a*), a contact pressure between contact surfaces (flat portion 415, flat portion 111) of the vane rotor (4) and the housing (HSG) which is caused by rotation of the vane rotor (4) with respect to the housing (HSG) in a first rotational direction toward the most retarded position, is smaller than a contact pressure between contact surfaces (stopper portion 419, second shoe 12) of the vane rotor (4) and the housing (HSG) which is caused by rotation of the vane rotor (4) with respect to the housing (HSG) in a second rotational direction opposite to the first rotational direction; and wherein in the exhaust valve timing control apparatus (1*b*), a contact pressure between contact surfaces (flat portion 415, flat portion 111) of the vane rotor (4) and the housing (HSG) which is caused by rotation of the vane rotor (4) with respect to the housing (HSG) in a first rotational direction toward the most advanced position, is smaller than a contact pressure between contact surfaces (stopper portion 419, second shoe 12) of the vane rotor (4) and the housing (HSG) which is caused by rotation of the vane rotor (4) with respect to the housing (HSG) in a second rotational direction opposite to the first rotational direction. Although the contact pressure between the vane rotor 4 and housing HSG in the first rotational direction is different from that in the second rotational direction, and the lock position of the intake valve timing control apparatus 1*a* is reversed from the lock position of the exhaust valve timing control apparatus (1*b*), the feature that the housing body (10) of the intake valve timing control apparatus (1*a*) and the housing body (10) of the exhaust valve timing control apparatus (1*b*) are mirror images of each other, and the vane rotor (4) of the intake valve timing control apparatus (1*a*) and the vane rotor (4) of the exhaust valve timing control apparatus (1*b*) are mirror images of each other, is effective for allowing to commonly use the base work pieces (P3, Q2) for the vane rotor (4) and the housing body (10) between the intake valve timing control apparatus (1*a*) and the exhaust valve timing control apparatus (1*b*). The feature that the contact pressure at the initial position (rotation limit position) where the vane rotor (4) is locked by the lock member (5) is small, is effective for preventing hard contact between the vane rotor 4 and the housing body 10. This is effective for preventing deformation of the vane rotor (4) and the housing (HSG), enhancing the durability of the intake valve timing control apparatus (1*a*) and the exhaust valve timing control apparatus (1*b*), while maintaining the performance of the intake valve timing control apparatus (1*a*) and the exhaust valve timing control apparatus (1*b*) by preventing deviation of the initial position or the bound within which rotation of the vane rotor (4) is restricted.

<3-7> A valve timing control apparatus (1) for an internal combustion engine, comprising: an intake valve timing control apparatus (1*a*) fixed to an intake camshaft (3*a*) that actuates an intake valve of the internal combustion engine; and an exhaust valve timing control apparatus (1*b*) fixed to an exhaust camshaft (3*b*) that actuates an exhaust valve of the internal combustion engine; wherein each of the intake valve timing control apparatus (1*a*) and the exhaust valve timing control apparatus (1*b*) comprises: a housing (HSG) having a hollow cylindrical shape, wherein the housing (HSG) is formed integrally with a shoe (11, 12, 13) at an inside periphery of the housing (HSG), and wherein the shoe (11, 12, 13) projects inwardly in a radial direction of the housing (HSG); a vane rotor (4) including: a rotor (40) rotatably mounted in the housing (HSG), and fixed to a respective one of the intake camshaft (3*a*) and the exhaust camshaft (3*b*); and a vane (41, 42, 43) formed integrally with the rotor (40), projecting outwardly in a radial direction of the rotor (40), wherein the vane (41, 42, 43) and the shoe (11, 12, 13) define an advance chamber (A1, A2, A3) and a retard chamber (R1, R2, R3) between the vane rotor (4) and housing (HSG), and wherein the advance chamber (A1, A2, A3) and the retard chamber (R1, R2, R3) are adapted to supply and drainage of fluid; and a lock member (lock mechanism 5) arranged to selectively lock and release the vane rotor (4) with respect to the housing (HSG) according to a state of operation of the internal combustion engine; wherein the vane rotor (4) is provided with a first stopper portion (flat portion 415), and the housing (HSG) is provided with a first stopper portion (flat portion 111), wherein the first stopper portion (flat portion 415) of the vane rotor (4) and the first stopper portion (flat portion 111) of the housing (HSG) constitute a first stopper mechanism (flat portion 111, flat portion 415), and wherein the first stopper portion (flat portion 415) of the vane rotor (4) is brought into contact with the first stopper portion (flat portion 111) of the housing (HSG) when the vane rotor (4) rotates with respect to the housing (HSG) in a first rotational direction; and wherein the vane rotor (4) is provided with a second stopper portion (stopper portion 419), and the housing (HSG) is provided with a second stopper portion (second shoe 12), wherein the second stopper portion (stopper portion 419) of the vane rotor (4) and the second stopper portion (second shoe 12) of the housing (HSG) constitute a second stopper mechanism (second shoe 12, stopper portion 419), wherein the second stopper portion (stopper portion 419) of the vane rotor (4) is brought into contact with the second stopper portion (second shoe 12) of the housing (HSG) when the vane rotor (4) rotates with respect to the housing (HSG) in a second rotational direction opposite to the first rotational direction, and wherein the second stopper mechanism (stopper portion 419, second shoe 12) has a larger contact area (SS2) than the first stopper mechanism (flat portion 111, flat portion 415, SS1); wherein in the intake valve timing control apparatus (1*a*), the lock member (lock mechanism 5) is arranged to lock the vane rotor (4) with respect to the housing (HSG) under a condition that the vane rotor (4) is in a most retarded position within which rotation of the vane rotor (4) is restricted by the first stopper mechanism (flat portion 111, flat portion 415); wherein in the exhaust valve timing control apparatus (1*b*), the lock member (5) is arranged to lock the vane rotor (4) with respect to the housing (HSG) under a condition that the vane rotor (4) is in a most advanced position within which rotation of the vane rotor (4) is restricted by the first stopper mechanism (flat portion 111, flat portion 415); and wherein the exhaust valve timing control apparatus (1*b*) further comprises a biasing member (6, coil springs 610, 620 and 630) arranged to bias the vane rotor (4) with respect to the housing (HSG) in a direction toward the most advanced position. The feature that the first stopper mechanism (flat portion 111, flat portion 415)

and the second stopper mechanism (stopper portion 419, second shoe 12) are common between the intake valve timing control apparatus 1*a* and the exhaust valve timing control apparatus 1*b*, except that arrangement in the rotational direction is reversed, is effective for allowing to commonly use the base work pieces (P3, Q2) for the vane rotor (4) and the housing body (10) between the intake valve timing control apparatus 1*a* and the exhaust valve timing control apparatus 1*b*, wherein the housing body (10) of the intake valve timing control apparatus (1*a*) and the housing body (10) of the exhaust valve timing control apparatus (1*b*) are mirror images of each other, and the vane rotor (4) of the intake valve timing control apparatus (1*a*) and the vane rotor (4) of the exhaust valve timing control apparatus (1*b*) are mirror images of each other. The feature that the contact pressure of the first stopper mechanism (flat portion 111, flat portion 415) at the initial position (the rotation limit position) where the vane rotor 4 is locked by the lock member (lock mechanism 5) is set smaller, is effective for preventing deformation of the first stopper mechanism (flat portion 111, flat portion 415), and change of the initial position (the rotation limit position). When the vane rotor 4 rotates in the direction away from the initial position, rotation of the vane rotor 4 is restricted by the second stopper mechanism (stopper portion 419, second shoe 12). The feature that the contact area of the second stopper mechanism (stopper portion 419, second shoe 12) is smaller than that of the first stopper mechanism (flat portion 111, flat portion 415), is effective for allowing to arrange the biasing member 6 in the exhaust valve timing control apparatus 1*b* without interference with the second stopper mechanism (stopper portion 419, second shoe 12). This feature is effective for restricting the amount of displacement of biasing member 6 within a predetermined bound, and thereby preventing plastic deformation of the biasing member 6, thereby maintaining the performance of the exhaust valve timing control apparatus (1*b*). On the other hand, in the exhaust valve timing control apparatus 1*b*, the contact pressure of the first stopper mechanism (flat portion 111, flat portion 415) at the most advanced position toward which the vane rotor 4 is biased by the biasing member 6, is relatively large. Accordingly, the feature that the contact area SS1 of the first stopper mechanism (flat portion 111, flat portion 415) is set larger is effective for efficiently preventing deformation of the biasing member 6.

<3-8> In each of the intake valve timing control apparatus (1*a*) and the exhaust valve timing control apparatus (1*b*), each of the housing (HSG) and the vane rotor (4) is formed of an aluminum-based metal. This feature is effective for reducing the weight of each of the intake valve timing control apparatus 1*a* and the exhaust valve timing control apparatus 1*b*.

<3-9> In each of the intake valve timing control apparatus (1*a*) and the exhaust valve timing control apparatus (1*b*), each of the housing (HSG) and the vane rotor (4) is formed by extrusion. This feature is effective for allowing to commonly use the base workpieces between the intake valve timing control apparatus 1*a* and the exhaust valve timing control apparatus 1*b*, simplifying the process of manufacturing, and thereby reducing the manufacturing cost. This is effective for forming the housing body 10 and the vane rotor 4 so that each of the housing body 10 and the vane rotor 4 has a uniform radial size without tapering which may be caused by die-casting, and thereby enhancing the accuracy of manufacturing.

<3-10> In each of the intake valve timing control apparatus (1*a*) and the exhaust valve timing control apparatus (1*b*), when the vane rotor (4) rotates in a direction toward a first position where the lock member (5) is arranged to lock the vane rotor (4) with respect to the housing (HSG), a circumferentially facing surface (415) of the vane (41) is brought into contact with a circumferentially facing surface (111) of the shoe (11). In other words, in each of the intake valve timing control apparatus (1*a*) and the exhaust valve timing control apparatus (1*b*), the first stopper mechanism is constituted by the circumferentially facing surfaces of the first vane 41 and the first shoe 11. This feature is effective for allowing to set the contact area SS1 of the first stopper mechanism at the rotation limit position to an arbitrary large value. This is effective for efficiently preventing deformation of the vane rotor 4 and the housing HSG.

<3-11> In each of the intake valve timing control apparatus (1*a*) and the exhaust valve timing control apparatus (1*b*): the housing (HSG) is formed with a plurality of the shoes (11, 12, 13); the vane rotor (4) includes a plurality of the vanes (41, 42, 43); the lock member (5) is mounted in a first one of the vanes (41); the first stopper mechanism (111, 415) is constituted by a circumferentially facing surface (415) of the first one of the vanes (41) and a circumferentially facing surface (111) of a respective one of the shoes (11); and a circumferentially facing surface (425, 435) of each of the vanes other than the first one (42, 43) and a circumferentially facing surface (121, 131) of a respective one of the shoes (12, 13) are maintained out of contact with each other. Namely, the first stopper mechanism is constituted by the circumferentially facing surface of the first vane 41 in which the lock mechanism 5 is mounted. The first vane 41 is relatively strong enough to restrict the relative rotation, because the circumferential size of the first vane 41 is larger than those of the second vane 42 and third vane 43. This is effective for preventing deformation of the first stopper mechanism, i.e. deformation of the vane rotor 4 (the first vane 41), and thereby enhancing the durability of the intake valve timing control apparatus 1*a* and the exhaust valve timing control apparatus 1*b*.

<3-12> In each of the intake valve timing control apparatus (1*a*) and the exhaust valve timing control apparatus (1*b*), when the vane rotor (4) rotates in a direction away from the first position, a circumferentially facing surface of the shoe (12) is brought into contact with a circumferentially facing surface of a projection (419) of the vane rotor (4) which projects outwardly in a radial direction of the rotor (40) from an outside periphery of the rotor (40) to a position radially inside of a tip of the vane (41). In other words, in each of the intake valve timing control apparatus (1*a*) and the exhaust valve timing control apparatus (1*b*), the second stopper mechanism (419, 12) is constituted by a circumferentially facing surface of the shoe (12) as the second stopper portion (12) of the housing (HSG), and a circumferentially facing surface of a projection (419) of the vane rotor (4) as the second stopper portion (419) of the vane rotor (4), and wherein the projection (419) projects outwardly in a radial direction of the rotor (40) from an outside periphery of the rotor (40) to a position radially inside of a tip of the vane (41). This feature is effective for allowing to set the contact area SS2 of the second stopper mechanism (stopper portion 419, second shoe 12) to an arbitrary small value, and thereby easily mounting the biasing member (6) in the exhaust valve timing control apparatus (1*b*).

<3-13> In addition to the feature <3-12>, the biasing member (6) of the exhaust valve timing control apparatus (1*b*) includes a coil spring (61, 62, 63) arranged between the vane (41, 42, 43) and the shoe (11, 12, 13) and radially outside of the projection (419) of the vane rotor (4). This is effective similar to the feature <3-5>.

<3-14> In addition to the feature <3-13>, in each of the intake valve timing control apparatus (1*a*) and the exhaust valve timing control apparatus (1*b*), the circumferentially facing surface of the shoe (11, 12, 13) is formed with a recess (115, 125, 235), and a circumferentially facing surface of the vane (41, 42, 43) opposite to the circumferentially facing surface of the shoe (11, 12, 13) is formed with a recess (418, 428, 438), and wherein in the exhaust valve timing control apparatus (1*b*), the coil spring (61, 62, 63) is mounted in the recess (115, 125, 235) of the shoe (11, 12, 13) and the recess (418, 428, 438) of the vane (41, 42, 43). This is effective for ensuring normal operations of the biasing member 6 and the exhaust valve timing control apparatus 1*b*, because the displacements of coil springs 610, 620 and 630 in the radial direction and the axial direction of the housing body 10 are restricted by the recess (418, 428, 438), and the recess (115, 125, 235). The provision of the recess (418, 428, 438), and the recess (115, 125, 235) eliminates the necessity of provision of an additional retaining member. Moreover, the coil springs 610, 620 and 630 may be directly mounted in the recess (418, 428, 438), and the recess (115, 125, 235) in the first, second and third advance chambers A1, A2 and A3, without the retaining portions 611 and 612. The omission of the retaining portions 611 and 612 results in reduction of the number of parts.

<<Modifications of Present Embodiment>> The present embodiment may be modified as follows.

Although the number of vanes or the number of shoes is three in the present embodiment, the number may be changed. The number of bolts for fixing the front plate 8, rear plate 9 and housing body 10 together may be also changed from three.

The driven member of the valve timing control apparatus is not limited to the vane rotor. The housing may be formed with no shoe. Namely, the present embodiment is of a vane type, but may be modified to other types. For example, the present embodiment may be modified to a type that rotation of a crankshaft is transmitted to a housing, and the rotational phase of the housing with respect to the camshaft is changed by axial movement of a member which is formed with a helical gear (or spline).

Although the valve timing control apparatus according to the present embodiment includes intake valve timing control apparatus 1*a* and exhaust valve timing control apparatus 1*b* for both of the intake camshaft and the exhaust camshaft of the internal combustion engine, the valve timing control apparatus may include only one of intake valve timing control apparatus 1*a* and exhaust valve timing control apparatus 1*b*.

Although the sealing recess 101 is formed only at the rear-plate-side of the housing body 10 in which the rear plate 9 is fixedly inserted in the present embodiment, the sealing recess 101 may be also formed at the front-plate-side of the housing body 10 in which the front plate 8 is fixedly inserted. This feature is effective for further shortening the axial length of the valve timing control apparatus. However, the housing body 10 may be formed with no sealing recess 101, so that the front plate 8 and rear plate 9 are simply fixed to the axial end surfaces of the housing body 10.

Although the housing body 10 has openings at the axial ends in the present embodiment, the housing body 10 may have a bottom at one axial end, and an opening at the other axial end. In this alternative case, the feature that the housing body 10 is formed with the sealing recess 101 at the opening axial end in which the first plate (rear plate 9) is fixedly mounted, is also effective for reducing the axial length of the valve timing control apparatus.

Although the female threads are formed in the rear plate 9 to which bolts b1, b2 and b3 are fixed in the present embodiment, the female threads may be formed in front plate 8 so that the bolts b1, b2 and b3 are inserted from the X-axis negative side to fix the rear plate 9, housing body 10 and front plate 8 together.

Although each of the bolt holes (of female thread portions 901, 902 and 903) of the rear plate 9 is formed with a female thread in the present embodiment, each of the bolt holes (of female thread portions 901, 902 and 903) of the rear plate 9 may be formed with no female thread. For example, the bolts b1, b2 and b3 may be inserted to pass through the rear plate 9, and fixed to nuts. Moreover, although each of the bolt holes (of female thread portions 901, 902 and 903) of the rear plate 9 is a through hole, each of the bolt holes (of female thread portions 901, 902 and 903) of the rear plate 9 may be a recess.

Although the boundary between the inside periphery of the sealing recess (101) and the outside periphery of the first plate (9) is sealed by the sealing ring S1, and the boundary between the axial end surface of each of the shoes (11, 12, 13) and the annular portion (annular groove 907) of the first plate (9) is sealed by the sealing ring S2, wherein the annular portion (907) extends circumferentially around a respective one of the second bolt holes (female thread portions 901, 902 and 903), the sealing rings S1 and S2 may be replaced with a sealant. For example, the boundary between the axial end surface of one of the shoes (11, 12, 13) and the annular portion (annular groove 907) of the first plate (9) may be sealed by an adhesive serving a sealant. This alternative feature is effective for strengthening the fixing forces of the bolts b1, b2 and b3, and implementing the sealing without the sealing rings S2 and the annular grooves 907, 908 and 909.

Although the sealing rings S1, S2, S3 and S4 are O-rings in the present embodiment, the sealing rings S1, S2, S3 and S4 may be sealing rings of another type.

Although the front plate 8 is formed with the annular groove 89 in which the sealing ring S3 is mounted in the present embodiment, the annular groove 89 may be formed in the opposite surface of the housing body 10. Also, although the rear plate 9 is formed with the annular grooves 907, 908 and 909 in which the sealing rings S2 are mounted in the present embodiment, the annular grooves 907, 908 and 909 may be formed in the opposite surface of the housing body 10.

Although the sealing ring S3 is provided in the form of the clover shape, the sealing ring S3 may be replaced with a first sealing ring for sealing the inside of the front plate 8 where the first sealing ring extends outside of bolt holes 83, 84 and 85, and a second sealing ring for sealing the portions surrounding the bolt holes 83, 84 and 85.

Although the front plate 8 and the plug 7 are formed by forging an iron-based metal material in the present embodiment, the front plate 8 and the plug 7 may be formed by pressing. The iron-based metal material may be replaced with an aluminum-based metal material such as aluminum alloys.

Although the housing HSG and the vane rotor 4 are formed of an aluminum-based metal in the present embodiment, the aluminum-based metal may be replaced with another material such as an iron-based metal material.

Although the base workpieces of the housing HSG and the vane rotor 4 are formed by extrusion in the present embodiment, they may be formed by another process such as die-casting.

Although the vane rotor 4 is formed with the boss portion 401 that is inserted in the camshaft insertion hole (support hole 92) in the present embodiment, the vane rotor 4 may be formed with no boss portion 401. The construction of positioning pin 905 may be modified differently. The positioning pin 905 may be omitted.

Although first, second and third spring units 61, 62 and 63 which constitute the biasing member 6 in the exhaust valve timing control apparatus 1*b* are mounted in respective ones of all the first, second and third advance chambers A1, A2 and A3 in the present embodiment, only a part of first, second and third spring units 61, 62 and 63 may be mounted in only a part of first, second and third advance chambers A1, A2 and A3. When no spring unit is mounted in first advance chamber A1 in which the second stopper mechanism is provided, it is possible to increase the contact area of the second stopper mechanism, and thereby securely preventing the second stopper mechanisms from deforming. In this case, even when a fluid passage is formed to be connected to first advance chamber A1 for actuating the lock mechanism, there is a high flexibility of design, because the fluid passage does not interfere with such a spring unit or retainer portions.

Although first, second and third spring units 61, 62 and 63 which constitute the biasing member 6 in the exhaust valve timing control apparatus 1*b* are mounted in respective ones of the first, second and third advance chambers A1, A2 and A3 in the present embodiment, the first, second and third spring units 61, 62 and 63 may be mounted in respective ones of first, second and third retard chambers R1, R2 and R3. This may be applied to a type that it is necessary to bias the vane rotor 4 in the retard direction, depending on the type of transmitting the rotation of the crankshaft to the camshaft.

Although each of the first, second and third spring units 61, 62 and 63 is provided with the single coil spring 610, 620 or 630 in the present embodiment, each of the first, second and third spring units 61, 62 and 63 may be provided with a plurality of coil springs. Arrangement of the coil springs in the radial direction not in the axial direction is effective for suppressing increase in the axial size of the exhaust valve timing control apparatus 1*b*.

Although the first, second and third spring units 61, 62 and 63 is provided with coil springs 610, 620 and 630 in the present embodiment, each of the first, second and third spring units 61, 62 and 63 may be provided with an elastic member such as a leaf spring or spiral spring instead of the coil spring. Although each of the first, second and third spring units 61, 62 and 63 is provided with the retaining portions 611, 612 in the present embodiment, the retaining portions may be omitted.

Although each of the coil springs 610, 620 and 630 is mounted in the recesses of the circumferentially-facing surfaces of the respective vane and shoe which faces each other in the present embodiment, the recesses may be replaced with projections to which the coil springs 610, 620 and 630 are mounted.

Although the first stopper mechanism (flat portion 111, flat portion 415) is constituted by a circumferentially facing surface (flat portion 415) of the first one of the vanes (41) and a circumferentially facing surface (flat portion 111) of a respective one of the shoes (11); and a circumferentially facing surface (flat portion 425, flat portion 435) of each of the vanes other than the first one (42, 43) and a circumferentially facing surface (flat portion 121, flat portion 131) of a respective one of the shoes (12, 13) are maintained out of contact with each other in the present embodiment, the first stopper mechanism may be alternatively constituted by the circumferentially facing surface (flat portion 425, flat portion 435) of one of the second vane 42 or third vane 43 and the circumferentially facing surface (flat portion 121, flat portion 131) of the respective one of the second shoe 12 or third shoe 13, or by a plurality of the circumferentially facing surfaces of the vanes and the circumferentially facing surfaces of the shoes.

Although the first stopper mechanism is constituted by the circumferentially facing surfaces of the vane and the shoe in the present embodiment, the first stopper mechanism may be constituted by another construction. For example, the first stopper mechanism may be constituted by a projection which is formed at the outside periphery of the rotor to extend outwardly in the radial direction of the rotor, similar to the second stopper mechanism.

Although the second stopper mechanism (stopper portion 419, second shoe 12) is constituted by the circumferentially facing surface of the shoe (second shoe 12), and the circumferentially facing surface of the projection (stopper portion 419) of the vane rotor (4) wherein the projection (stopper portion 419) projects outwardly in a radial direction of the rotor (40) from an outside periphery of the rotor (40) in the present embodiment, the second stopper mechanism may be constructed differently.

Although the lock position is set identical to the most retarded position or the most advanced position in the present embodiment, the lock position may be a different position as an initial position which is suitable for cranking operation of the internal combustion engine. In other words, the position within which rotation of the driven member (vane rotor 4) is restricted with respect to the housing HSG may be different from the initial position where the driven member (vane rotor 4) is locked during cranking operation of the internal combustion engine.

Although the engagement member (lock piston 51 of lock mechanism 5) is mounted in the vane 41 of the vane rotor 4 in the present embodiment, the engagement member (lock piston 51 of lock mechanism 5) may be mounted in the housing HSG, for example, in the shoe, and arranged to engage with the rotor of the vane rotor 4 for locking the vane rotor 4.

Although the engagement recess portion (sleeve 52 in lock mechanism 5) is provided in the rear plate 9 in the present embodiment, the engagement recess portion (sleeve 52 in lock mechanism 5) may be provided in the front plate 8.

Although the engagement member (lock piston 51 of lock mechanism 5) is implemented by the lock piston 51 which is hydraulically engaged and disengaged in the present embodiment, the lock mechanism may be constructed differently. For example, the lock mechanism my be implemented by a clutch mechanism or a lever mechanism.

Although the lock piston 51 is arranged to travel forward or rearward in the axis of rotation of vane rotor 4 in the present embodiment, the lock piston 51 may be arranged to travel in the radial direction of vane rotor 4.

Although the engagement recess portion (sleeve 52 in lock mechanism 5) is formed separately from the first plate (rear plate 9), and fixed to the first plate (rear plate 9) in the present embodiment, the engagement recess portion may be integrally formed in the first plate (rear plate 9).

Although the engagement recess portion (sleeve 52 in lock mechanism 5) is press-fitted in the recess 900 of the first plate (rear plate 9) in the present embodiment, the engagement recess portion may be fixed differently.

Although the lock piston 51 releases the lock state when a hydraulic pressure is applied to the tip of lock piston 51 so that lock piston 51 is brought out of the engagement recess portion (sleeve 52 in lock mechanism 5) in the present embodiment, this releasing mechanism may be replaced by a different construction.

Although the pulley 100 is formed integrally with the housing body 10 in the present embodiment, the pulley 100 may be formed separately from the housing body 10. Although the housing body 10 is formed integrally with the pulley 100 at an outside periphery of the housing body 10, wherein the pulley 100 extends in an axial direction of the housing body 10 all over the outside periphery of the housing body 10 in the present embodiment, the pulley 100 may be formed to extend in an axial direction of the housing body 10 partly over the outside periphery of the housing body 10. In this case, the pulleys 100 of the intake valve timing control apparatus 1*a* and the exhaust valve timing control apparatus 1*b* may be formed by cutting, etc., in different manners, from a common base workpiece of the housing body 10, into mirror images of each other.

Although the timing belt 1010 is employed to transmit a torque from the crankshaft to the housing body 10 in the present embodiment, the timing belt 1010 may be replaced with a timing chain or a gear. The pulley 100 may be replaced with a sprocket which is driven by a belt, or a gear which is driven by a gear.

The entire contents of Japanese Patent Applications Nos. 2009-045333, 2009-046208 and 2009-046226 filed Feb. 27, 2009 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus for an internal combustion engine, comprising:

a housing body having a hollow cylindrical shape having at least an open axial end, wherein the housing body is formed with a plurality of shoes at an inside periphery of the housing body, wherein each of the shoes projects inwardly in a radial direction of the housing body, and is formed with a first bolt hole, wherein the first bolt holes extend through the housing body in an axial direction of the housing body, and wherein the housing body is formed with a sealing recess at the open axial end of the housing body;

a vane rotor rotatably mounted in the housing body, wherein the vane rotor includes a vane, wherein the vane and the shoes define an advance chamber and a retard chamber between the vane rotor and housing body, and wherein the advance chamber and the retard chamber are adapted to supply and drainage of fluid;

a first plate fixedly inserted in the sealing recess of the housing body, the first plate sealing an axial end opening of the advance chamber and an axial end opening of the retard chamber, wherein the first plate is formed with second bolt holes whose positions are conformed to positions of the first bolt holes of the housing body respectively, and wherein the second bolt holes extend through the first plate;

a plurality of bolts that are inserted through respective ones of the first bolt holes of the housing body and respective ones of the second bolt holes of the first plate, for fixing the first plate to the housing body;

a pulley adapted to winding of a belt, and arranged to rotate with the housing body;

an annular first sealing ring arranged between an inside periphery of the sealing recess and an outside periphery of the first plate; and an annular second sealing ring arranged between the first plate and an axial end surface of one of the shoes, wherein the annular second sealing ring extends circumferentially around one of the second bolt holes.

2. The valve timing control apparatus as claimed in claim 1, wherein the first sealing ring is inserted in a groove formed in the outside periphery of the first plate.

3. The valve timing control apparatus as claimed in claim 1, wherein the second sealing ring is inserted in a groove formed in the first plate, wherein the groove extends circumferentially around one of the second bolt holes.

4. The valve timing control apparatus as claimed in claim 1, wherein an inside periphery of each of the second bolt holes is formed with a female thread so that the bolts are screwed in the second bolt holes.

5. The valve timing control apparatus as claimed in claim 1, wherein the first sealing ring is an O-ring having a circular cross section, and wherein the second sealing ring is an O-ring having a circular cross section.

6. The valve timing control apparatus as claimed in claim 1, wherein the housing body is formed of an aluminum-based metal.

7. The valve timing control apparatus as claimed in claim 6, wherein the first plate is formed of an iron-based metal.

8. The valve timing control apparatus as claimed in claim 7, wherein the first plate is formed by forging.

9. The valve timing control apparatus as claimed in claim 8, further comprising:

an engagement member mounted in the vane rotor for moving in an axial direction of the vane rotor selectively out of and into the vane rotor according to a state of operation of the internal combustion engine;

an engagement recess portion arranged in the first plate to receive insertion of the engagement member;

a positioning pin press-fitted in a recess formed in the first plate, wherein the recess is located adjacent to the engagement recess portion; and a positioning recess formed in the housing body, where a position of the positioning recess is conformed to a position of the positioning pin.

10. A valve timing control apparatus for an internal combustion engine, comprising:

a housing body having a hollow cylindrical shape having first and second open axial ends, wherein the housing body is formed with a plurality of shoes at an inside periphery of the housing body, wherein each of the shoes projects inwardly in a radial direction of the housing body, and is formed with a first bolt hole, wherein the first bolt holes extend through the housing body in an axial direction of the housing body, and wherein the housing body is formed with a sealing recess at the first open axial end of the housing body;

a vane rotor rotatably mounted in the housing body, wherein the vane rotor includes a vane, wherein the vane and the shoes define an advance chamber and a retard chamber between the vane rotor and housing body, and wherein the advance chamber and the retard chamber are adapted to supply and drainage of fluid;

a first plate fixedly inserted in the sealing recess of the housing body, the first plate sealing an axial end opening of the advance chamber and an axial end opening of the retard chamber, wherein the first plate is formed with second bolt holes whose positions are conformed to positions of the first bolt holes of the housing body respectively, wherein the second bolt holes extend through the first plate, and wherein an inside periphery of each of the second bolt holes is formed with a female thread;

a second plate sealing anther axial end of the advance chamber and another axial end of the retard chamber, wherein the second plate is formed with third bolt holes whose positions are conformed to the positions of the first bolt holes of the housing body respectively;

a plurality of bolts that are inserted through respective ones of the third bolt holes of the second plate and respective ones of the first bolt holes of the housing body, and screwed in respective ones of the second bolt holes of the first plate, for fixing the first plate to the housing body;

a pulley adapted to winding of a belt, and arranged to rotate with the housing body;

an annular first sealing ring arranged between an inside periphery of the sealing recess and an outside periphery of the first plate;

an annular second sealing ring arranged between the first plate and an axial end surface of one of the shoes, wherein the annular second sealing ring extends circumferentially around one of the second bolt holes; and an annular third sealing ring arranged between a portion of the second plate and a portion of the housing body which face each other, wherein the annular third sealing ring extends circumferentially inside of the first bolt holes of the housing body.

11. The valve timing control apparatus as claimed in claim 10, wherein the third sealing ring is inserted in a groove formed in the second plate.

12. The valve timing control apparatus as claimed in claim 11, wherein the second plate is formed by forging.

13. The valve timing control apparatus as claimed in claim 10, wherein the housing body is formed by extrusion.

14. A valve timing control apparatus for an internal combustion engine, comprising:

a housing body having a hollow cylindrical shape having at least an open axial end, wherein the housing body is formed with a plurality of shoes at an inside periphery of the housing body, wherein each of the shoes projects inwardly in a radial direction of the housing body, and is formed with a first bolt hole, wherein the first bolt holes extend through the housing body in an axial direction of the housing body, and wherein the housing body is formed with a sealing recess at the open axial end of the housing body;

a vane rotor rotatably mounted in the housing body, wherein the vane rotor includes a vane, wherein the vane and the shoes define an advance chamber and a retard chamber between the vane rotor and housing body, and wherein the advance chamber and the retard chamber are adapted to supply and drainage of fluid;

a first plate fixedly inserted in the sealing recess of the housing body, the first plate sealing an axial end opening of the advance chamber and an axial end opening of the retard chamber, wherein the first plate is formed with second bolt holes whose positions are conformed to positions of the first bolt holes of the housing body respectively, and wherein the second bolt holes extend through the first plate;

a plurality of bolts that are inserted through respective ones of the first bolt holes of the housing body and respective ones of the second bolt holes of the first plate, for fixing the first plate to the housing body; and a pulley adapted to winding of a belt, and arranged to rotate with the housing body;

wherein a boundary between an inside periphery of the sealing recess and an outside periphery of the first plate is sealed; and wherein a boundary between an axial end surface of one of the shoes and an annular portion of the first plate is sealed, wherein the annular portion extends circumferentially around one of the second bolt holes.

15. The valve timing control apparatus as claimed in claim 14, further comprising a second plate sealing another axial end opening of the advance chamber and another axial end opening of the retard chamber, wherein a boundary between surfaces of the second plate and the housing body which face each other.

16. The valve timing control apparatus as claimed in claim 14, wherein an inside periphery of each of the second bolt holes is formed with a female thread so that the bolts are screwed in the second bolt holes.

17. The valve timing control apparatus as claimed in claim 14, wherein the housing body is formed of an aluminum-based metal.

18. The valve timing control apparatus as claimed in claim 17, wherein the first plate is formed of an iron-based metal.

19. The valve timing control apparatus as claimed in claim 18, wherein the first plate is formed by forging.

20. The valve timing control apparatus as claimed in claim 14, further comprising:

an engagement member mounted in the vane rotor for moving in an axial direction of the vane rotor selectively out of and into the vane rotor according to a state of operation of the internal combustion engine;

an engagement recess portion arranged in the first plate to receive insertion of the engagement member;

a positioning pin press-fitted in a recess formed in the first plate, wherein the recess is located adjacent to the engagement recess portion; and a positioning recess formed in the housing body, where a position of the positioning recess is conformed to a position of the positioning pin.

* * * * *